US007591050B2

(12) United States Patent
Hammerslag

(10) Patent No.: US 7,591,050 B2
(45) Date of Patent: Sep. 22, 2009

(54) FOOTWEAR LACING SYSTEM

(75) Inventor: Gary R. Hammerslag, Steamboat Springs, CO (US)

(73) Assignee: Boa Technology, Inc., Steamboat Springs, CO (US)

( * ) Notice: Subject to any disclaimer, the term of this patent is extended or adjusted under 35 U.S.C. 154(b) by 278 days.

(21) Appl. No.: 10/459,843

(22) Filed: Jun. 12, 2003

(65) Prior Publication Data

US 2003/0204938 A1 Nov. 6, 2003

Related U.S. Application Data

(63) Continuation-in-part of application No. 09/993,296, filed on Nov. 14, 2001, now abandoned, which is a continuation-in-part of application No. 09/956,601, filed on Sep. 18, 2001, now abandoned, which is a continuation of application No. 09/388,756, filed on Sep. 2, 1999, now Pat. No. 6,289,558, which is a continuation-in-part of application No. 09/337,763, filed on Jun. 22, 1999, now Pat. No. 6,202,953, which is a continuation of application No. 08/917,056, filed on Aug. 22, 1997, now Pat. No. 5,934,599.

(51) Int. Cl.
*A43C 11/00* (2006.01)
*A43B 5/16* (2006.01)

(52) U.S. Cl. ..... 24/68 SK; 36/50.5

(58) Field of Classification Search ..... 24/68 SK, 24/909, 714.6–715.2, 71.1; 36/50.1, 50.5
See application file for complete search history.

(56) References Cited

U.S. PATENT DOCUMENTS

| | | | |
|---|---|---|---|
| 80,834 | A | 8/1868 | Prussia |
| 117,530 | A | 8/1871 | Foote |
| 228,946 | A | 6/1880 | Schulz |
| 230,759 | A | 8/1880 | Drummond |
| 746,563 | A | 12/1903 | McMahon |
| 908,704 | A | 1/1909 | Sprinkle |
| 1,060,422 | A | 4/1913 | Bowdish |
| 1,062,511 | A | 5/1913 | Short |

(Continued)

FOREIGN PATENT DOCUMENTS

| | | |
|---|---|---|
| CA | 2114387 | 8/1994 |

(Continued)

OTHER PUBLICATIONS

ASOLO® Boat Brochure/Catalog, undated.

(Continued)

*Primary Examiner*—James R Brittain
(74) *Attorney, Agent, or Firm*—Knobbe, Martens, Olson & Bear, LLP

(57) ABSTRACT

Disclosed is a footwear lacing system comprising a lace attached to a tightening mechanism. The lace extends through a series of guide members positioned along two opposing footwear closure portions. The lace and guides preferably have low friction surfaces to facilitate sliding of the lace along the guide members so that the lace evenly distributes tension across the footwear member. The tightening mechanism allows incremental adjustment of the tension of the lace. A release mechanism allows a user to quickly loosen the lace. A safety mechanism inhibits unintentional and/or accidental loosing of the lace.

181 Claims, 44 Drawing Sheets

U.S. PATENT DOCUMENTS

| | | | |
|---|---|---|---|
| 1,090,438 | A | 3/1914 | Worth et al. |
| 1,170,472 | A | 2/1916 | Barber |
| 1,288,859 | A | 12/1918 | Feller et al. |
| 1,393,188 | A | 10/1921 | Whiteman |
| 1,412,486 | A | 4/1922 | Paine |
| 1,416,203 | A | 5/1922 | Hobson |
| 1,469,661 | A | 10/1923 | Migita |
| 1,481,903 | A | 1/1924 | Hart |
| 1,530,713 | A | 3/1925 | Clarkk |
| 1,995,243 | A | 3/1935 | Clarke |
| 2,088,851 | A | 8/1937 | Gantenbein |
| 2,109,751 | A | 3/1938 | Matthias et al. |
| 2,124,310 | A | 7/1938 | Murr, Jr. |
| 2,316,102 | A | 4/1943 | Preston |
| 2,539,026 | A | 1/1951 | Mangold |
| 2,611,940 | A | 9/1952 | Caims |
| 2,673,381 | A | 3/1954 | Dueker |
| 2,907,086 | A | 10/1959 | Ord |
| 3,035,319 | A | 5/1962 | Wolff |
| 3,112,545 | A | 12/1963 | Williams |
| 3,163,900 | A | 1/1965 | Martin |
| 3,169,325 | A | 2/1965 | Fesl |
| 3,197,155 | A | 7/1965 | Chow |
| 3,221,384 | A | 12/1965 | Aufenacker |
| 3,276,090 | A | 10/1966 | Nigon |
| 3,401,437 | A | 9/1968 | Christophersen |
| 3,430,303 | A | 3/1969 | Perrin et al. |
| 3,491,465 | A | 1/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 4,130,949 | A | 12/1978 | Siedel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,433,456 | A | 2/1984 | Baggio |
| 4,480,395 | A | 11/1984 | Schoch |
| 4,551,932 | A | 11/1985 | Schoch |
| 4,555,830 | A | 12/1985 | Petrini |
| 4,574,500 | A | 3/1986 | Aldinio et al. |
| 4,616,524 | A | 10/1986 | Bidoia |
| 4,620,378 | A | 11/1986 | Sartor |
| 4,631,840 | A | 12/1986 | Gamm |
| 4,633,599 | A | 1/1987 | Morell et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,870,723 | A * | 10/1989 | Pozzobon et al. ..... 24/68 SK |
| 4,870,761 | A | 10/1989 | Tracy |
| 4,884,760 | A | 12/1989 | Baggio et al. |
| 4,937,953 | A | 7/1990 | Walkhoff |
| 4,961,544 | A | 10/1990 | Bidoria |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | De Bortoli et al. |
| 5,065,481 | A | 11/1991 | Walkhoff |
| 5,117,567 | A | 6/1992 | Berger |
| 5,152,038 | A | 10/1992 | Schoch |
| 5,157,813 | A | 10/1992 | Carroll |
| 5,177,882 | A | 1/1993 | Berger |
| 5,181,331 | A | 1/1993 | Berger |
| 5,184,378 | A | 2/1993 | Batra |
| D333,552 | S | 3/1993 | Berger et al. |
| 5,249,377 | A | 10/1993 | Walkhoff |
| 5,259,094 | A | 11/1993 | Zepeda |
| 5,315,741 | A | 5/1994 | Dubberke |
| 5,319,868 | A | 6/1994 | Hallenbeck |
| 5,325,613 | A | 7/1994 | Sussmann |
| 5,327,662 | A | 7/1994 | Hallenbeck |
| 5,335,401 | A | 8/1994 | Hanson |
| 5,341,583 | A | 8/1994 | Hallenbeck |
| 5,345,697 | A | 9/1994 | Quellais |
| 5,355,596 | A | 10/1994 | Sussman |
| 5,357,654 | A | 10/1994 | Hsing-Chi |
| 5,381,609 | A | 1/1995 | Hieldinger |
| 5,425,185 | A | 6/1995 | Gansler |
| 5,430,960 | A | 7/1995 | Richardson |
| 5,463,822 | A | 11/1995 | Miller |
| 5,477,593 | A | 12/1995 | Leick |
| 5,502,902 | A | 4/1996 | Sussmann |
| 5,511,325 | A | 4/1996 | Hieblinger |
| 5,535,531 | A | 7/1996 | Karabed et al. |
| 5,537,763 | A | 7/1996 | Donnadieu et al. |
| 5,557,864 | A | 9/1996 | Marks |
| 5,566,474 | A | 10/1996 | Leick et al. |
| 5,599,000 | A | 2/1997 | Bennett |
| 5,600,874 | A | 2/1997 | Jungkind |
| 5,606,778 | A | 3/1997 | Jungkind |
| 5,638,588 | A | 6/1997 | Jungkind |
| 5,640,785 | A | 6/1997 | Egelja |
| 5,647,104 | A | 7/1997 | James |
| 5,651,198 | A | 7/1997 | Sussmann |
| 5,669,116 | A | 9/1997 | Jungkind |
| 5,718,021 | A | 2/1998 | Tatus |
| 5,732,483 | A | 3/1998 | Cagliari |
| 5,737,854 | A | 4/1998 | Sussmann |
| 5,755,044 | A | 5/1998 | Veylupek |
| 5,784,809 | A | 7/1998 | McDonald |
| 5,819,378 | A | 10/1998 | Doyle |
| 5,934,599 | A | 8/1999 | Hammerslag |
| 5,956,823 | A | 9/1999 | Borel |
| 6,052,921 | A | 4/2000 | Oreck |
| 6,119,318 | A | 9/2000 | Maurer |
| 6,148,489 | A | 11/2000 | Dickie et al. |
| 6,202,953 | B1 | 3/2001 | Hammerslag |
| 6,267,390 | B1 | 7/2001 | Maravetz et al. |
| 6,289,558 | B1 | 9/2001 | Hammerslag |
| 6,543,159 | B1 | 4/2003 | Carpenter et al. |
| 6,708,376 | B1 | 3/2004 | Landry |
| 6,711,787 | B2 | 3/2004 | Jungkind et al. |
| 6,757,991 | B2 | 7/2004 | Sussmann |
| 6,877,256 | B2 | 4/2005 | Martin et al. |
| 7,134,224 | B2 | 11/2006 | Elkington et al. |
| 7,281,341 | B2 | 10/2007 | Reagan et al. |
| 7,331,126 | B2 | 2/2008 | Johnson |
| 2002/0178548 | A1 | 12/2002 | Freed |
| 2003/0177662 | A1 | 9/2003 | Elkington et al. |
| 2005/0054962 | A1 | 3/2005 | Bradshaw |
| 2006/0156517 | A1 | 7/2006 | Hammerslag |
| 2007/0169378 | A1 | 7/2007 | Sodeberg et al. |

| | | | |
|---|---|---|---|
| 2008/0060167 | A1 | 3/2008 | Hammerslag |
| 2008/0060168 | A1 | 3/2008 | Hammerslag |
| 2008/0066272 | A1 | 3/2008 | Hammerslag |
| 2008/0066345 | A1 | 3/2008 | Hammerslag |
| 2008/0066346 | A1 | 3/2008 | Hammerslag |
| 2008/0083135 | A1 | 4/2008 | Hammerslag |

FOREIGN PATENT DOCUMENTS

| | | | |
|---|---|---|---|
| CH | 204834 | A | 5/1939 |
| DE | 7043154.8 | | 11/1970 |
| DE | 23 41 658 | | 3/1974 |
| DE | 29 00 077 | A1 | 7/1980 |
| DE | 36 26 837 | A1 | 2/1988 |
| DE | 38 13 470 | A1 | 11/1989 |
| DE | 3822113 | | 1/1990 |
| DE | 0 589 232 | A1 | 3/1994 |
| DE | 42 30 652 | A1 | 3/1994 |
| DE | 42 30 653 | A1 | 3/1994 |
| DE | 4302401 | A1 | 8/1994 |
| DE | 43 05 671 | A1 | 9/1994 |
| DE | 94 13 147 | U | 10/1994 |
| DE | 93 15 776.2 | | 2/1995 |
| DE | 295 03 552.8 | | 4/1995 |
| DE | 196 24 553 | A1 | 1/1998 |
| DE | 201 16 755 | U1 | 1/2002 |
| EP | 0 123 050 | A1 | 2/1984 |
| EP | 0 081 042 | B1 | 12/1984 |
| EP | 0 056 953 | B1 | 11/1985 |
| EP | 0 201 051 | A1 | 11/1986 |
| EP | 0 099 504 | B1 | 1/1987 |
| EP | 0 255 869 | A2 | 7/1987 |
| EP | 0 155 596 | B1 | 1/1988 |
| EP | 0 393 380 | A1 | 3/1990 |
| EP | 0 474 708 | B1 | 9/1993 |
| EP | 0 679 346 | A1 | 11/1995 |
| EP | 0693260 | A2 | 1/1996 |
| EP | 0 717 942 | A1 | 6/1996 |
| EP | 0 734 662 | A1 | 10/1996 |
| EP | 0 858 819 | A1 | 8/1998 |
| EP | 0 858 821 | A2 | 8/1998 |
| EP | 0 923 965 | A1 | 6/1999 |
| EP | 0 937 487 | A1 | 8/1999 |
| EP | 0 848 917 | B1 | 4/2000 |
| EP | 1 219 195 | A1 | 7/2002 |
| FR | 3.349.832 | | 3/1963 |
| FR | 1.404.799 | | 7/1964 |
| FR | 2.019.991 | A | 7/1970 |
| FR | 2399811 | | 3/1979 |
| FR | 2 565 795 | A1 | 6/1984 |
| FR | 2 598 292 | A1 | 5/1986 |
| FR | 2 726 440 | A1 | 5/1996 |
| FR | 2 770 379 | A1 | 5/1999 |
| FR | 2 814 919 | A1 | 4/2002 |
| GB | 11673 | | 6/1899 |
| GB | 216400 | | 5/1924 |
| JP | 53-124987 | | 10/1978 |
| JP | 6-284906 | | 10/1994 |
| JP | 7-208 | | 1/1995 |
| JP | 2001-197905 | | 7/2001 |
| JP | 2004-041666 | | 2/2004 |
| WO | WO 95/03720 | | 2/1995 |
| WO | WO 95/11602 | | 5/1995 |
| WO | WO 98/37782 | | 9/1998 |
| WO | WO 99/09850 | | 3/1999 |
| WO | WO 99/15043 | | 4/1999 |
| WO | WO 99/15043 | A1 | 4/1999 |
| WO | WO 00/53045 | | 9/2000 |
| WO | WO 00/76337 | A1 | 12/2000 |
| WO | WO 00/76603 | A1 | 12/2000 |
| WO | WO 01/08525 | A1 | 2/2001 |
| WO | WO 02/051511 | A1 | 7/2002 |
| WO | WO 2004/093589 | A1 | 11/2004 |
| WO | WO 2007/016983 | | 2/2007 |

OTHER PUBLICATIONS

U.S. Appl. No. 09/993,296, filed Nov. 14, 2001, pending.
U.S. Appl. No. 60/623,341, filed Oct. 29, 2004, pending.
U.S. Appl. No. 60/704,831, filed Aug. 2, 2005, pending.
Partial European Search Report dated Sep. 10, 2004.
Derwent abstract for DE 42 30 652 A1.
Derwent abstract for DE 42 30 653 A1.
Derwent abstract for DE 43 05 671 A1.
Delphion report and Derwent record for DE 0 123 050 A1 dated Mar. 23, 2006.
Delphion report and Derwent record for FR 2 598 292 A1 dated Mar. 23, 2006.
Delphion report and Derwent record for FR 2 565 795 A1 dated Mar. 22, 2006.
Delphion report and Derwent record for EP 0 474 708 B1 dated Mar. 23, 2006.
Derwent record for DE 196 24 553 A1 dated Mar. 28, 2006.
U.S. Appl. No. 11/650,665, filed Jan. 8, 2007, pending.
U.S. Appl. No. 11/070,579, filed Mar. 1, 2005, pending.
U.S. Appl. No. 11/263,253, filed Oct. 31, 2005, pending.
U.S. Appl. No. 11/841,872, filed Aug. 20, 2007, pending.
U.S. Appl. No. 11/841,997, filed Aug. 20, 2007, pending.
U.S. Appl. No. 11/842,005, filed Aug. 20, 2007, pending.
U.S. Appl. No. 11/842,009, filed Aug. 20, 2007, pending.
U.S. Appl. No. 11/842,013, filed Aug. 20, 2007, pending.
U.S. Appl. No. 61/022,045, filed Jan. 18, 2008, pending.
U.S. Appl. No. 11/854,522, filed Sep. 12, 2007, pending.

* cited by examiner

FOOTWEAR LACING SYSTEM

This application is a continuation-in-part of U.S. patent application Ser. No. 09/993,296 filed Nov. 14, 2001, which is a continuation-in-part of U.S. patent application Ser. No. 09/956,601 filed on Sep. 18, 2001, which is a continuation of U.S. patent application Ser. No. 09/388,756 filed on Sep. 2, 1999, now U.S. Pat. No. 6,289,558 which is a continuation-in-part of U.S. patent application Ser. No. 09/337,763 filed on Jun. 22, 1999, now U.S. Pat. No. 6,202,953 B1 which is a continuation of U.S. patent application Ser. No. 08/917,056 filed Aug. 22, 1997, now U.S. Pat. No. 5,934,599.

The present invention relates to footwear. More particularly, the present invention relates to a low-friction lacing system that provides equilibrated tightening pressure across a wearer's foot for sports boots and shoes.

BACKGROUND OF THE INVENTION

There currently exists a number of mechanisms and methods for tightening a shoe or boot around a wearer's foot. A traditional method comprises threading a lace in a zig-zag pattern through eyelets that run in two parallel rows attached to opposite sides of the shoe. The shoe is tightened by first tensioning opposite ends of the threaded lace to pull the two rows of eyelets towards the midline of the foot and then tying the ends in a knot to maintain the tension. A number of drawbacks are associated with this type of lacing system. First, laces do not adequately distribute the tightening force along the length of the threaded zone, due to friction between the lace and the eyelets, so that portions of the lace are slack and other portions are in tension. Consequently, the higher tensioned portions of the shoe are tighter around certain sections of the foot, particularly the ankle portions which are closer to the ends. This is uncomfortable and can adversely affect performance in some sports.

Another drawback associated with conventional laces is that it is often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions and sometimes much of the foot in tension even when the knot is released. Consequently, the user must often loosen the lace individually from each of the eyelets. This is especially tedious if the number of eyelets is high, such as in ice-skating boots or other specialized high performance footwear.

Another tightening mechanism comprises buckles which clamp together to tighten the shoe around the wearer's foot. Typically, three to four or more buckles are positioned over the upper portion of the shoe. The buckles may be quickly clamped together and drawn apart to tighten and loosen the shoe around the wearer's foot. Although buckles may be easily and quickly tightened and untightened, they also have certain drawbacks. Specifically, buckles isolate the closure pressure across three or four points along the wearer's foot corresponding to the locations of the buckles. This is undesirable in many circumstances, such as for the use of sport boots where the wearer desires a force line that is evenly distributed along the length of the foot. Another drawback of buckles is that they are typically only useful for hard plastic or other rigid material boots. Buckles are not as practical for use with softer boots, such as ice skates or snowboard boots.

There is therefore a need for a tightening system for footwear that does not suffer from the aforementioned drawbacks. Such a system should automatically distribute lateral tightening forces along the length of the wearer's ankle and foot. The tightness of the shoe should desirably be easy to loosen and incrementally adjust. The tightening system should close tightly and should not loosen up with continued use.

SUMMARY OF THE INVENTION

There is provided in accordance with one aspect of the present invention, a footwear lacing system. The system comprises a footwear member including first and second opposing sides configured to fit around a foot. A plurality of lace guide members are positioned on the opposing sides. A lace is guided by the guide members, the lace being rotationally connected to a spool that is rotatable in a winding direction and an unwinding direction. A tightening mechanism is attached to the footwear member, and coupled to the spool, the tightening mechanism including a control for winding the lace around the spool to place tension on the lace thereby pulling the opposing sides towards each other. A safety device is moveable between a secure position in which the spool is unable to rotate in an unwinding direction, and a releasing position in which the spool is free to rotate in an unwinding direction.

In one embodiment, the lace is slideably positioned around the guide members to provide a dynamic fit in response to movement of the foot within the footwear. The guide members may have a substantially C-shaped cross section.

Additionally, the tightening mechanism is a rotatable reel that is configured to receive the lace. In accordance with one embodiment, a knob rotates the spool and thereby winds the lace about the spool. In some embodiments, rotating the knob in an unwinding direction releases the spool and allows the lace to unwind. A safety device can be attached, such as a lever, that selectively allows the knob to rotate in an unwinding direction to release the spool. Alternatively, the safety device can be a rotatable release that is rotated separately from the knob to release the spool.

In certain embodiments, the footwear lacing system is attached to footwear having a first opposing side configured to extend from one side of the shoe, across the upper midline of the shoe, and to the opposing side of the shoe. As such, the reel can be mounted to the first opposing side.

In one embodiment, the lace is formed of a polymeric fiber.

According to another aspect of the footwear lacing system, a closure system for footwear having an upper with a lateral side and a medial side, the closure system comprising at least a first lace guide attached to the lateral side of the upper, at least a second lace guide attached to the medial side of the upper, and each of the first and second lace guides comprising a lace pathway, a lace slideably extending along the lace pathway of each of the first and second lace guides. Additionally, a tightening reel of the footwear for retracting the lace and thereby advancing the first lace guide towards the second lace guide to tighten the footwear is positioned on the footwear, and a lock is moveable between a coupled position and an uncoupled position wherein the lock allows the reel to be only rotatable in a forward direction when the lock is engaged, and allows the reel to be rotatable in a reverse direction when the lock is disengaged.

An embodiment also includes a closed loop lace wherein the lace is permanently mounted in the reel. Accordingly, each of the at least first and second lace guides comprise an open channel to receive the closed loop lace.

According to another embodiment of the footwear lacing system, a spool and lace unit is provided for use in conjunction with a footwear lacing system comprises a spool having ratchet teeth disposed on its periphery configured to interact with a pawl for inhibiting relative rotation of the spool in at least one direction, and a lace securely attached to the spool. Optionally, the lace can be formed of a lubricious polymer having a relatively low elasticity and high tensile strength. Alternatively, the lace can be formed of a multi-strand polymeric cable.

BRIEF DESCRIPTION OF THE DRAWINGS

FIG. 31A is a cross section through a knob showing integrally molded pawls, while FIG. 31B is a cross-section taken along lines 31B of FIG. 31A

DETAILED DESCRIPTION OF PREFERRED EMBODIMENTS

Figure 1:
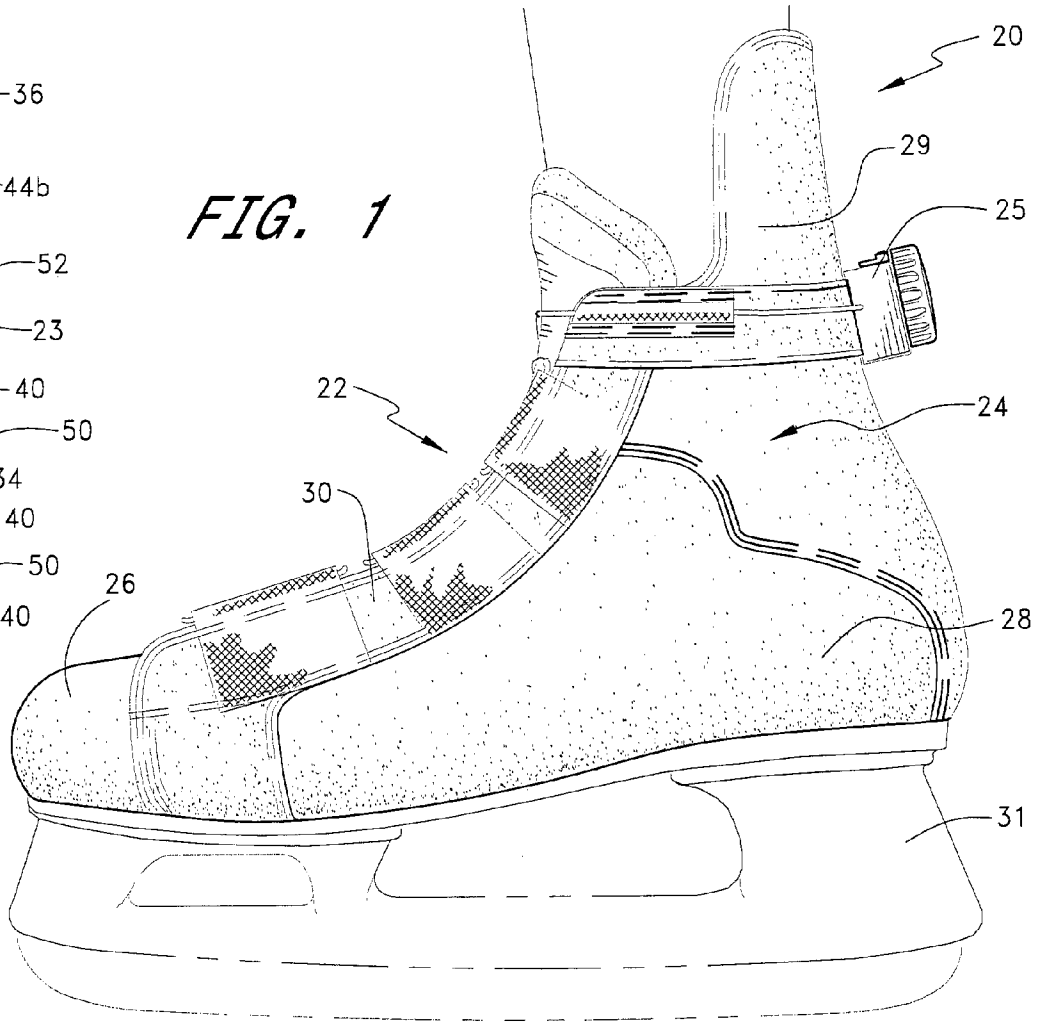
FIG. 1 is a side view of a sport boot including a lacing system configured in accordance with the present invention.

Referring to FIG. 1, there is disclosed one embodiment of a sport boot 20 prepared in accordance with the present invention. The sport boot 20 generally comprises an ice skating or other action sport boot which is tightened around a wearer's foot using a lacing system 22. The lacing system 22 includes a lace 23 (FIG. 2) that is threaded through the boot 20 and attached at opposite ends to a tightening mechanism 25, as described in detail below. As used herein, the terms lace and cable have the same meaning unless specified otherwise. The lace 23 is a low friction lace that slides easily through the boot 20 and automatically equilibrates tightening of the boot 20 over the length of the lacing zone, which generally extends along the ankle and foot. Although the present invention will be described with reference to an ice skating boot, it is to be understood that the principles discussed herein are readily applicable to any of a wide variety of footwear, and are particularly applicable to sports shoes or boots suitable for snow boarding, roller skating, skiing and the like.

The boot 20 includes an upper 24 comprising a toe portion 26, a heel portion 28, and an ankle portion 29 that surrounds the wearer's ankle. An instep portion 30 of the upper 24 is interposed between the toe portion 26 and the ankle portion 29. The instep portion 30 is configured to fit around the upper part of the arch of the medial side of the wearer's foot between the ankle and the toes. A blade 31 (shown in phantom lines) extends downward from the bottom of the boot 20 in an ice-skating embodiment.

Figure 2:
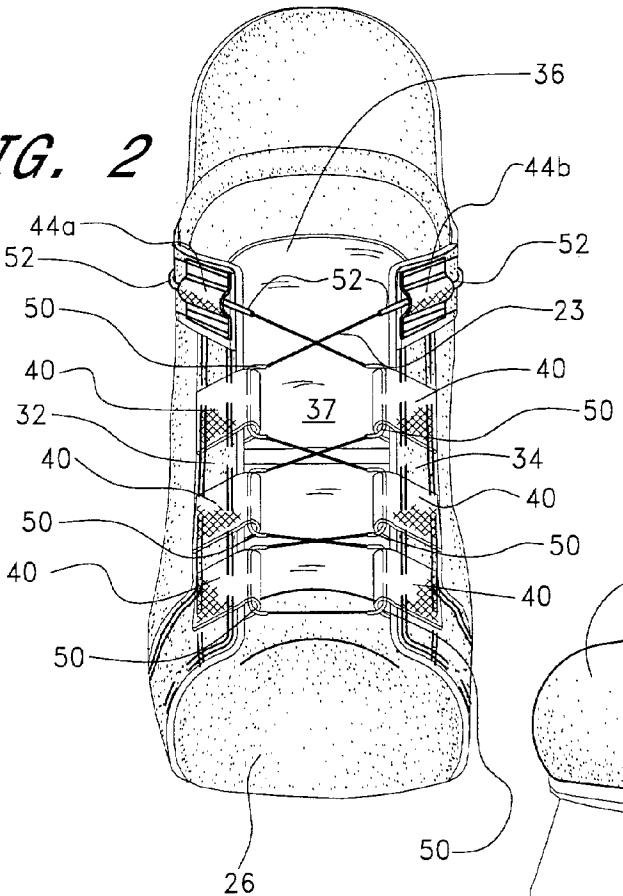
FIG. 2 is a front view of the sport boot of FIG. 1.

FIG. 2 is a front elevational view of the boot 20. As shown, the top of the boot 20 generally comprises two opposed closure edges or flaps 32 and 34 that partially cover a tongue 36. Generally, the lace 23 may be tensioned to draw the flaps 32 and 34 toward each other and tighten the boot 20 around the foot, as described in detail below. Although the inner edges of the flaps 32 and 34 are shown separated by a distance, it is understood that the flaps 32 and 34 could also be sized to overlap each other when the boot 20 is tightened, such as is known with ski footwear. Thus, references herein to drawing opposing sides of footwear towards each other refers to the portion of the footwear on the sides of the foot. This reference is thus generic to footwear in which opposing edges remain spaced apart even when tight (e.g. tennis shoes) and footwear in which opposing edges may overlap when tight (e.g. certain snow skiing boots). In both, tightening is accomplished by drawing opposing sides of the footwear towards each other.

Referring to FIG. 2, the tongue 36 extends rearwardly from the toe portion 26 toward the ankle portion 29 of the boot 20. Preferably, the tongue 36 is provided with a low friction top surface 37 to facilitate sliding of the flaps 32 and 34 and lace 23 over the surface of the tongue 32 when the lace 23 is tightened. The low friction surface 37 may be formed integrally with the tongue 32 or applied thereto such as by adhesives, heat bonding, stitching or the like. In one embodiment, the surface 37 is formed by adhering a flexible layer of nylon or polytetrafluoroethylene to the top surface of the tongue 36. The tongue 36 is preferably manufactured of a soft material, such as leather.

The upper 24 may be manufactured from any from a wide variety of materials known to those skilled in the art. In the case of a snow board boot, the upper 24 is preferably manufactured from a soft leather material that conforms to the shape of the wearer's foot. For other types of boots or shoes, the upper 24 may be manufactured of a hard or soft plastic. It is also contemplated that the upper 24 could be manufactured from any of a variety of other known materials.

As shown in FIG. 2, the lace 23 is threaded in a crossing pattern along the midline of the foot between two generally parallel rows of side retaining members 40 located on the flaps 32 and 34. In the illustrated embodiment, the side retaining members 40 each consist of a strip of material looped around the top and bottom edges of the flaps 32 and 34 so as to define a space in which guides 50 are positioned. The lace 23 slides through the guides 50 during tightening and untightening of the lace 23, as described more fully below. In the illustrated embodiment, there are three side retaining members 40 on each flap 32, 34 although the number of retaining members 40 may vary. In some embodiments, four, five or six or more retaining members 40 may be desirable on each side of the boot.

In certain boot designs, it may be possible during the tightening process for an opposing pair of lace guides to "bottom out" and come in contact with each other before that portion of the boot is suitably tightened. Further tightening of the system will not produce further tightening at that point. Rather, other portions of the boot which may already be sized appropriately would continue to tighten. In the embodiment illustrated in FIG. 2, the side retaining members 40 each consist of a strip of material looped around the guides 50. Additional adjustability may be achieved by providing a releasable attachment between the side retaining members 40 and the corresponding flap 32 or 34 of the shoe. In this manner, the side retaining member 40 may be moved laterally away from the midline of the foot to increase the distance between opposing lace guides.

One embodiment of the adjustable side retaining member 40 may be readily constructed, that will appear similar to the structure disclosed in FIG. 2. In the adjustable embodiment, a first end of the strip of material is attached to the corresponding flap 32 or 34 using conventional means such as rivets, stitching, adhesives, or others known in the art. The strip of material loops around the guide 50, and is folded back over the outside of the corresponding flap 32 or 34 as illustrated. Rather than stitching the top end of the strip of material to the flap, the corresponding surfaces between the strip of material and the flap may be provided with a releasable engagement structure such as hook and loop structures (e.g., Velcro®), or other releasable engagement locks or clamps which permits lateral-medial adjustability of the position of the guide 50 with respect to the edge of the corresponding flap 32 or 34.

The guides 50 may be attached to the flaps 32 and 34 or to other spaced apart portions of the shoe through any of a variety of manners, as will be appreciated by those of skill in the art in view of the disclosure herein. For example, the retaining members 40 can be deleted and the guide 50 sewn directly onto the surface of the flap 32 or 34 or opposing sides of the upper. Stitching the guide 50 directly to the flap 32 or 34 may advantageously permit optimal control over the force distribution along the length of the guide 50. For example, when the lace 23 is under relatively high levels of tension, the guide 50 may tend to want to bend and to possibly even kink near the curved transition in between longitudinal portion 51 and transverse portion 53 as will be discussed. Bending of the guide member under tension may increase friction between the guide member and the lace 23, and, severe bending or kinking of the guide member 50 may undesirably interfere with the intended operation of the lacing system. Thus, the attachment mechanism for attaching the guide member 50 to the shoe preferably provides sufficient support of the guide member to resist bending and/or kinking. Sufficient support is particularly desirable on the inside radius of any curved portions particularly near the ends of the guide member 50.

As shown in FIGS. 1 and 2, the lace 23 also extends around the ankle portion 29 through a pair of upper retaining members 44*a* and 44*b* located on the ankle portion 29. The upper retaining members 44*a* and 44*b* each comprise a strip of material having a partially raised central portion that defines a space between the retaining members 44 and the upper 24. An upper guide member 52 extends through each of the spaces for guiding the lace 23 around either side of the ankle portion 29 to the tightening mechanism 25.

Figure 3:
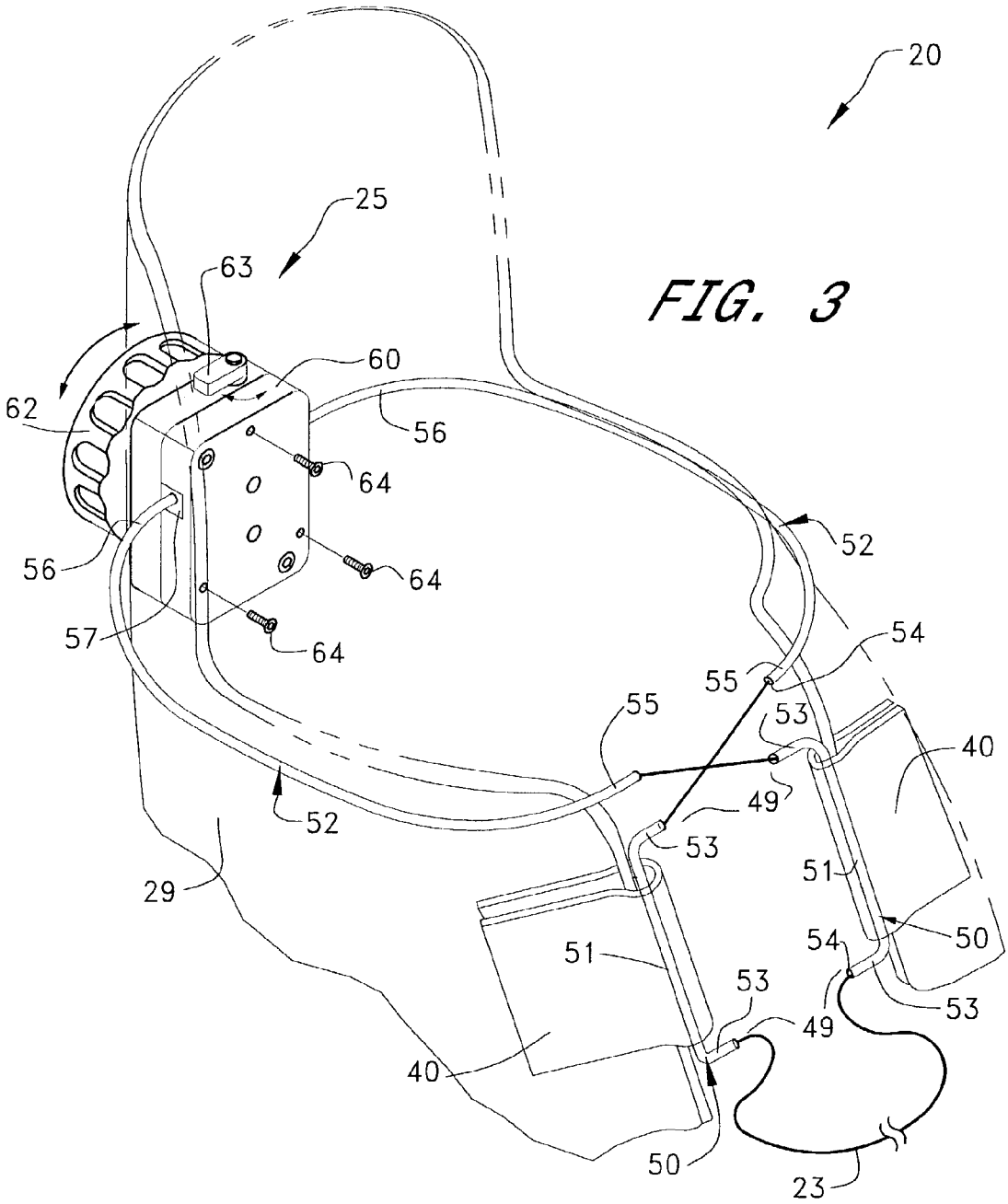
FIG. 3 is a perspective schematic view of the lacing system of the sport boot of FIG. 1.

FIG. 3 is a schematic perspective view of the lacing system 22 of the boot 20. As shown, each of the side and top guide members 50 and 52, has a tube-like configuration having a central lumen 54. Each lumen 54 has an inside diameter that is larger than the outside diameter of the lace 23 to facilitate sliding of the lace 23 through the side and top guide members 50, 52 and prevent binding of the lace 23 during tightening and untightening. In one embodiment, the inside diameter of the lumen is approximately 0.040 inches, to cooperate with a lace having an outside diameter of about 0.027". However, it will be appreciated that the diameter of the lumen 54 can be varied to fit specific desired lace dimensions and other design considerations. The wall thickness and composition of the guides 50, 52 may be varied to take into account the physical requirements imposed by particular shoe designs.

Thus, although the guides 50 are illustrated as relatively thin walled tubular structures, any of a variety of guide structures may be utilized as will be apparent to those of skill in the art in view of the disclosure herein. For example, either permanent (stitched, glued, etc.) or user removable (Velcro, etc.) flaps 40 may be utilized to hold down any of a variety of guide structures. In one embodiment, the guide 50 is a molded block having a lumen extending therethrough. This may take a form similar to that illustrated in FIG. 4A, 4B or 6. Modifications of the forgoing may also be accomplished, such as by extending the length of the lace pathway in a structure such as that illustrated in FIG. 6, such that the overall part has a shallow "U" shaped configuration which allows it to be conveniently retained by the retention structure 40. Providing a guide member 50 having increased structural integrity over that which would be achieved by the thin tube illustrated in FIG. 2 may be advantageous in embodiments of the invention where the opposing guides 50 may be tightened sufficiently to "bottom out" against the opposing corresponding guide, as will be apparent to those of skill in the art in view of the disclosure herein. Solid and relatively harder lace guides as described above may be utilized throughout the boot, but may be particularly useful in the lower (e.g. toe) portion of the boot.

In general, each of the guide members 50 and 52 defines a pair of openings 49 that communicate with opposite ends of the lumen 54. The openings 49 function as inlets/outlets for the lace 23. The openings desirably are at least as wide as the cross-section of the lumen 54.

As may be best seen in FIG. 3, each top guide 52 has an end 55 which is spaced apart from a corresponding side guide 50 on the opposing side of the footwear, with the lace 23 extending therebetween. As the system is tightened, the spacing distance will be reduced. For some products, the wearer may prefer to tighten the toe or foot portion more than the ankle. This can be conveniently accomplished by limiting the ability of the side guide 50 and top guide 52 to move towards each other beyond a preselected minimum distance during the tightening process. For this purpose, a selection of spacers having an assortment of lengths may be provided with each system. The spacers may be snapped over the section of lace 23 between a corresponding end 55 of top guide 52 and side guide 50. When the ankle portion of the boot is sufficiently tight, yet the wearer would like to additionally tighten the toe or foot portion of the boot, a spacer having the appropriate length may be positioned on the lace 23 in-between the top guide 52 and side guide 50. Further tightening of the system will thus not be able to draw the top guide 52 and corresponding side guide 50 any closer together.

The stop may be constructed in any of a variety of ways, such that it may be removably positioned between the top guide 52 and side guide 50 to limit relative tightening movement. In one embodiment, the stop comprises a tubular sleeve having an axial slot extending through the wall, along the length thereof. The tubular sleeve may be positioned on the boot by advancing the slot over the lace 23, as will be apparent to those of skill in the art. A selection of lengths may be provided, such as ½ inch, 1 inch, -1½ inch, and every half inch increment, on up to 3 or 4 inches or more, depending upon the position of the reel on the boot and other design features of a particular embodiment of the boot. Increments of ¼ inch may also be utilized, if desired.

Figure 22:
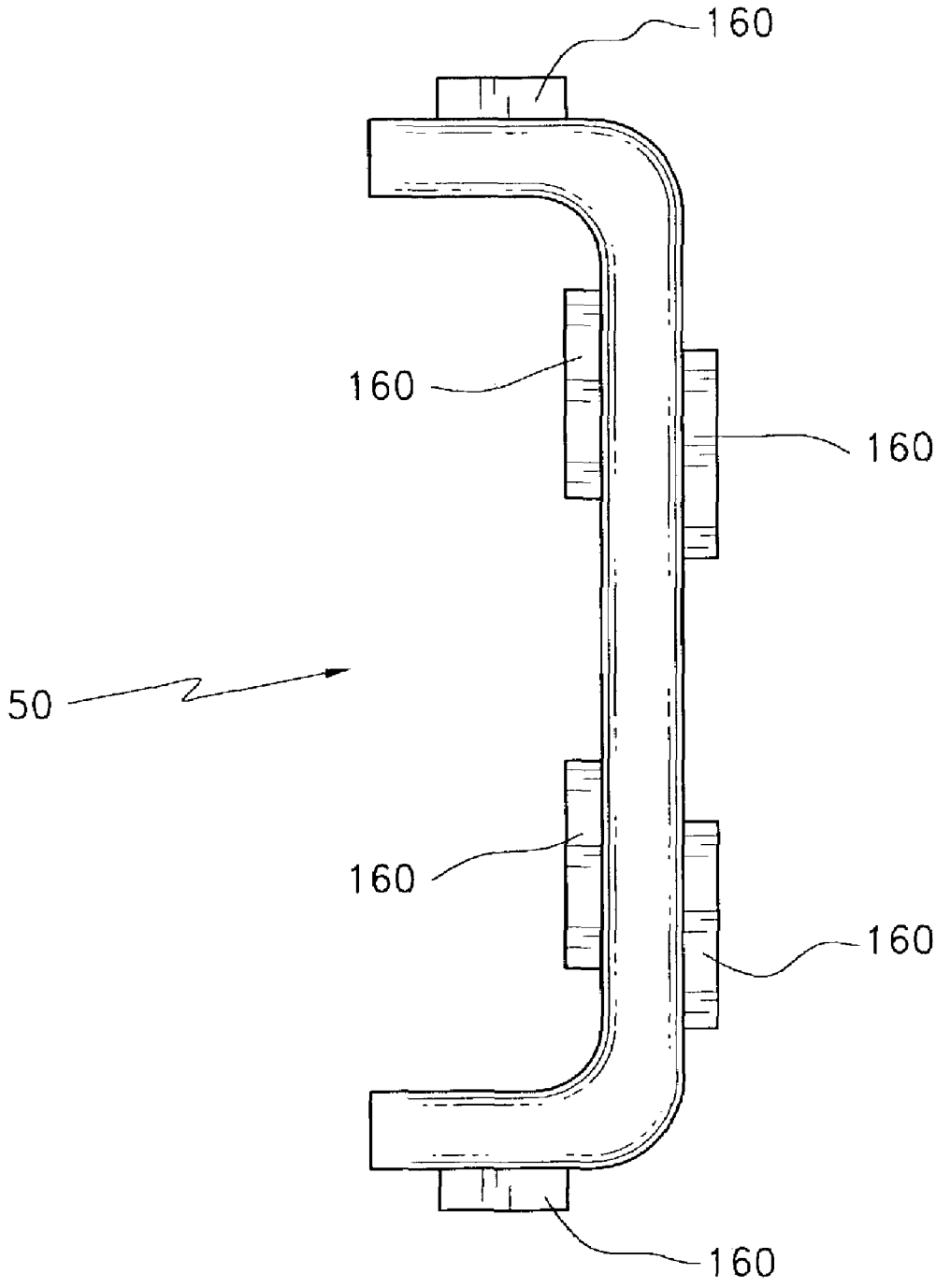
FIG. 22 is a top plan view of an alternative embodiment of a lace guide.
Figure 22A:
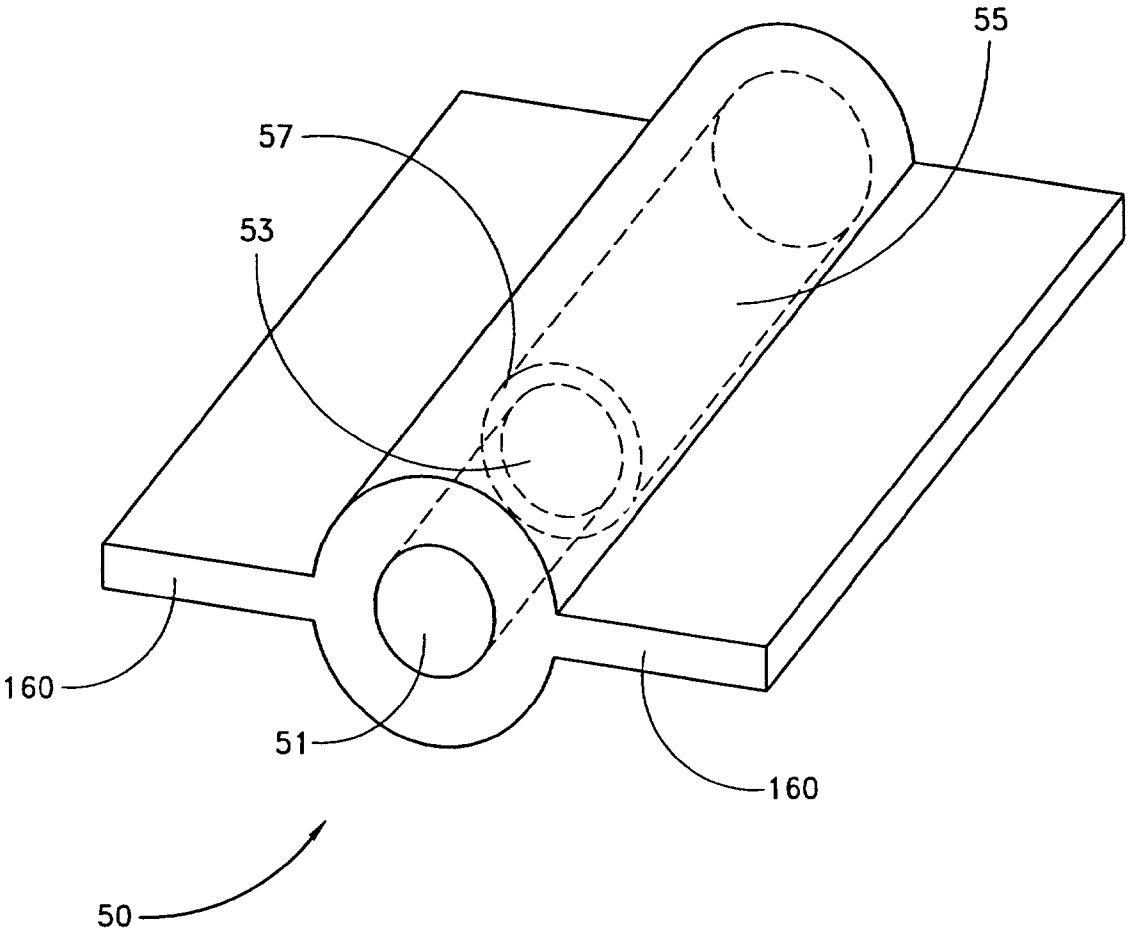
FIG. 22A is a perspective view of a guide tube stop in accordance with the present invention.

In FIG. 3, the top guide 52 is illustrated for simplicity as unattached to the corresponding side flap 32. However, in an actual product, the top guide 52 is preferable secured to the side flap 32. For example, upper retaining member 44*a*, discussed above, is illustrated in FIG. 2. Alternatively, the top guide 52 may extend within the material of or between the layers of the side flap 32. As a further alternative, or in addition to the foregoing, the end 55 of top guide 52 may be anchored to the side flap 32 using any of a variety of tie down or clamping structures. One suitable structure is illustrated in FIG. 22*a*, discussed below. The lace 23 may be slideably positioned within a tubular sleeve extending between the reel and the tie down at the end 55 of the sleeve.

Any of a variety of flexible tubular sleeves may be utilized, such as a spring coil with or without a polymeric jacket similar to that used currently on bicycle brake and shift cables. The use of a flexible but axially noncompressible sleeve for surrounding the lace 23 between the reel and the tie down at the end 55 isolates the tightening system from movement of portions of the boot, which may include hinges or flexibility points as is understood in the art. The tie down may comprise any of a variety of structures in addition to that illustrated in FIG. 22A, including grommets, rivets, staples, stitched or adhesively bonded eyelets, as will be apparent to those of skill in the art in view of the disclosure herein.

In the illustrated embodiment, the side guide members 50 each have a generally U-shape that opens towards the midline of the shoe. Preferably, each of the side guide members 50 comprise a longitudinal portion 51 and two inclined or transverse portions 53 extending therefrom. The length of the longitudinal portion 51 may be varied to adjust the distribution of the closing pressure that the lace 23 applies to the upper 24 when the lace 23 is under tension. In addition, the length of the longitudinal portion 51 need not be the same for all guide members 50 on a particular shoe. For example, the longitudinal portion 51 may be shortened near the ankle portion 29 to increase the closing pressure that the lace 23 applies to the ankles of the wearer. In general, the length of the longitudinal portion 51 will fall within the range of from about ½" to about 3", and, in some embodiments, within the range of from about ¼" to about 4". In one snowboard application, the longitudinal portion 51 had a length of about 2". The length of the transverse portion 53 is generally within the range of from about ⅛" to about 1". In one snowboard embodiment, the length of transverse portion 53 was about ½". Different specific length combinations can be readily optimized for a particular boot design through routine experimentation by one of ordinary skill in the art in view of the disclosure herein.

In between the longitudinal portion 51 and transverse portion 53 is a curved transition. Preferably, the transition has a substantially uniform radius throughout, or smooth progressive curve without any abrupt edges or sharp changes in radius. This construction provides a smooth surface over which the lace 23 can slide, as it rounds the corner. The transverse section 53 can in some embodiments be deleted, as long as a rounded cornering surface is provided to facilitate sliding of the lace 23. In an embodiment which has a transverse section 53 and a radiused transition, with a guide member 50 having an outside diameter of 0.090" and a lace 23 having an outside diameter of 0.027", the radius of the transition is preferably greater than about 0.1", and generally within the range of from about 0.125" to about 0.4".

Referring to FIG. 3, the upper guide members 52 extend substantially around opposite sides of the ankle portion 29. Each upper guide member 52 has a proximal end 56 and a distal end 55. The distal ends 55 are positioned near the top of the tongue 36 for receipt of the lace 23 from the uppermost side guide members 50. The proximal ends 56 are coupled to the tightening mechanism 25. In the illustrated embodiment, the proximal ends 56 include rectangular coupling mounts 57 that engage with the tightening mechanism 25 for feeding the ends of the lace 23 therein, as described more fully below. The guide members 50 and/or 52 are preferably manufactured of a low friction material, such as a lubricous polymer or metal, that facilitates the slideability of the lace 23 therethrough. Alternatively, the guides 50, 52 can be made from any convenient substantially rigid material, and then be provided with a lubricous coating on at least the inside surface of lumen 54 to enhance slideability. The guide members 50 and 52 are preferably substantially rigid to prevent bending and kinking of the guide members 50, 52 and/or the lace 23 within any of the guide members 50 and 52 as the lace 23 is tightened. The guide members 50, 52 may be manufactured from straight tube of material that is cold bent or heated and bent to a desired shape.

Alternatively, the guide members 50, 52 may be constructed in a manner that permits bending, retains a low friction surface, yet resist kinking. For example, guide members 50, 52 may comprise a spring coil, either with the spring coil exposed or the spring coil provided with a polymeric coating on the inside surface or outside surface or both. The provision of a spring coil guide satisfies the need for lateral flexibility in some embodiments, yet retains a hard interior surface which help to minimize friction between the guide and the lace.

As an alternate guide member 50, 52 design which increases lateral flexibility yet retains a hard interior lace contacting surface, the guide 50 may comprise a plurality of coaxially-aligned segments of a hard polymeric or metal tube material. Thus, a plurality of tubing segments, each segment having an axial length within the range of from about 0.1" to about 1.0", and preferably about 0.25" or less can be coaxially aligned, either in end-to-end contact or axially spaced apart along the length of the guide 50, 52. Adjacent tubular segments can be maintained in a coaxial relationship such as by the provision of an outer flexible polymeric jacket. The shape of the tubular guide may be retained such as by stitching the guide onto the side of the shoe in the desired orientation, or through other techniques which will be apparent to those of skill in the art in view of the disclosure herein.

As an alternative to the previously described tubular guide members, the guide members 50 and/or 52 comprise an open channel having, for example, a semicircular or "U" shaped cross section. The guide channel is preferably mounted on the boot such that the channel opening faces away from the midline of the boot, so that a lace under tension will be retained therein. One or more retention strips, stitches or flaps may be provided for "closing" the open side of the channel, to prevent the lace from escaping when tension on the lace is released. The axial length of the channel can be preformed in a generally U configuration like the illustrated tubular embodiment, and may be continuous or segmented as described in connection with the tubular embodiment.

Several guide channels may be molded as a single piece, such as several guide channels molded to a common backing support strip which can be adhered or stitched to the shoe. Thus, a right lace retainer strip and a left lace retainer strip can be secured to opposing portions of the top or sides of the shoe to provide a right set of guide channels and a left set of guide channels.

Figure 4B:
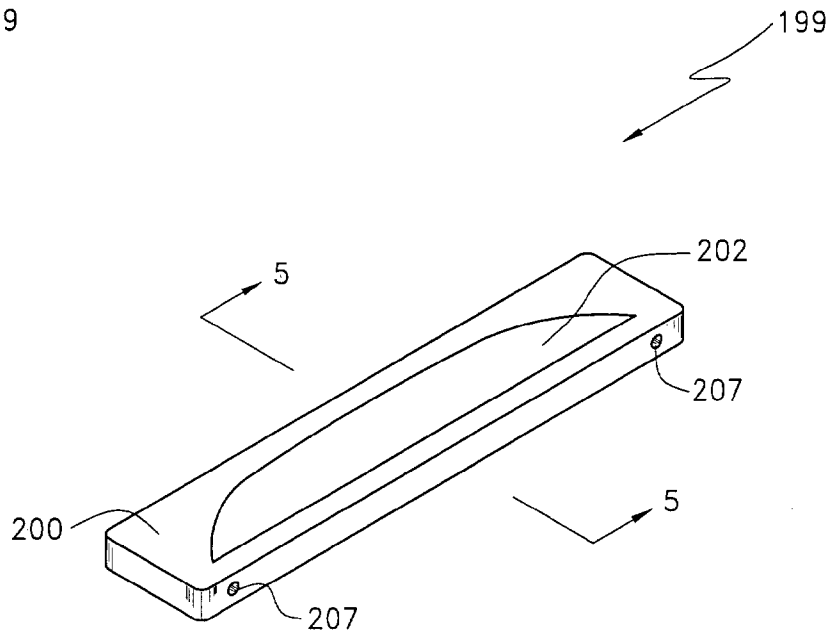
FIG. 4B is a perspective view of an assembled multi-piece guide member.
Figure 4A:
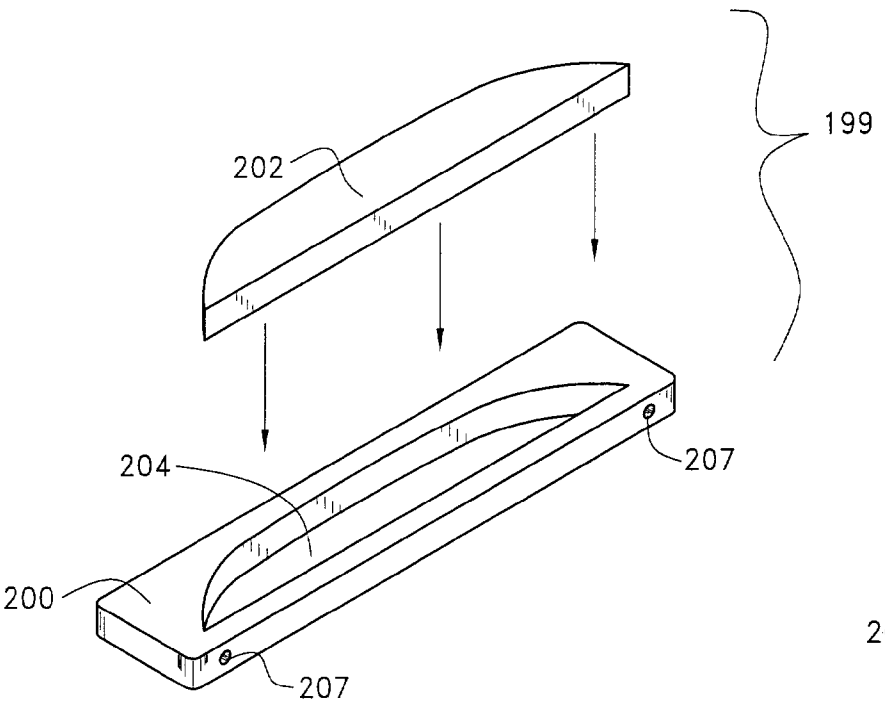
FIG. 4A is an exploded perspective view of a multi-piece lace guide member.

As an alternative to the previously described tubular guide members, the guide members 50 and/or 52 comprise a multi-piece guide member 199 comprised of a first member 200 and a second member 202 that mates thereto, such as shown in FIGS. 4A and 4B. The first member 200 and the second member 202 each have a thin, flat shape. A cavity or seat 204 (FIG. 4A) extends into an upper surface of the first member 200. The seat 204 is preferably sized to receive the second member 202 snug therein, such as in a press-fit fashion, as best shown in FIG. 4B.

Figure 5:
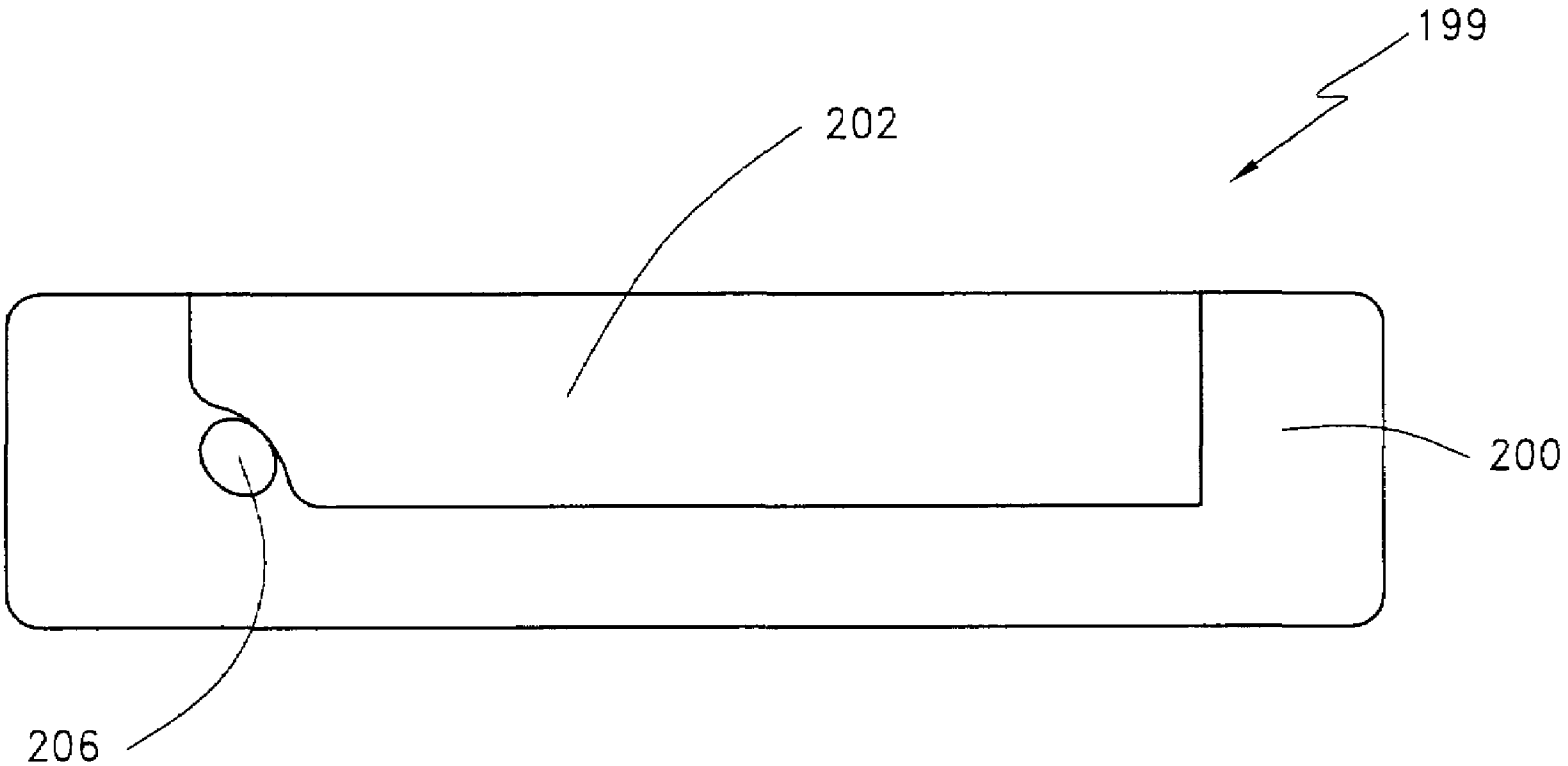
FIG. 5 is a cross-sectional view of the multi-piece guide member of FIG. 4 along line 5-5.

As shown in the cross-sectional view of FIG. 5, the second member 202 may be positioned within the seat so that a gap 206 of predetermined shape is defined between the second member 202 and the first member 200. A pair of apertures 207 (FIGS. 4A, 4B) are located on one of the first or second member 202, 204 to serve as entryways into the gap 206. The apertures 207 preferably are sufficiently large to allow passage of the lace 23 therethrough. In one embodiment, the apertures 207 are within the range of from about 0.030 inches to about 0.060 inches in diameter.

Figure 6:
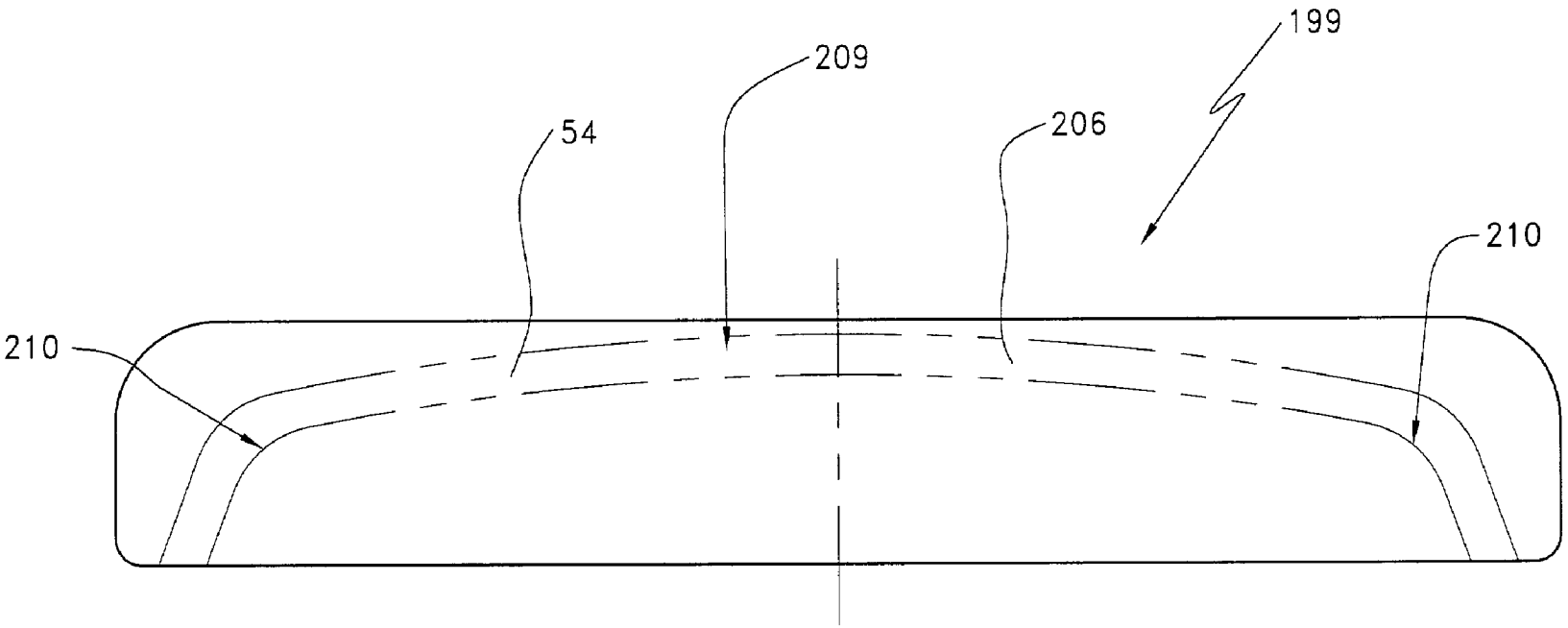
FIG. 6 is a top plan view of the multi-piece guide member.

With reference to FIG. 6, the gap 206 is elongated so that it defines a lace pathway that functions as the lumen 54 for the lace 23. The lumen 54 preferably includes an elongate region 209 that extends generally lengthwise along the edges of the flaps 32 or 34 when the guide member 199 is mounted on the boot. The elongate region 209 may be straight or may be defined by a smooth curve along the length thereof, such as a continuous portion of a circle or ellipse. As an example, the elongate region 209 may be defined by a portion of an ellipse having a major axis of about 0.5 inches to about 2 inches and a minor axis of about 0.25 inches to about 1.5 inches. In one embodiment, the major axis is approximately 1.4 inches and the minor axis is about 0.5 inches. The lumen 54 further includes a transverse region 210 on opposite ends of the elongate region 209. The transverse region 210 extends at an incline to the edges of the flaps 32 and 34. Alternatively, the elongate region 209 and the transverse region 210 may be merged into one region having a continuous circular or elliptical profile to spread load evenly along the length of the lumen 54 and thereby reduce total friction in the system.

The first and second members 200, 202 of the multi-piece guide member 199 may be manufactured of a low friction material, such as a lubricous polymer or metal, that facilitates the slideability of the lace 23 therethrough. Alternatively, the guide member 199 can be made from any convenient substantially rigid material, and then be provided with a lubricous coating on at least the surface of the inside curve of lumen 54 to enhance slideability. The guide member 199 may be substantially rigid to prevent bending and kinking of the guide member 199 and/or the lace 23 therein as the lace 23 is tightened. The guide member 199 may alternatively be made of a flexible material when used in portions of the shoe that are subject to bending. The guide members 50, 52 may be manufactured through known molding processes.

Referring to FIG. 4A, each of the guide members 199 has a predetermined distance between the first opening 207*a* and second opening 207*b* to the lace pathway therein. The effective linear distance between the first and second openings to the lace pathway may affect the fit of the boot. An embodiment in which the distance between the first opening 207*a* and second opening 207*b* is adjustable is illustrated schematically in FIG. 4C. Any of a wide variety of other implementations may be readily devised, which incorporate the function of the structure schematically illustrated in FIG. 4C.

In general, a first guide element 211 is spaced apart from a second guide element 213. The first guide element 211 contains a first partial or complete aperture 207*a* for receiving lace 23 therethrough. The second guide element 213 includes the second partial or complete aperture 207*b*, also for receiving the lace 23 therethrough. As is the case with other embodiments herein, the lace pathway (not illustrated) through the first and second guide elements 211 and 213 may extend through a tunnel or may extend along a curved surface, such as a rotatable pulley, radiused recess or otherwise depending upon the desired performance and construction.

Figure 4C:
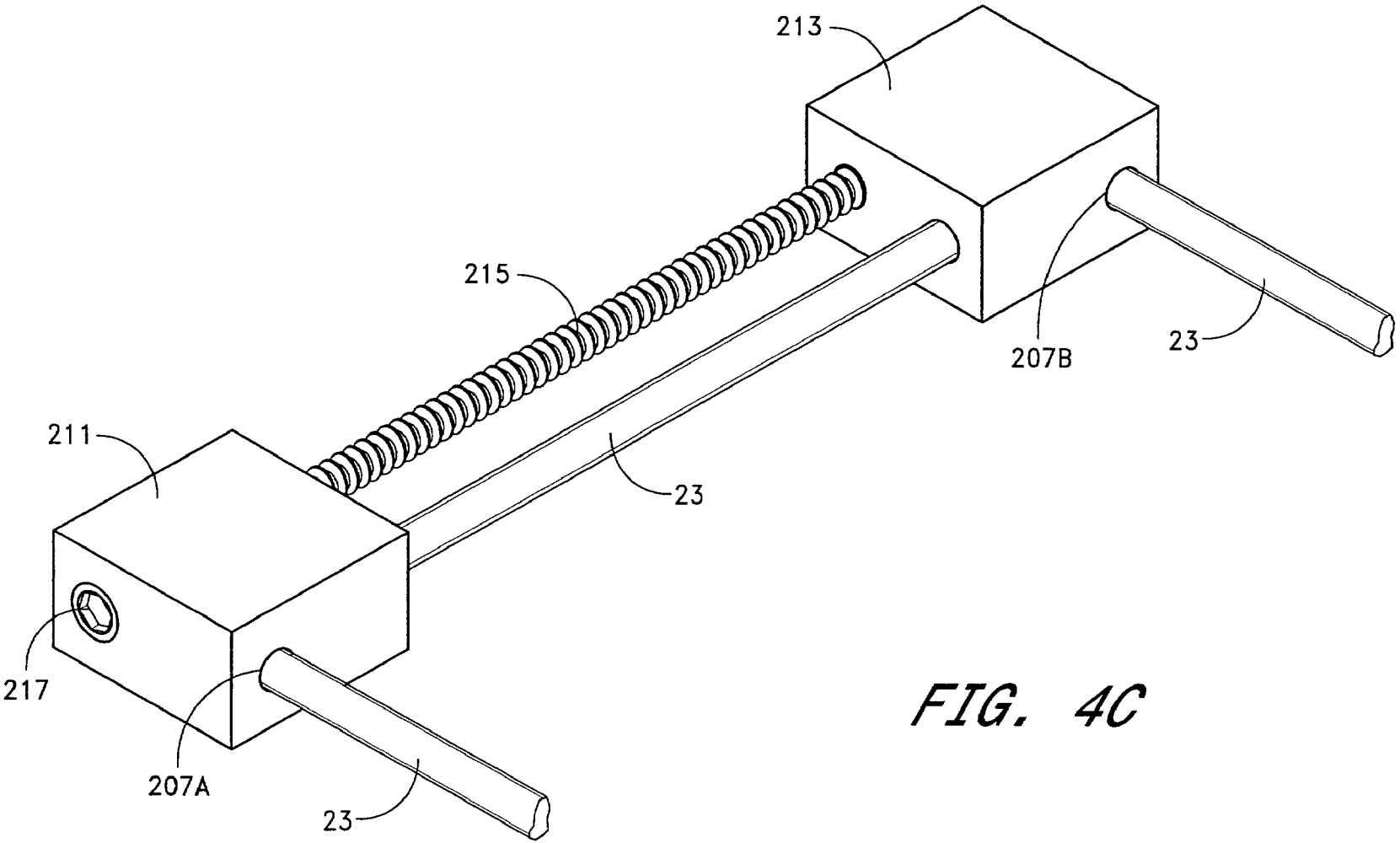
FIG. 4C is a schematic perspective view of an adjustable guide member in accordance with the present invention.

As illustrated in FIG. 4C, the lace 23 enters the first aperture 207*a*, extends through the first guide element 211, and into the second guide element 213. The adjustable guide member 199 is additionally provided with a threaded shaft 215 extending between the first and second guide elements 211 and 213. Rotation of the threaded shaft 215 in a first direction draws the guide elements 211 and 213 towards each other, thereby shortening the distance between the lace apertures 207*a* and 207*b*. Rotating the threaded shaft 215 in an opposite direction increases the axial distance between apertures 207*a* and 207*b*. Specific rotational engagements between the threaded shaft 215, guide elements 211 and 213, to accomplish this purpose are well known in the art. A rotatable engagement structure, such as a slotted head, a hex recess or projection, or the like may be provided on one end 217 of the threaded shaft 215. Any of a variety of alternate structures may be utilized, to permit the adjustment of the spacing between the apertures 207*a* and 207*b*, as will be apparent to those of ordinary skill in the art in view of the disclosure herein.

The lace 23 may be formed from any of a wide variety of polymeric or metal materials or combinations thereof, which exhibit sufficient axial strength and bendability for the present application. For example, any of a wide variety of solid core wires, solid core polymers, or multi-filament wires or polymers, which may be woven, braided, twisted or otherwise oriented can be used. A solid or multi-filament metal core can be provided with a polymeric coating, such as PTFE or others known in the art, to reduce friction. In one embodiment, the lace 23 comprises a stranded cable, such as a 7 strand by 7 strand cable manufactured of stainless steel. In order to reduce friction between the lace 23 and the guide members 50, 52 through which the lace 23 slides, the outer surface of the lace 23 is preferably coated with a lubricous material, such as nylon or Teflon. In a preferred embodiment, the diameter of the lace 23 ranges from 0.024 inches to 0.060 inches and is preferably 0.027 inches. The lace 23 is desirably strong enough to withstand loads of at least 40 pounds and preferably at least about 90 pounds. In certain embodiments the lace is rated at least about 100 pounds up to as high as 200 pounds or more. A lace 23 of at least five feet in length is suitable for most footwear sizes, although smaller or larger lengths could be used depending upon the lacing system design.

The lace 23 may be formed by cutting a piece of cable to the desired length. If the lace 23 comprises a braided or stranded cable, there may be a tendency for the individual strands to separate at the ends or tips of the lace 23, thereby making it difficult to thread the lace 23 through the openings in the guide members 50, 52. As the lace 23 is fed through the guide members, the strands of the lace 23 easily catch on the curved surfaces within the lace guide members. The use of a metallic lace, in which the ends of the strands are typically extremely sharp, also increases the likelihood of the cable catching on the guide members during threading. As the tips of the strands catch on the guide members and/or the tightening mechanism, the strands separate, making it difficult or impossible for the user to continue to thread the lace 23 through the tiny holes in the guide members and/or the tightening mechanism. Unfortunately, unstranding of the cable is a problem unique to the present replaceable-lace system, where the user may be required to periodically thread the lace through the lace guide members and into the corresponding tightening mechanism.

Figure 7:
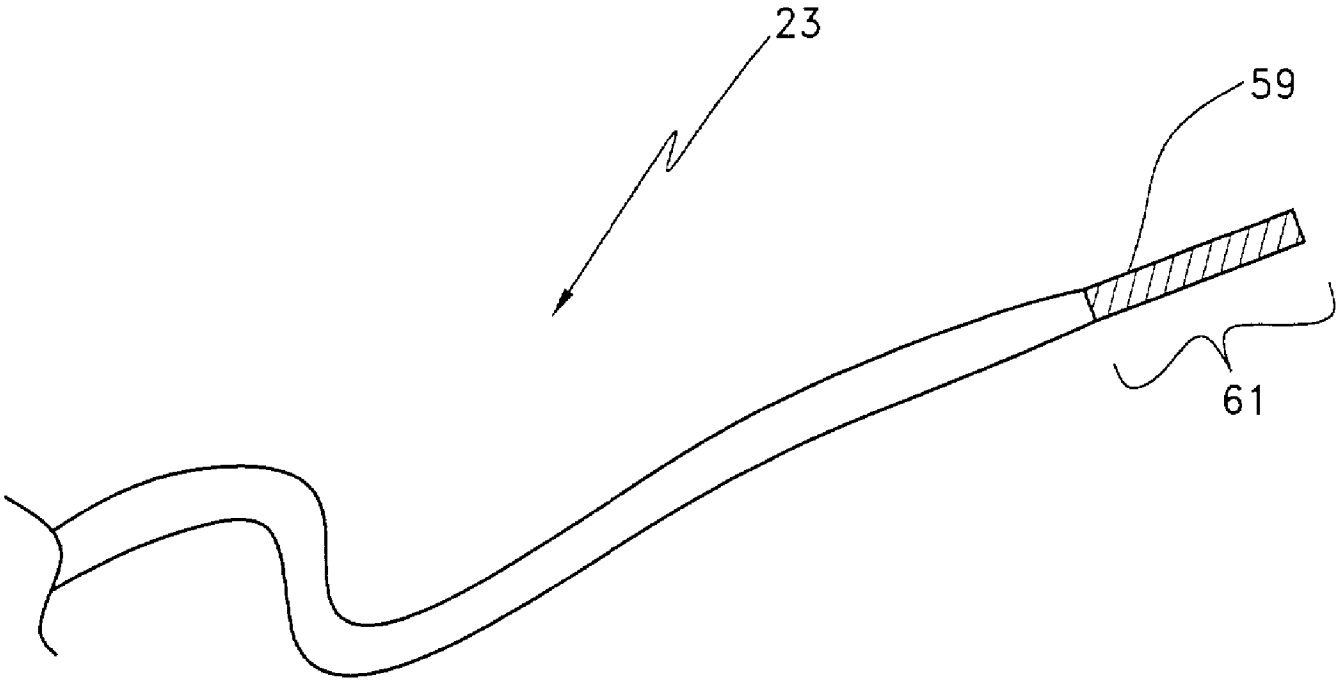
FIG. 7 is a perspective view of an end portion of a lace having a welded tip.

With reference to FIG. 7, one solution to this problem is to provide the tips or ends 59 of the lace 23 with a sealed or bonded region 61 wherein the individual strands are retained together to prevent separation of the strands from one another. For clarity of illustration, the bonded region 61 is shown having an elongate length. However, the bonded region 61 may also be a bead located at just the extreme tip of the lace 23 and, in one embodiment, could be a bonded tip surface as short as 0.002 inch or less.

The bonded region 61 may be formed, for example, by applying a weld (e.g., solder tip, brazing, welding, or melting the strands together) to the ends 59 during formation of the lace 23 to thereby hold the strands together and prevent separation of the strands. A tip weld advantageously does not significantly increase the overall diameter of the lace 23. Additionally, the weld may also be used to smooth the ends 59 of the lace 23 to facilitate insertion of the lace 23 into the guide members. A weld is also advantageous in that it provides a secure, permanent bond between the strands of the lace 23. The bonded region 61 provides the ends of the lace 23 with a smooth and secure surface that greatly facilitates threading of the lace through the guide members and into the tightening mechanism. The bonded region thus makes it much easier for a user to replace the lace 23 in the system. Alternatively, adhesives or thin walled shrink wrap tubing may be used in certain embodiments.

After the 7×7 multistrand stainless steel cable described above has been tightened and untightened a number of times, the cable tends to kink or take a set. Kink resistance of the cable may be improved by making the cable out of a nickel titanium alloy such as nitinol. Other materials may provide desirable kink resistance, as will be appreciated by those of skill in the art in view of the disclosure herein. In one particular embodiment, a 1×7 multi-strand cable may be constructed having seven nitinol strands, each with a diameter within the range of from about 0.005 inches to about 0.015 inches woven together. In one embodiment, the strand has a diameter of about 0.010 inches, and a 1×7 cable made with that strand has an OD of about 0.030 inches. The diameter of the nitinol strands may be larger than a corresponding stainless steel embodiment due to the increased flexibility of nitinol, and a 1×7 construction and in certain embodiments a 1×3 construction may be utilized.

In a 1×3 construction, three strands of nitinol, each having a diameter within the range of from about 0.007 inches to about 0.025 inches, preferably about 0.015 inches are drawn and then swaged to smooth the outside. A drawn multistrand cable will have a nonround cross-section, and swaging and/or drawing makes the cross-section approximately round. Swaging and/or drawing also closes the interior space between the strands, and improves the crush resistance of the cable. Any of a variety of additives or coatings may also be utilized, such as additives to fill the interstitial space between the strands and also to add lubricity to the cable. Additives such as adhesives may help hold the strands together as well as improve the crush resistance of the cable. Suitable coatings include, among others, PTFE, as will be understood in the art.

In an alternate construction, the lace or cable comprises a single strand element. In one application, a single strand of a nickel titanium alloy wire such as nitinol is utilized. Advantages of the single strand nitinol wire include both the physical properties of nitinol, as well as a smooth outside diameter which reduces friction through the system. In addition, durability of the single strand wire may exceed that of a multi strand since the single strand wire does not crush and good tensile strength or load bearing capacity can be achieved using a small OD single strand wire compared to a multi strand braided cable. Compared to other metals and alloys, nitinol alloys are extremely flexible. This is useful since the nitinol laces are able to navigate fairly tight radii curves in the lace guides and also in the small reel. Stainless steel or other materials tend to kink or take a set if a single strand was used, so those materials are generally most useful in the form of a stranded cable. However, stranded cables have the disadvantage that they can crush in the spool when the lace is wound on top of itself. In addition, the stranded cables are not as strong for a given diameter as a monofilament wire because of the spaces in between the strands. Strand packing patterns in multistrand wire and the resulting interstitial spaces are well understood in the art. For a given amount of tensile strength, the multistrand cables therefore present a larger bulk than a single filament wire. Since the reel is preferably minimized in size the strongest lace for a given diameter is preferred. In addition, the stranded texture of multistrand wires create more friction in the lace guides and in the spool. The smooth exterior surface of a single strand creates a lower friction environment, better facilitating tightening, loosening and load distribution in the dynamic fit of the present invention.

Single strand nitinol wires having diameters within the range of from about 0.020 inches to about 0.040 inches may be utilized, depending upon the boot design and intended performance. In general, diameters which are too small may lack sufficient load capacity and diameters which are too large may lack sufficient flexibility to be conveniently threaded through the system. The optimal diameter can be determined for a given lacing system design through routine experimentation by those of skill in the art in view of the disclosure herein. In many boot embodiments, single strand nitinol wire having a diameter within the range of from about 0.025 inches to about 0.035 inches may be desirable. In one embodiment, single strand wire having a diameter of about 0.030 inches is utilized.

The lace may be made from wire stock, shear cut or otherwise severed to the appropriate length. In the case of shear cutting, a sharpened end may result. This sharpened end is preferably removed such as by deburring, grinding, and/or adding a solder ball or other technique for producing a blunt tip. In one embodiment, the wire is ground or coined into a tapered configuration over a length of from about ½ inch to about 4 inches and, in one embodiment, no more than about 2 inches. The terminal ball or anchor is preferably also provided as discussed below. Tapering the end of the nitinol wire facilitates feeding the wire through the lace guides and into the spool due to the increased lateral flexibility of the reduced cross section.

Provision of an enlarged cross sectional area structure at the end of the wire, such as by welding, swaging, coining operations or the use of a melt or solder ball, may be desirable in helping to retain the lace end within the reel as well as facilitating feeding the lace end through the lace guides and into the reel. In one embodiment of the reel, discussed elsewhere herein, the lace end is retained within the reel under compression by a set screw. While set screws may provide sufficient retention in the case of a multi strand wire, set screw compression on a single stand cable may not produce sufficient retention force because of the relative crush resistance of the single strand. The use of a solder ball or other enlarged cross sectional area structure at the end of the lace can provide an interference fit behind the set screw, to assist retention within the reel.

In one example, a 0.030 inch diameter single strand lace is provided with a terminal ball having a diameter within the range of from about 0.035 inches to about 0.040 inches. In addition to or as an alternative to the terminal ball or anchor, a slight angle or curve may be provided in the tip of the lace. This angle may be within the range of from about 5° to about 25°, and, in one embodiment about 15°. The angle includes approximately the distal ⅛ inch of the lace. This construction allows the lace to follow tight curves better, and may be combined with a rounded or blunted distal end which may assist navigation and locking within the reel. In one example, a single strand wire having a diameter of about 0.030 inches is provided with a terminal anchor having a diameter of at least about 0.035 inches. Just proximal to the anchor, the lace is ground to a diameter of about 0.020 inches, which tapers over a distance of about an inch in the proximal direction up to the full 0.030 inches. Although the term "diameter" is utilized to describe the terminal anchor, Applicant contemplates nonround anchors such that a true diameter is not present. In a noncircular cross-section embodiment, the closest approximation of the diameter is utilized for the present purposes.

As an alternative terminal anchor on the lace, a molded piece of plastic or other material may be provided on the end of each single strand. In a further variation, each cable end is provided with a detachable threading guide. The threading guide may be made from any of a variety of relatively stiff plastics like nylon, and be tapered to be easily travel around the corners of the lace guides. After the lace is threaded through the lace guides, the threading guide may be removed from the lace and discarded, and the lace may be then installed into the reel.

The terminal anchor on the lace may also be configured to interfit with any of a variety of connectors on the reel. Although set screws are a convenient mode of connection, the reel may be provided with a releasable mechanism to releasably receive the larger shaped end of the lace which snaps into place and is not removable from the reel unless it is released by an affirmative effort such as the release of a lock or a lateral movement of the lace within a channel. Any of a variety of releasable interference fits may be utilized between the lace and the reel, as will be apparent to those of skill in the art in view of the disclosure herein.

As shown in FIG. 3, the tightening mechanism 25 is mounted to the rear of the upper 24 by fasteners 64. Although the tightening mechanism 25 is shown mounted to the rear of the boot 20, it is understood that the tightening mechanism 25 could be located at any of a wide variety of locations on the boot 20. In the case of an ice skating boot, the tightening mechanism is preferably positioned over a top portion of the tongue 36. The tightening mechanism 25 may alternatively be located on the bottom of the heal of the boot, on the medial or the lateral sides of the upper or sole, as well as anywhere along the midline of the shoe facing forward or upward. Location of the tightening mechanism 25 may be optimized in view of a variety of considerations, such as overall boot design as well as the intended use of the boot. The shape and overall volume of the tightening mechanism 25 can be varied widely, depending upon the gear train design, and the desired end use and location on the boot. A relatively low profile tightening mechanism 25 is generally preferred. The mounted profile of the tightening mechanism 25 can be further reduced by recessing the tightening mechanism 25 into the wall or tongue of the boot. Boots for many applications have a relatively thick wall, such as due to structural support and/or thermal insulation and comfort requirements. The tightening mechanism may be recessed into the wall of the boot by as much as ¾" or more in some locations and for some boots, or on the order of about ⅛" or ½" for other location and/or other boots, without adversely impacting the comfort and functionality of the boot.

In general, the tightening mechanism 25 comprises a control such as a lever, crank or knob, which can be manipulated to retract lace 23 therein. In addition, the tightening mechanism preferably comprises a release such as a button or lever, for disengaging the tightening mechanism to permit the lace 23 to be withdrawn freely therefrom.

The tightening mechanism 25 in the illustrated embodiment generally comprises a rectangular housing 60 and a circular knob 62 rotatably mounted thereto. The knob 62 may be rotated to wind the ends of the lace 23 into the housing 60 and thereby tension the lace 23 to reduce slack. As the slack in the lace 23 reduces, the lace 23 pulls the side guide members 50, and thereby the flaps 32 and 34, toward the midline of the boot to tighten the upper 24 around a foot.

The tightening mechanism 25 advantageously includes an internal gear mechanism to allow the wearer to easily turn the knob 62 to retract the lace 23. Preferably, the gear mechanism is configured to incrementally pull and retain a predetermined length of lace as the knob 62 is rotated, as described in detail below. A user may thus advantageously continuously adjust the tension in the lace 23 to a desired comfort and performance level. The knob 62 may be rotated either manually or through the use of a tool or small motor attached to the knob 62.

Any of a variety of known mechanical structures can be utilized to permit winding of the spool to increase tension on the lace, yet resist unwinding of the spool until desired. For example, any of a wide variety of ratchet structures can be used for this purpose. Alternatively, a Sprague clutch or similar structure will permit one-way rotation of a shaft while resisting rotation in the opposite direction. These and other structures will be well known to those of ordinary skill in the mechanical arts.

A release lever 63 is located along a side of the housing 60. The release lever may be rotated to disengage the internal gear mechanism to release tension in the lace 23 and loosen the upper 23 around the wearer's foot, as described in detail below. This advantageously allows a user to quickly and easily untighten the lacing system by simply turning the release lever 63.

The low friction relationship between the lace 23 and cable guides 50, 52 greatly facilitate tightening and untightening of the lacing system 20. Specifically, because the lace 23 and cable guides 50 and 52 are manufactured or coated with a low friction material, the lace 23 slides easily through the cable guides without catching. The lace 23 thus automatically distributes the tension across its entire length so that tightening pressure is evenly distributed along the length of the ankle and foot. When the tension in the lace 23 is released by actuating the release lever, the lace 23 slides easily through the cable guides 50 and 52 to release tension and evenly distribute any slack among the length of the lace. The low friction tongue 36 also facilitates moving of the flaps 32, 34 away from each other when the lace 23 is loosened.

Figure 8:
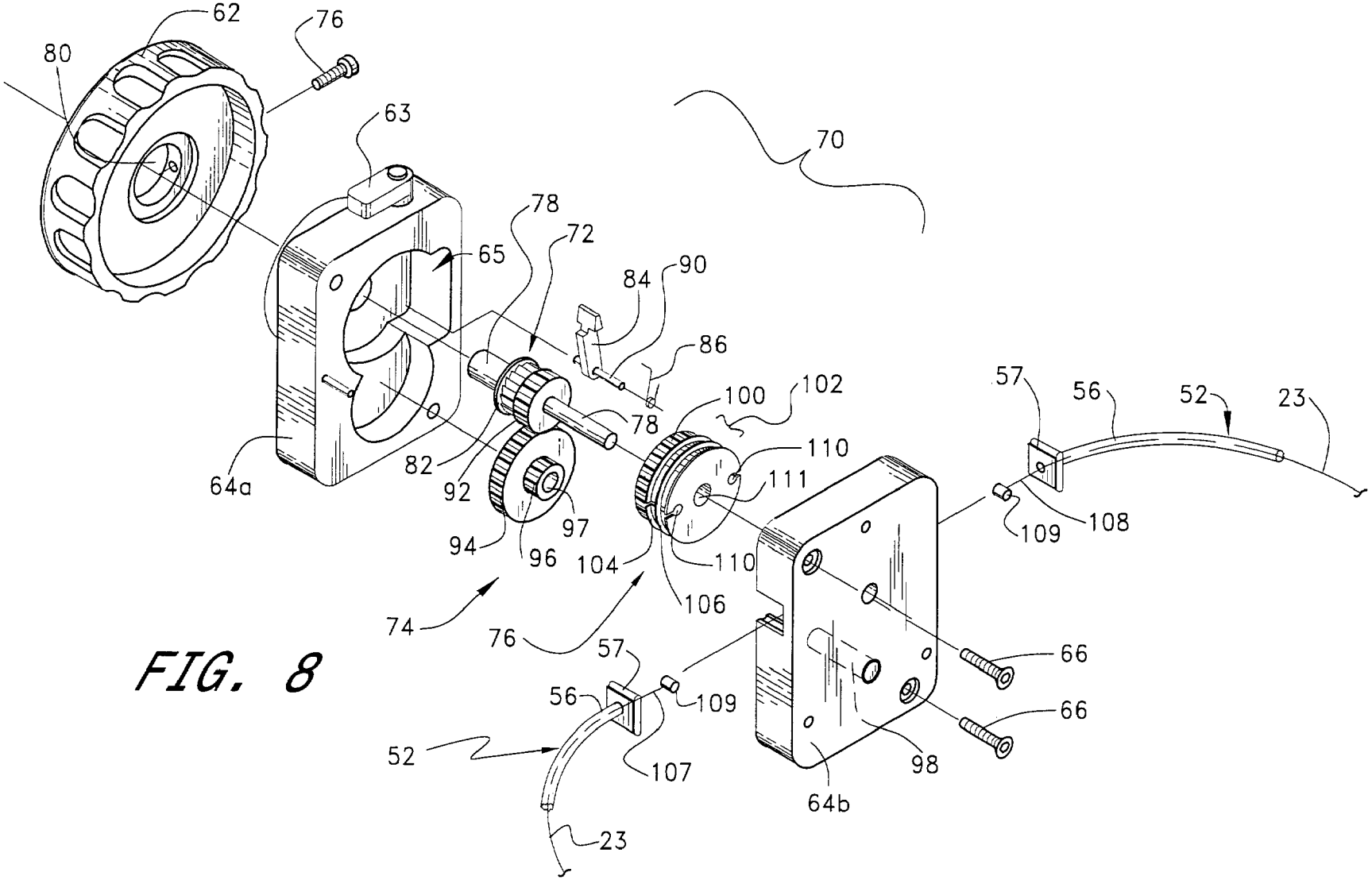
FIG. 8 is an exploded perspective view of one embodiment of a tightening mechanism used with the lacing system described herein.

FIG. 8 is an exploded perspective view of the various components of one embodiment of the tightening mechanism 25. As shown, the housing 60 consists of a pair of interlocking halves 64*a* and 64*b* that are mated to each other using fasteners 66, such as screws. The housing 60 encloses a gear mechanism 70 that preferably rotatably fits within cavities 65 in the inner surfaces of the halves 64*a* and 64*b*. In the illustrated embodiment, the gear mechanism 70 comprises first, second, and third gear wheels 72, 74, and 76, respectively, that rotatably engage with each other when the tightening mechanisms 25 is assembled.

As shown in FIG. 8, the first gear wheel 72 includes a shaft 78 about which the first gear wheel rotates. A first portion of the shaft 78 extends through an aperture in the housing halve 64*a*. A second portion of the shaft 78 extends through an aperture in the halve 64*b*. The knob 62 mounts to the shaft 78 through a mounting hole 80 in the knob 0.62. A mounting pin 76 removably secures the knob 62 to the shaft 78 in a well known manner. When the tightening mechanism 25 is assembled, rotation of the knob 62 causes the first gear wheel 72 to also rotate. Actuation of the gear mechanism 70 is thus accomplished through rotation of the knob 62.

Referring to FIG. 8, the first gear wheel 72 also includes a ratchet section 82 having a plurality of sloped teeth 83 (FIG. 10) positioned circumferentially around the axis of the first gear wheel 72. The sloped teeth 83 are configured to mate with a pawl 84 to prevent undesired backward rotation of the first gear wheel 72, as described more fully below. Toward this end, a biasing member 86 couples to a peg 90 that extends from the pawl 84. The biasing member 86 biases the pawl 84 against the ratchet teeth when the gear mechanism 70 is assembled. The third gear wheel 72 also includes a gear section 92 having a series of gear teeth that extend around the periphery of the third gear wheel 72.

As shown in FIG. 8, the second gear wheel 74 includes a first gear section 94 and a stepped second gear section 96 having a diameter smaller than the first gear section 94 on a common axis of rotation. The first gear section 94 has gear teeth that are configured to mesh with the gear section 92 of the first gear wheel 72. An aperture 97 extends centrally through the second gear wheel 74. The aperture 97 is sized to rotatably receive a post 98 that extends from the housing halve 64*b*. The second gear wheel 74 rotates about the post 98 during actuation of the assembled gear mechanism 70.

Referring to FIG. 8, the third gear wheel 76 includes a gear section 100 that is configured to mesh with the second gear section 96 of the second gear wheel 74. The third gear wheel also includes a spool section 102 comprising grooves 104, 106 that extend around the periphery of the third gear wheel 76. The grooves 104, 106 are sized to receive opposite ends of the lace 23 in a winding fashion during actuation of the gear mechanism 25.

The ends 107 and 108 of the lace 23 are each provided with anchors 109 that mate with seating holes 110 in a press fit fashion. The seating holes 110 are diametrically positioned on the third gear wheel 76. When the anchors 109 are mated with the seating holes 110, the ends 107 and 108 of the lace 23 are separately positioned within the grooves 104 and 106, respectively. The coupling mounts 57 fit into a corresponding aperture in the housing halve 64 to maintain the distal ends 56 of the guide member 50 in a fixed position relative to the tightening mechanism.

Any of a variety of spool or reel designs can be utilized in the context of the present invention, as will be apparent to those of skill in the art in view of the disclosure herein. For example, only a single groove spool can be utilized. However, a dual groove spool or two side-by-side spools as illustrated has the advantage of permitting convenient simultaneous retraction of both lace ends 107 and 108. In the illustrated embodiment, with ends 107 and 108 approaching the spool from opposite directions, the lace conveniently wraps around the spool in opposite directions using a single rotatable shaft as will be apparent from FIG. 8.

Depending upon the gearing ratio and desired performance, one end of the lace can be fixed to a guide or other portion of the boot and the other end is wound around the spool. Alternatively, both ends of the lace can be fixed to the boot, such as near the toe region and a middle section of the lace is attached to the spool.

Preferably, the cavity 65 is toleranced to fit closely around the outer circumference of the spool, to capture the lace. Thus, the gap between the outer flange walls surrounding each groove and the interior surface of the cavity 65 are preferably smaller than the diameter of the lace. In this manner, the risk of tangling the lace within the winding mechanism can be minimized.

Any of a variety of attachment structures for attaching the ends of the lace to the spool can be used. In addition to the illustrated embodiment, the lace may conveniently be attached to the spool by threading the lace through an aperture and providing a transversely oriented set screw so that the set screw can be tightened against the lace and to attach the lace to the spool. The use of set screws or other releasable clamping structures facilitates disassembly and reassembly of the device, and replacement of the lace as will be apparent to those of skill in the art.

In any of the embodiments disclosed herein, the lace may be rotationally coupled to the spool either at the lace ends, or at a point on the lace that is spaced apart from the ends. In addition, the attachment may either be such that the user can remove the lace with or without special tools, or such that the user is not intended to be able to remove the lace from the spool. Although the device is disclosed primarily in the context of a design in which the lace ends are attached to the spool, the lace ends may alternatively be attached elsewhere on the footwear. In this design, an intermediate point on the lace is connected to the spool such as by adhesives, welding, interference fit or other attachment technique. In one design the lace extends through an aperture which extends through a portion of the spool, such that upon rotation of the spool, the lace is wound around the spool. The lace ends may also be attached to each other, to form a continuous lace loop.

Rotation of the third gear wheel 76 causes the ends 107 and 108 of the lace 23 to wind around the grooves 104 and 106, respectively, and thereby pull the length of the lace 23 into the tightening mechanism 25 and place the lace 23 in tension. It is understood that the ends 107, 108 of the lace 23 wind around the spool section 102 at an equal rate so that tension is evenly applied to both ends of the lace 23.

The third gear wheel includes a central aperture 111 sized to rotatably receive the shaft 78 on the first gear wheel 72. The third gear wheel 76 rotates about the shaft 78 during actuation of the gear mechanism 70.

In a preferred embodiment, the third gear wheel 76 has a diameter of 0.625 inches. The second gear section 96 of the second gear wheel 74 preferably has a diameter of approximately 0.31 inches and the first gear section preferably has a diameter approximately equal to the diameter of the third gear wheel 76. The first gear wheel 72 preferably has a diameter of approximately 0.31 inches. Such a relationship in the gear sizes provides sufficiently small adjustments in the tension of the lace 23 as the gear wheels are turned.

Figure 9:
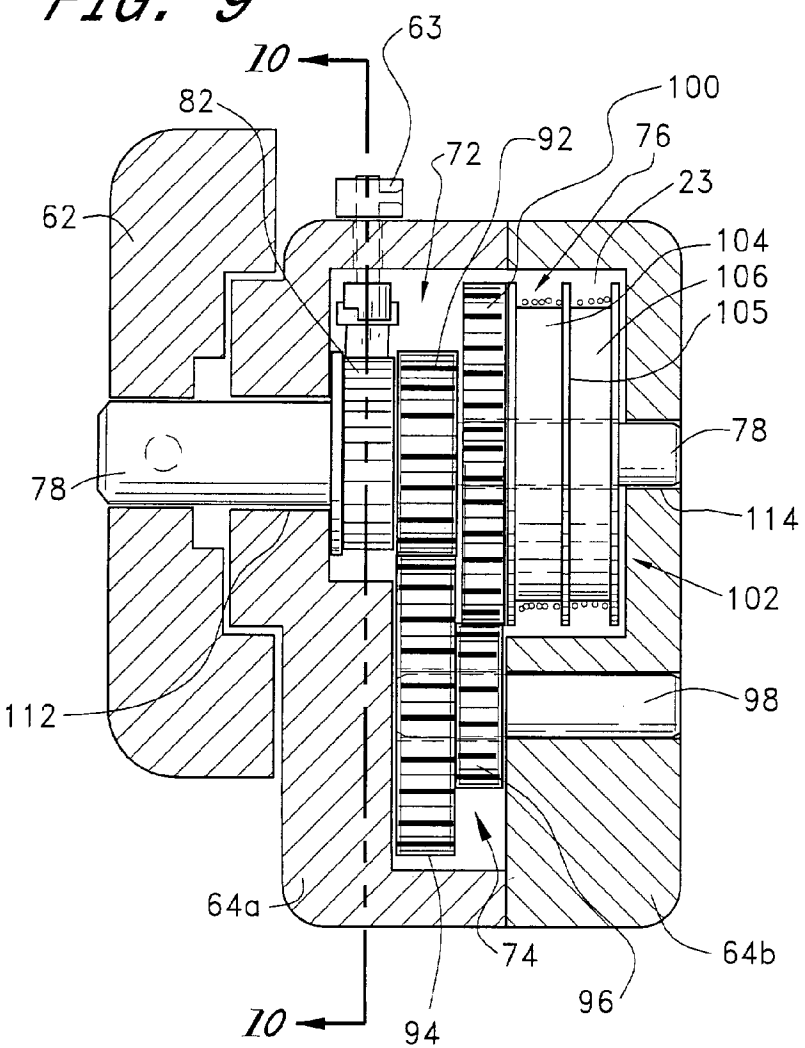
FIG. 9 is a cross-sectional side view of the assembled tightening mechanism of FIG. 8.

FIG. 9 illustrates a cross-sectional view of the assembled tightening mechanism 25. As shown, the shaft 78 of the first gear wheel 72 is journaled within apertures 112 and 114 in the housing halves 64*a* and 64*b*, respectively. The knob 62 is mounted over the portion of the shaft 78 extending out of the halve 64*a* through the aperture 112. The first, second, and third gear wheels 72, 74, and 76, respectively are in meshed engagement with each other. Specifically, the gear section 92 of the first gear wheel 72 is in meshed engagement with the first gear section 94 on the second gear wheel. Likewise, the second gear section 96 on the second gear wheel 94 is in meshed engagement with the gear section 100 of the third gear wheel 76. Accordingly, rotation of the knob 62 causes the first gear wheel 72 to rotate and thereby cause the second gear wheel to rotate in an opposite direction by means of the meshed engagement between the gear sections 92 and 94. This in turn causes the third gear wheel 76 to rotate in the direction of knob rotation by means of the meshed engagement between the gear sections 96 and 100.

As the third gear wheel 76 rotates, the ends 107 and 108 of the lace are wound within the grooves 104 and 106 respectively. Rotation of the knob 62 thus winds the lace 23 around the third gear wheel 76 to thereby tighten the boot 20.

As illustrated, counterclockwise rotation (relative to FIG. 10) of the knob 62 tightens the lace 23. The tension in the lace 23 is maintained by means of a ratchet mechanism that is described with reference to FIG. 10.

Figure 10:
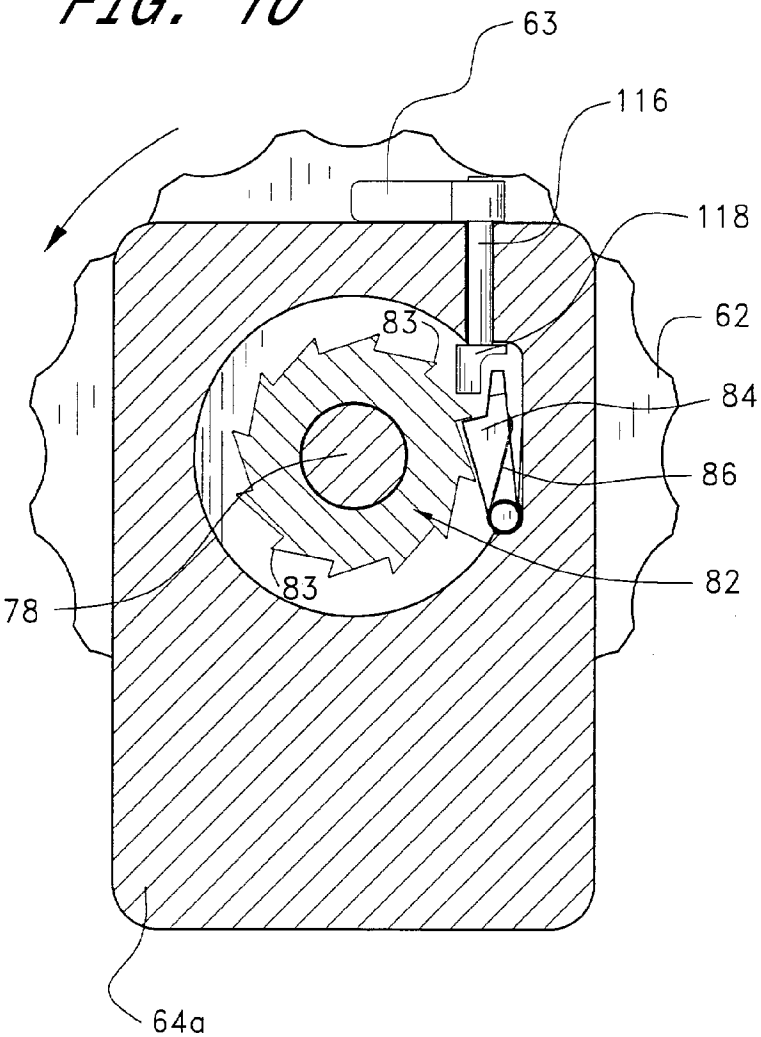
FIG. 10 is a cross-sectional view of the tightening mechanism of FIG. 9 taken along the line 10-10.

FIG. 10 is a cross-sectional view of the tightening mechanism 25 taken along the line 10-10 of FIG. 9. As shown, the biasing member 86 maintains the pawl 84 in locked engagement with the sloped teeth 83 on the ratchet section 82. The pawl 84 thus inhibits clockwise rotation of the knob 62 and loosening of the lace 23. It will be understood that the sloped teeth 83 do not inhibit counterclockwise rotation of the knob 62 because the pawl 84 slides over the teeth 83 when the knob 64 is rotated clockwise. As the knob 62 is rotated counterclockwise, the pawl 84 automatically engages each of the teeth 83 to advantageously allow the user to incrementally adjust the amount of lace 23 that is drawn into the tightening mechanism 25.

As shown in FIG. 10, the release lever 63 communicates with the pawl 84 through a shaft 116 that extends through the housing 60. A lower end of the shaft 116 is provided with a cam member 118. The release lever 63 may be rotated about the shaft 116 to cause the cam member 118 to also rotate and push the pawl 84 away from engagement with the ratchet teeth 83. When the pawl 84 disengages from the ratchet teeth, the first gear wheel 72, and each of the other gear wheels 74 and 76, are free to rotate.

When the user actuates the release lever 63, the tension, if any, in the lace 23 causes the lace 23 to automatically unwind from the spooling section 102. The release lever 63 is thus used to quickly untighten the boot 20 from around the foot. It will be appreciated that the low friction relationship between the lace 23 and the guide members 50 and 52 facilitates sliding of the lace 23 within the guide members so that the lace untightens quickly and smoothly by simply turning the release lever 63 and then manually pulling the tongue 36 forward.

It is contemplated that a limit on the expansion of portions of the boot due to the sliding of the lace 23 could be accomplished such as through one or more straps that extend transversely across the boot 20 at locations where an expansion limit or increased tightness or support are desired. For instance, a strap could extend across the instep portion 30 from one side of the boot 20 to another side of the boot. A second or lone strap could also extend around the ankle portion 29.

Figure 11:
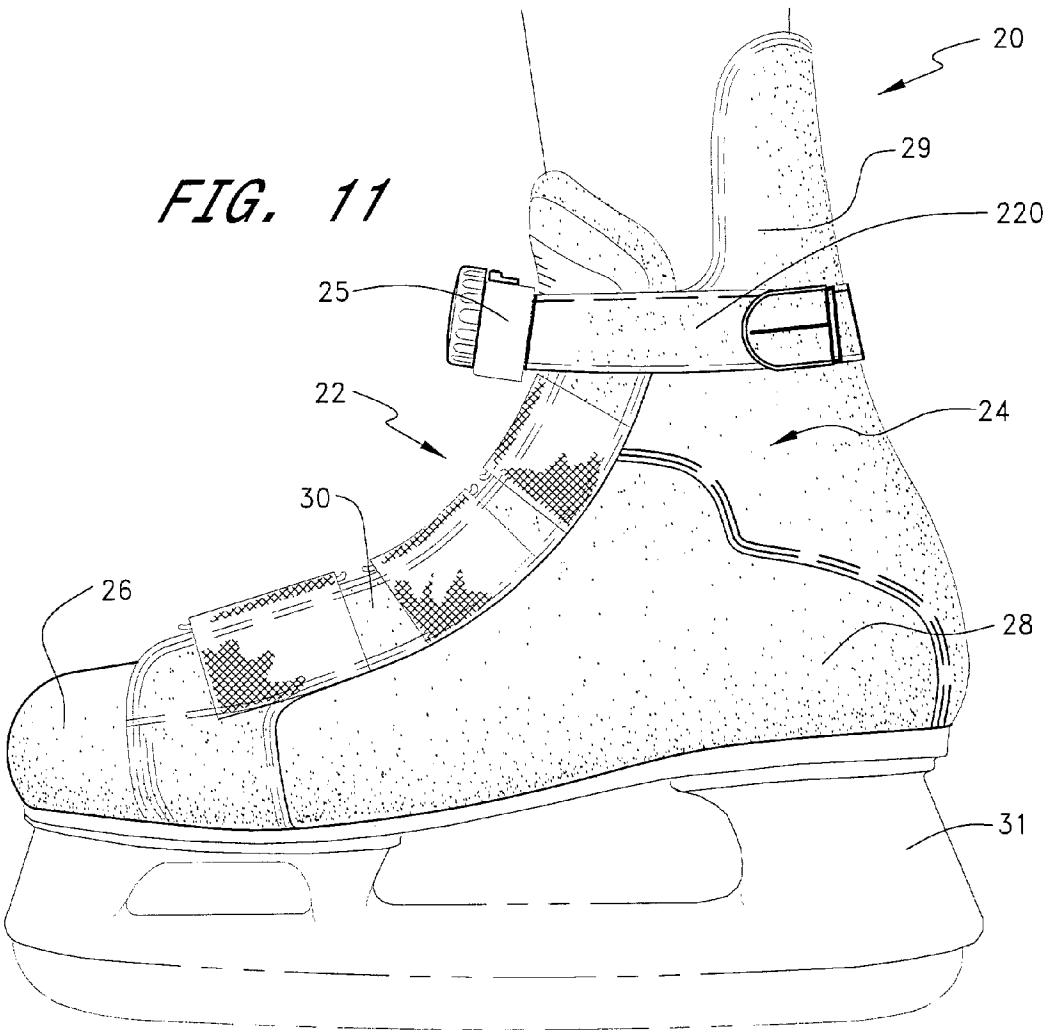
FIG. 11 is a side view of the sport boot including an ankle support strap.

With reference to FIG. 11, an expansion limiting strap 220 is located on the ankle portion of the boot 20 to supplement the closure provided by the lace 23 and provide a customizable limit on expansion due to the dynamic fit achieved by the lacing system of the present invention. The limit strap 220 may also prevent or inhibit the wearer's foot from unintentionally exiting the boot 20 if the lace 20 is unlocked or severed or the reel fails. In the illustrated embodiment, the strap 220 extends around the ankle of the wearer. The location of the limit strap 220 can be varied depending upon boot design and the types of forces encountered by the boot in a particular athletic activity.

For example, in the illustrated embodiment, the limit strap 220 defines an expansion limiting plane which extends generally horizontally and transverse to the wearer's ankle or lower leg. The inside diameter or cross section of the footwear thus cannot exceed a certain valve in the expansion limiting plane, despite forces imparted by the wearer and the otherwise dynamic fit. The illustrated location tends to limit the dynamic opening of the top of the boot as the wearer bends forward at the ankle. The function of the limit strap 220 may be accomplished by one or more straps, wires, laces or other structures which encircle the ankle, or which are coupled to other boot components such that the limit strap in combination with the adjacent boot components provide an expansion limiting plane. In one embodiment the expansion limiting strap surrounds the ankle as illustrated in FIG. 11. The anterior aspect of the strap is provided with an aperture for receiving the reel assembly therethrough. This allows the use of the expansion limiting strap in an embodiment having a front mounted reel, and may be particularly useful where the reel is provided with a quick mount release such the bayonet mount described in connection with FIG. 27A, discussed below.

In an alternative design, the expansion limiting plane is positioned in a generally vertical orientation, such as by positioning the limit strap 220 across the top of the foot anterior of the ankle, to achieve a different limit on dynamic fit. In this location, the expansion limiting strap 220 may encircle the foot inside or outside of the adjacent shoe components, or may connect to the sole or other component of the shoe to provide the same net force effect as though the strap encircled the foot.

The limit strap 220 may also create a force limiting plane which resides at an angle in between the vertical and horizontal embodiments discussed above, such as in an embodiment where the force limiting plane inclines upwardly from the posterior to the anterior within the range of from about 25° to about 75° from the plane on which the sole of the boot resides. Positioning the limit strap 220 along an inclined force limiting plane which extends approximately through the ankle can conveniently provide both a limit on upward movement of the foot within the boot, as well as provide a controllable limit on the anterior flexing of the leg at the ankle with respect to the boot.

The strap 220 preferably includes a fastener 222 that could be used to adjust and maintain the tightness of the strap 220. Preferably, the fastener 222 is capable of quick attachment and release, so that the wearer can adjust the limit strap 220 without complication. Any of a variety of fasteners such as corresponding hook and loop (e.g., Velcro) surfaces, snaps, clamps, cam locks, laces with knots and the like may be utilized, as will be apparent to those of skill in the art in view of the disclosure herein.

The strap 220 is particularly useful in the present low-friction system. Because the lace 23 slides easily through the guide members, the tension in the lace may suddenly release if the lace is severed or the reel fails. This would cause the boot to suddenly and completely open which could cause injury to the wearer of the boot, especially if they were involved in an active sport at the time of failure. This problem is not present in traditional lacing systems, where the relatively high friction in the lace, combined with the tendency of the lace to wedge with the traditional eyelets on the shoe, eliminates the possibility of the lace suddenly and completely loosening.

The low-friction characteristics of the present system also provides the shoe with a dynamic fit around the wearer's foot. The wearer's foot tends to constantly move and change orientation during use, especially during active sports. This shifting causes the tongue and flaps of the shoe to shift in response to the movement of the foot. This is facilitated by the low-friction lacing system, which easily equilibrates the tension in the lace in response to shifting of the wearer's foot. The strap 220 allows the user to regulate the amount of dynamic fit provided by the boot by establishing an outer limit on the expansion which would otherwise have occurred due to the tension balancing automatically accomplished by the readjustment of the lace throughout the lace guide system.

For example, if the wearer of the boot in FIG. 11 did not have the ankle strap 220, when he flexed his ankle forward during skating, the increased forward force at the top of the boot would cause the tongue to move out slightly while the laces lower in the boot would tighten. As the wearer straightened his ankle out again, closure force would equalize and the tongue would stay tight against his ankle. If the strap 220 were wrapped around his ankle however, it would prevent or reduce this forward movement of the ankle and tongue reducing the dynamic fit characteristics of the boot in the plane of the strap 220 and providing a very different fit and feel of the boot. Thus, the strap provides an effective means for regulating the amount of dynamic fit inherent in the low friction closure system. Since traditional lacing systems have so much friction in them, they do not provide this dynamic fit and consequently would not benefit from the strap in the same way.

Similar straps are commonly used in conjunction with traditional lacing systems but for entirely different reasons. They are used to provide additional closure force and leverage to supplement shoelaces but are not needed for safety and are not used to regulate dynamic fit.

The footwear lacing system 20 described herein advantageously allows a user to incrementally tighten the boot 20 around the user's foot. The low friction lace 23 combined with the low friction guide members 50, 52 produce easy sliding of lace 23 within the guide members 50 and 52. The low friction tongue 36 facilitates opening and closure of the flaps 32 and 34 as the lace is tightened. The lace 23 equilibrates tension along its length so that the lacing system 23 provides an even distribution of tightening pressure across the foot. The tightening pressure may be incrementally adjusted by turning the knob on the tightening mechanism 25. A user may quickly untighten the boot 20 by simply turning the release lever 63 or lifting or pressing the knob or operating any alternative release mechanism to automatically release the lace 23 from the tightening mechanism 25.

Figure 12:
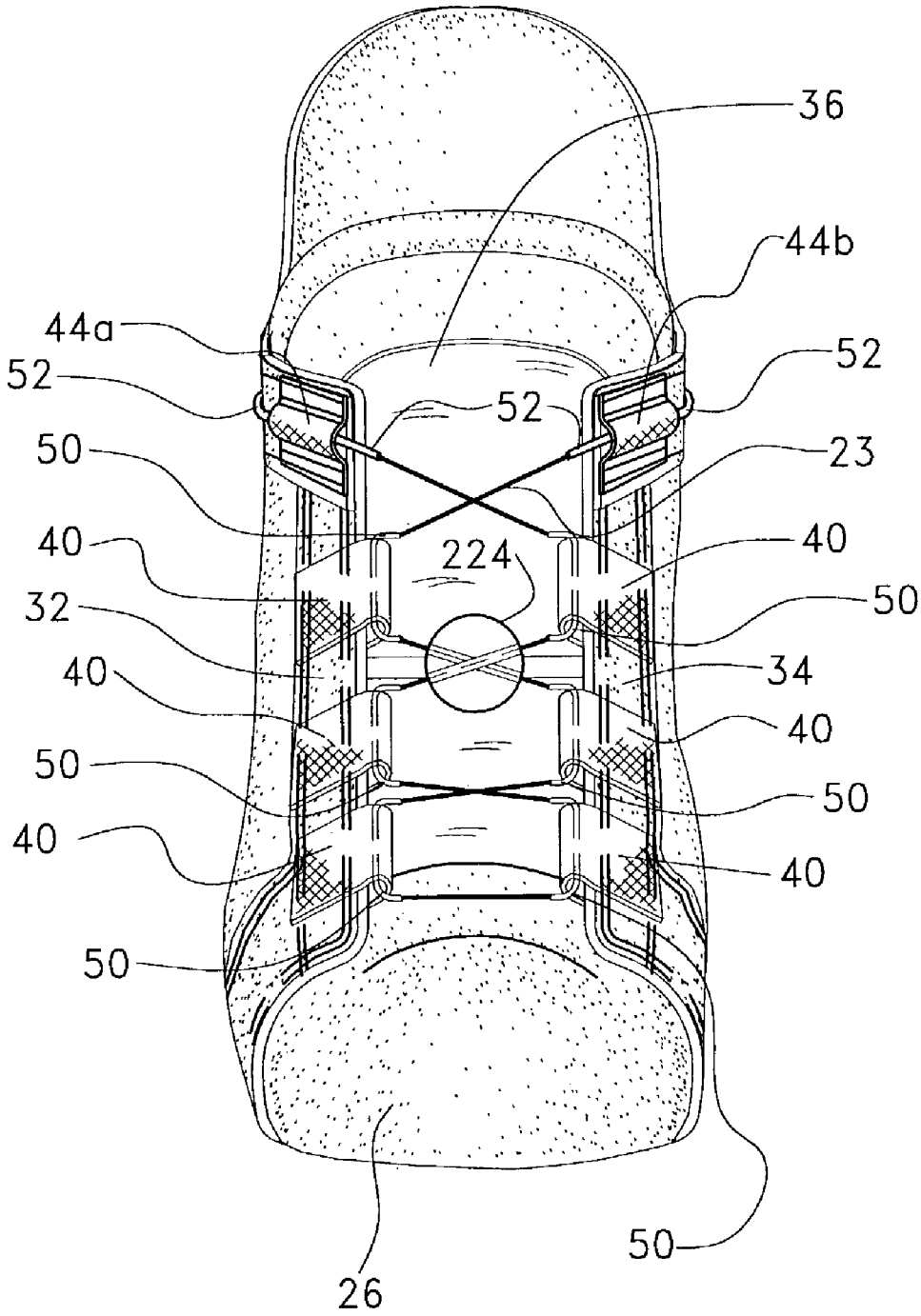
FIG. 12 is a front view of the sport boot including a central lace guide member disposed adjacent the tongue of the boot.
Figure 13:
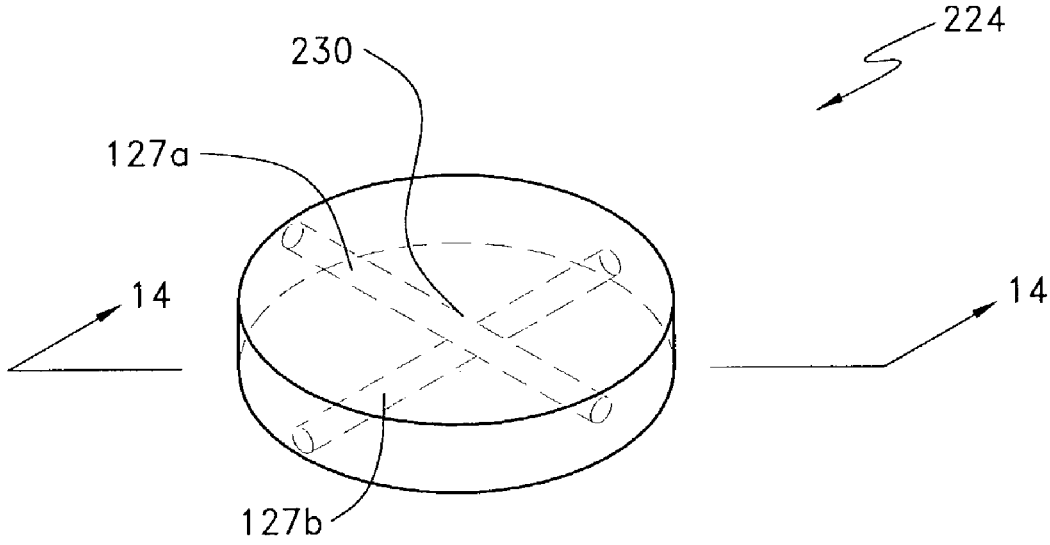
FIG. 13 is a perspective view of the central lace guide member.
Figure 14:
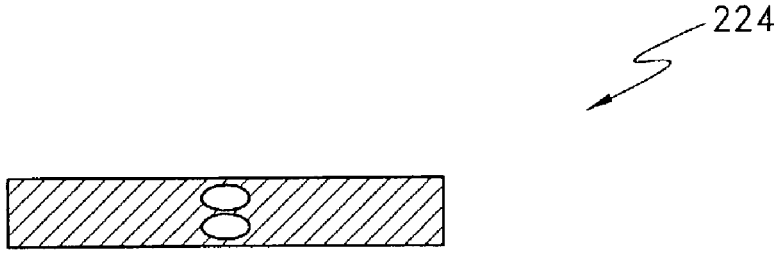
FIG. 14 is a cross-sectional view taken along the line 14-14 in FIG. 13.

As illustrated in FIG. 12, at least one anti-abrasion member 224 is disposed adjacent the tongue 36 and between the flaps 32, 34. As best shown in FIGS. 13, the anti-abrasion member 224 comprises a flat disc-like structure having a pair of internal channels or lumen 127*a,b* arranged in a crossing pattern so as to define a crossing point 230. The lumen 127*a,b* are sized to receive the lace 23 therethrough. As shown in the cross-sectional view of FIG. 14, the lumen 127*a,b* are arranged to prevent contact between adjacent sections of the lace 23 at the crossing point 230. The anti-abrasion member 224 thereby prevents chafing of the lace 23 at the crossing point 230. The anti-abrasion member 224 also shields the lace 23 from the tongue 36 to inhibit the lace 23 from chafing or abrading the tongue 36.

The anti-abrasion member 224 may alternatively take the form of a knife edge or apex for minimizing the contact area between the lace 23 and the anti-abrasion member 224 For example, at a crossing point where lace 23 crosses tongue 36, an axially extending (e.g. along the midline of the foot or ankle) ridge or edge may be provided in-between the boot tongue 36 and the lace 23. This anti-abrasion member 224 is preferably molded or otherwise formed from a lubricious plastic such as PTFE, or other material as can be determined through routine experimentation. The lace 23 crosses the apex so that crossing friction would be limited to a small contact area and over a lubricious surface rather than along the softer tongue material or through the length of a channel or lumen as in previous embodiments. Tapered sides of the anti-abrasion member 224 would ensure that the anti-abrasion member 224 stayed reasonably flexible as well as help distribute the downward load evenly laterally across the foot. The length along the midline of the foot would vary depending upon the boot design. It may be as short as one inch long or less and placed on the tongue just where the lace crossing are, or it may extend along the entire length of the tongue with the raised ridge or crossing edge more prominent in the areas where the lace crosses and less prominent where more flexibility is desired. The anti-abrasion member 224 may be formed integrally with or attached to the tongue or could float on top of the tongue as in previously described disks.

In one embodiment, the anti-abrasion member 224 is fixedly mounted on the tongue 36 using any of a wide variety of well known fasteners, such as rivets, screws, snaps, stitching, glue, etc. In another embodiment, the anti-abrasion member 224 is not attached to the tongue 36, but rather freely floats atop the tongue 36 and is held in place through its engagement with the lace 23. Alternatively, the anti-abrasion member 224 is integrally formed with the tongue 36, such as by threading a first portion of the lace 23 through the tongue, and the second, crossing portion of lace 23 over the outside surface of the tongue.

Alternatively, one or more of the sections of lace 23 which extend between the flaps 32 and 34 may slideably extend through a tubular protective sleeve. Referring to FIG. 12, three crossover points are illustrated, each crossover point including a first and a second crossing segments of the lace 23. A tubular protective sleeve may be provided on each of the first segments or on both the first and second segments at each of the crossover points. Alternatively, the short tubular protective sheaths may be provided on one or both of the segments of lace 23 at the central crossover point which, in FIG. 12, is illustrated as carrying the anti-abrasion member 24. Optimizing the precise number and location of the protective tubular segments may be routinely accomplished, by those of skill in the art observing wear patterns of the lacing system in a particular shoe design.

The tubular protective element may comprise any of a variety of tubular structures. Lengths of polymeric or metal tubing may be utilized. However, such tubular supports generally have a fixed axial length. Since the distance between the opposing flaps 32 and 34 will vary depending upon the size of the wearer's foot, the protective tubular sleeves should not be of such a great length that will inhibit tightening of the lacing system. The tubular protective sheaths may also have a variable axial length, to accommodate tightening and loosening of the lacing system. This may be accomplished, for example, by providing a tubular protective sheath which includes a slightly stretched spring coil wall. During tightening of the system, when each of the opposing flaps 32 and 34 are brought towards each other, the axial length of the spring guide may be compressed to accommodate various sizes. A further alternative comprises a tubular bellows-like structure having alternating smaller-diameter and larger-diameter sections, that may also be axially compressed or stretched to accommodate varying foot sizes. A variety of specific accordion structures, having pleats or other folds, will be apparent to those of skill in the art in view of the disclosure herein. As a further alternative, a telescoping tubular sleeve may be utilized. In this embodiment, at least a first tubular sleeve having a first diameter is carried by the lace 23. At least a second tubular sleeve having a second, greater diameter is also carried by the lace 23. The first tubular sleeve is axially slideably advanceable within the second tubular sleeve. Two or three or four or more telescoping tubes may be provided, for allowing the axial adjustability described above.

Figure 15:
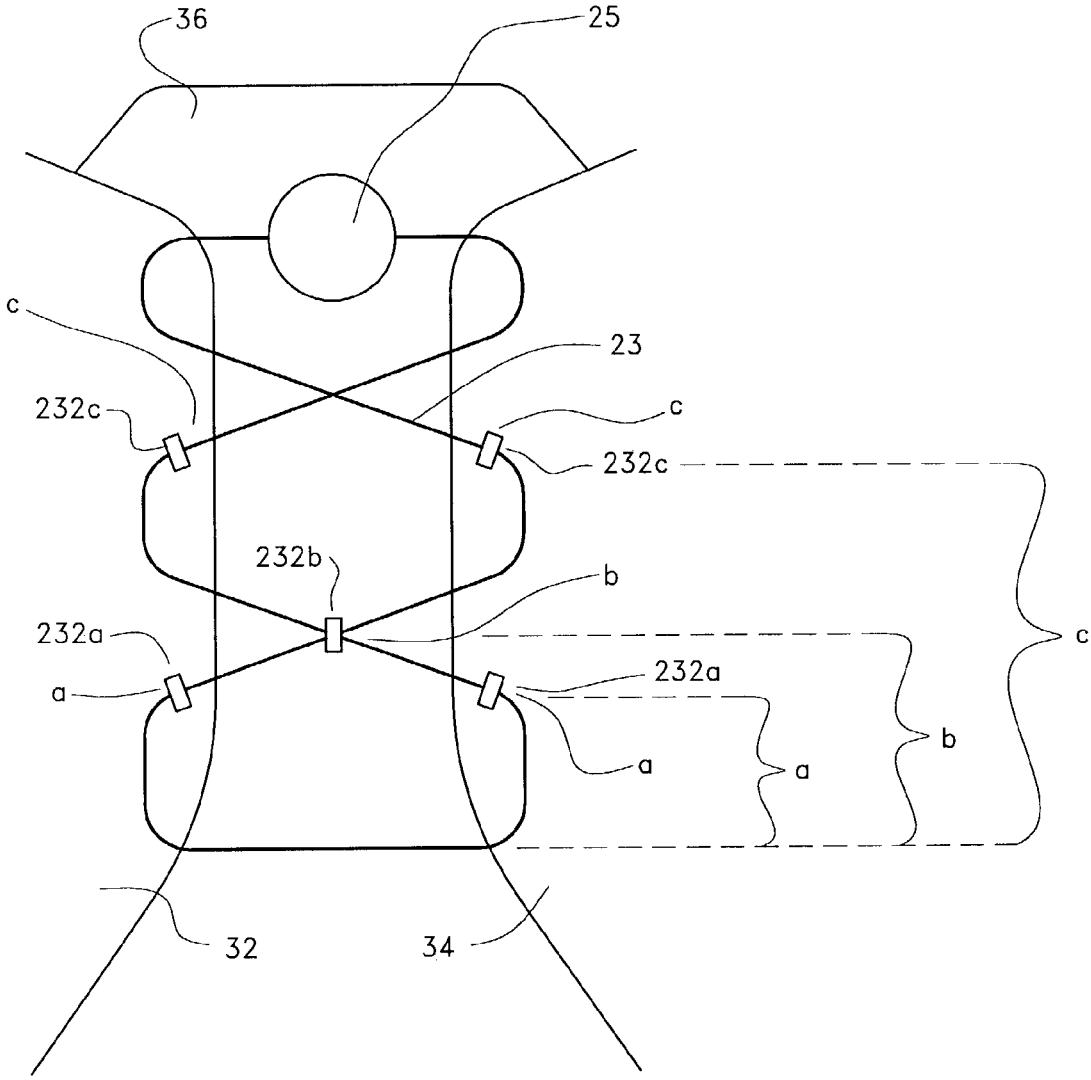
FIG. 15 is a schematic front view of the instep portion of the boot with a plurality of lace locking members disposed along the lace pathway.

FIG. 15 schematically illustrates a top view of the insole region of the boot 20. At least one lace locking member 232 (shown schematically) is disposed along the pathway of the lace 23. Each locking member 232 is configured to engage the lace 23 and prevent a predetermined portion of the lace from moving axially, such as toward the tightening mechanism 25 to thereby limit the tension of the lace in a predetermined region. For example, a pair of locking members 232*a* are located at points "a" along the lace pathway near the toe region of the flaps 32, 34. After tension has been applied to the lace 23 via the tightening mechanism 25, the locking members 232*a* may be engaged with the lace 23 to prevent movement of the lace in region "a". Once engaged, the locking members 232*a* secure the tension in the lace 23 in region "a" by locking the position of the lace 23 at points "a" with respect to the tightening mechanism 25. The lace tension in region "a" is thereby maintained even if the tension applied to the lace 23 by the tightening mechanism 25 is released or actuated. Thereafter, the tightening mechanism 25 may be released or actuated to apply a different level of tension or tightness in the lace outside of lace region "a".

With reference to FIG. 15, locking members 232 may be disposed at any of a wide variety of locations along the lace pathway, such as locations "b", and "c" to create various lace locking zones. By alternately locking and unlocking the locking members 232 and varying the tension in the lace 23, a user may provide zones of varied tightness along the lace pathway.

Figure 16:
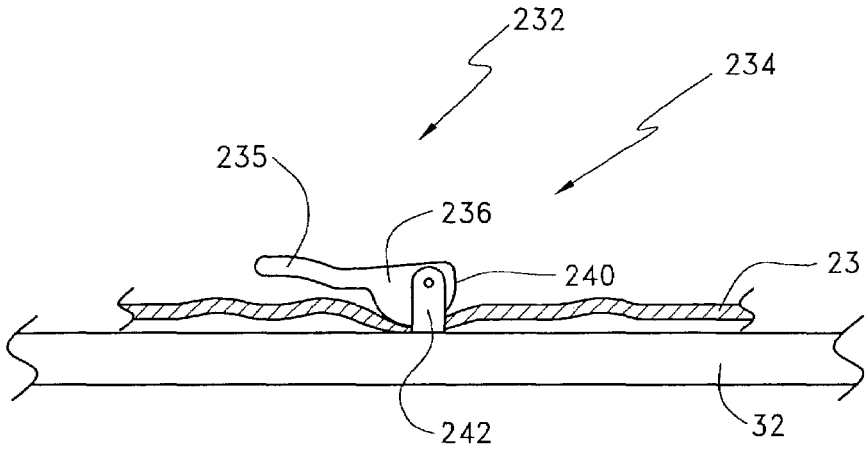
FIG. 16 is a side view of one embodiment of a lace locking member engaged with the boot lace.
Figure 17:
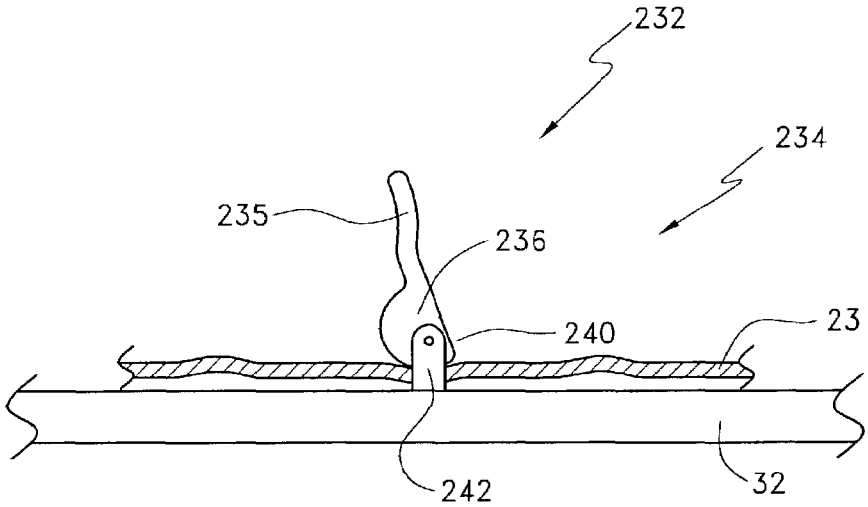
FIG. 17 is a side view of one embodiment of a lace locking member non-engages with the boot lace.

FIGS. 16 and 17 show one embodiment of a locking member 232 that is coupled to the boot flap 32. The locking member 232 comprises an actuator 234 having an elongate arm 235 that extends outwardly from an enlarged cam portion 236 having a rounded bottom edge 240. The lace 23 is interposed between the rounded edge 240 of the cam portion 236 and the flap 32. The enlarged cam portion 236 of the actuator 234 is rotatably mounted to the flap 32, such as through a rotatable pin connector 242. As shown in FIG. 16, the actuator 234 may be moved to first or engaged position wherein the rounded edge 240 engages the lace 23 and applies a tightening force to secure the lace against the flap 32. The locking member 232 thereby prevents movement of the lace 23 relative to the shoe flap 32.

With reference to FIG. 17, the actuator 234 may also be moved to a second, non-engaged orientation wherein the rounded edge 240 of the cam portion 236 is removed from engagement with the lace 23 to thereby allow movement of the lace 23 relative to the flap 32.

Figure 19:
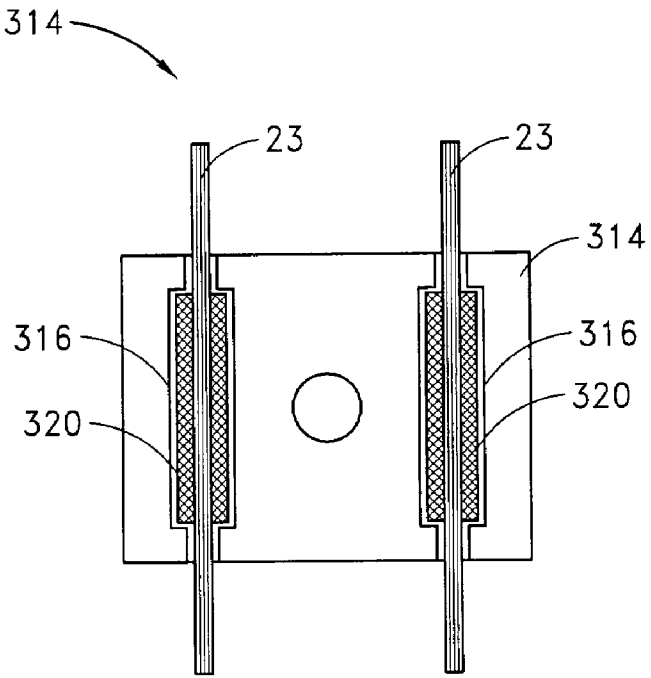
FIG. 19 is a top plan view of a first member portion of the lace locking member of FIG. 18.
Figure 18:
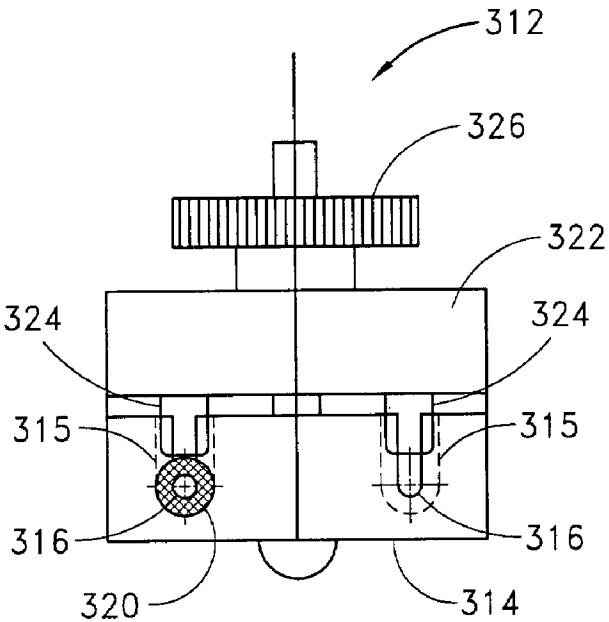
FIG. 18 is a side view of a second embodiment of the lace locking member.

FIG. 18 shows another embodiment of a lace locking member 312 comprised of a multi-piece structure including a first member 314 and a second member 322 coupled thereto. As best shown in the cross-sectional view of FIG. 19, the first member has a pair of shafts 316 extending therethrough. A pair of bore holes 315 (FIG. 18) in the first member 314 communicate with the shafts 316. An elongate tubular compression clamp 320 is located within each of the shafts 316. The shafts 316 and the compression clamps 320 are sized to receive the lace 23 therethrough, as shown in FIG. 19.

The second member 322 is movably coupled to the first member 314. The second member 322 includes a pair of pegs 324 that extend into the bore holes 315 in the first member 314. A screw 326 is coupled to the first member 314 and the second member 322. The second member 322 may be incrementally moved toward the first member 314 by turning the screw 326. As the screw 326 is turned, the pegs 324 incrementally slide into the lace shafts 316 and pinch or compress the compression clamps 320. When the lace is disposed within the compression clamps 320, the compression coupling between the pegs 324 and the compression clamps 320 is transferred to the lace 23 to inhibit the lace 23 from moving. The user may adjust the screw 326 to vary the level of compression that the pegs 324 apply to the lace 23.

The compression clamps 320 are preferably made of a soft, deformable material that will deform when the pegs 324 apply pressure thereto. Advantageously, the soft compression clamps 320 exert sufficient compression to the lace 23 with reduced risk of deformation to the lace 23. The locking member 312 may be disposed at various locations along the lace pathway to allow the user to create zones of varying tightness, as described previously.

As mentioned, the locking members 232 may be located at any of a wide variety of locations along the lace pathway to allow the user to fix the position of the lace 23 at any of these locations. Other mechanical or structural designs may be used to lock the lace relative to the tightening mechanism. For example, the entryways of the guide members may be fitted with a collect to engage the lace 23.

Figure 20:
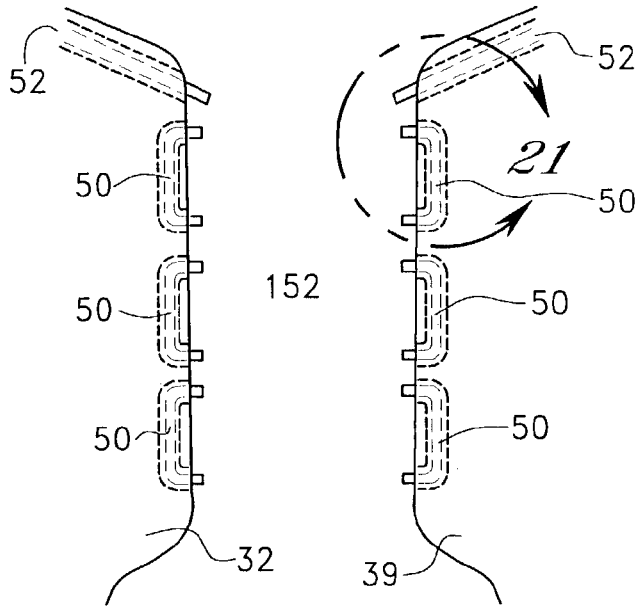
FIG. 20 is a front view of the instep portion of the boot.
Figure 21:
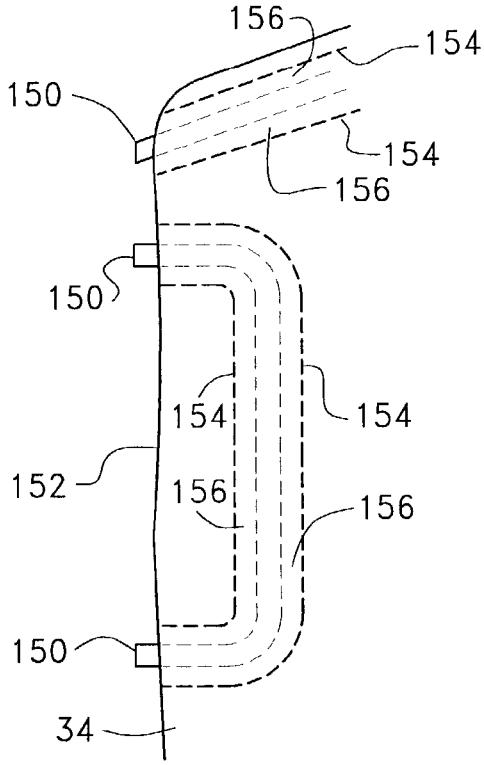
FIG. 21 is an enlarged view of the region within line 21 of FIG. 20.

FIG. 20 is a front view of the instep portion of the boot 20. In the embodiment shown in FIG. 20, the tubular guide members 50 and 52 are mounted directly within the flaps 32, 34, such as within or between single or multiple layers of material. Preferably, the tips 150 of each of the guide member 50, 52 protrude outwardly from an inner edge 152 of each of the flaps 32, 34. As best shown in FIG. 21, a set of stitches 154 surrounds each guide member 50 and 52. The stitches 154 are preferably positioned immediately adjacent the guide members 50, 52 to create a gap 156 therebetween. For ease of illustration, the gap 156 is shown-having a relatively large size with respect to the diameter of the guide members 50, 52. However, the distance between each guide member 50, 52 and the respective stitches 154 is preferably small.

Preferably, each set of stitches 154 forms a pattern that closely matches the shape of the respective guide members so that the guide members 50, 52 fit snug within the flaps 32, 34. The stitches 154 thereby inhibit deformation of the guide members 50, 52, particularly the internal radius thereof, when the lace is tightened. Advantageously, the stitches 154 also function as anchors that inhibit the guide members 50, 52 from moving or shifting relative to the flaps 32, 34 during tightening of the lace.

The gap 156 may be partially or entirely filled with a material, such as glue, that is configured to stabilize the position of the guide members 50, 52 relative to the flaps 32, 34. The material is selected to further inhibit the guide members 50, 52 from moving within the gap 156. As shown in FIG. 22, the guide members may also be equipped with anchoring members, such as tabs 160 of various shape, that are disposed at various locations thereon and that are configured to further inhibit the guide members 50, 52 from moving or deforming relative to the flap 32. The anchoring members may also comprise notches or grooves on the guide members 50, 52 that generate friction when the guide members 50, 52 begin to move and thereby inhibit further movement. The grooves may be formed using various methods, such as sanding, sandblasting, etching, etc.

Axial movement of the guide tubes 50 or 52 may also be limited through the use of any of a variety of guide tube stops such as that illustrated in FIG. 22A. The guide tube stop includes a tubular body having an opening 51 which provides access to a central lumen 53 extending therethrough. The stop may also be provided with one or more fastening tabs 160, for sewing or gluing to the shoe, as has been discussed. Tabs 160, once stitched or otherwise secured into place, resist axial movement of the device along its longitudinal pathway.

The central lumen 53 extends to a radially outwardly extending step 57, producing a chamber 55 having a greater inside diameter than the lumen 53 at the opening 51. Chamber 55 is dimensioned to slideably receive an end of a guide tube 50 or 52 therein. The annular step 57 inhibits movement of the guide tube in the direction of opening 51. The stop may be manufactured in accordance with any of a variety of techniques, such as injection molding or machining from suitable materials including plastics and metal. In one embodiment, the guide tube 52 comprises plastic, and the stop comprises plastic. The end of the guide tube may be secured within chamber 55 using any of a variety of adhesives, solvent bonding, thermal bonding, interference fit or other techniques known in the art, or simply held in place by tension on the lace. In one embodiment, the tube 50 is bonded within the stop using adhesive.

In any of the embodiments discussed elsewhere herein, the exit point on the lace guide or other structure may be made from a harder, more durable material than the rest of the lace guide. In the case of a tubular lace guide, the lace guide is often preferably flexible so that it can flex with the boot. Most of the wear takes place at the exit point of the cable, where reinforcement may be desirable. In addition, the tube stop can be made completely of metal or other high durometer material while the corresponding tubular lace guides are more flexible. This may be accomplished in a variety of ways, such as using metal or high durometer plastic ring inserts or attachments or coatings at the lace exit point as will be apparent to those of skill in the art in view of the disclosure herein.

By providing a stop on each end of a guide tube 50 or 52, movement of the guide tube 50 or 52 along its longitudinal axis under normal use conditions can be prevented.

In any of the foregoing embodiments, the external opening to the lace guide is subject to wear by the cable advancing in and out as the product is used. The durability of the lace guide may be improved by including an annular ring of a harder durometer material at the lace guide opening. Alternatively, a metal ring can be attached at each lace guide opening, using any of a variety of attachment techniques known in the art, including insert molding, adhesive bonding, threaded engagement and others known in the art. As a further alternative, a portion of the lumen extending through the lace guide may be lined using a metal tube such as an appropriately sized hypodermic needle tubing, taking into account the diameter of the lace. The tubing can extend slightly beyond the opening to the central lumen in the plastic-molded or formed part.

Figure 23:
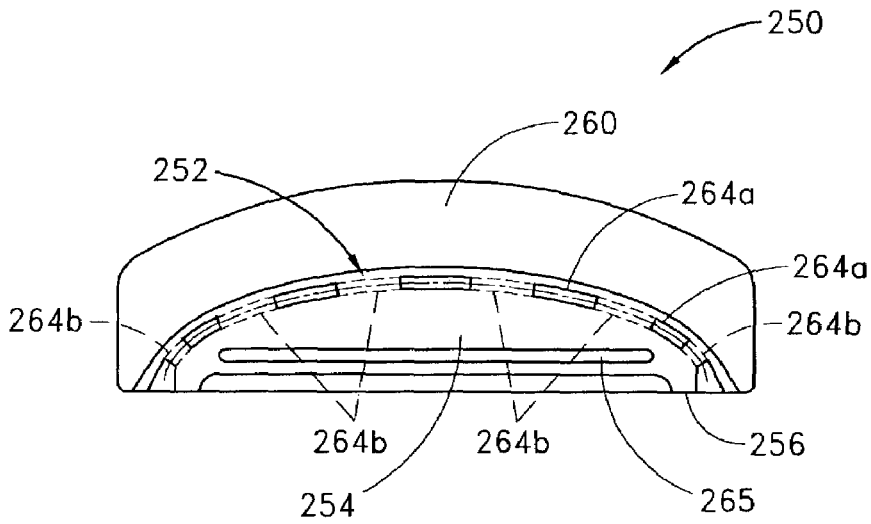
FIG. 23 is a top plan view of an alternative embodiment of a lace guide.
Figure 24:
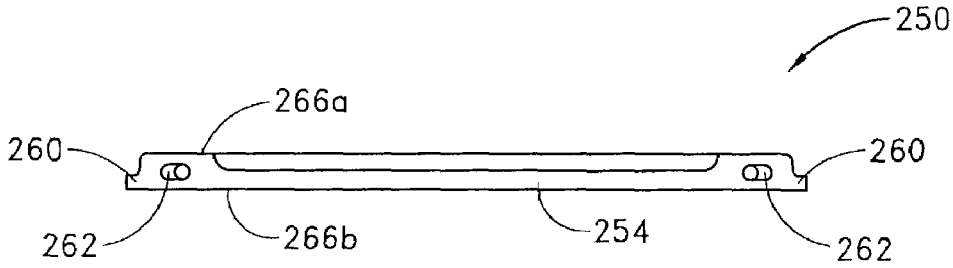
FIG. 24 is a side view of the lace guide of FIG. 23.

With reference to FIGS. 23 and 24, an alternative guide member 250 comprises a thin, single-piece structure having an internal lumen 252 for passage of the lace 23 therethrough. The guide member 250 includes a main portion 254 that defines a substantially straight inner edge 256 of the guide member. A flange portion 260 extends peripherally around one side of the main portion 254. As best shown in FIG. 22, the flange portion 260 comprises a region of reduced thickness with respect to the main portion 254. An elongate slot 265 comprised of a second region of reduced thickness is located on the upper surface 266*a* of the guide member 250.

A pair of lace exit holes 262 extend through a side surface of the lace guide member 250 and communicate with the lumen 252. The lace exit holes 262 may have an oblong shape to allow the lace 23 to exit therefrom at a variety of exit angles.

With reference to FIGS. 23 and 24, a series of upper and lower channels 264*a*, 264*b*, respectively, extend through upper and lower surfaces 266*a*, 266*b*, respectively, of the lace guide member 250. The channels 264 are arranged to extend along the pathway of the lumen 252 and communicate therewith. The location of each of the upper channels 264*a* preferably successively alternates with the location of each of the lower channels 264*b* along the lumen pathway so that the upper channels 264*a* are offset with respect to the lower channels 264*b*.

Figure 25:
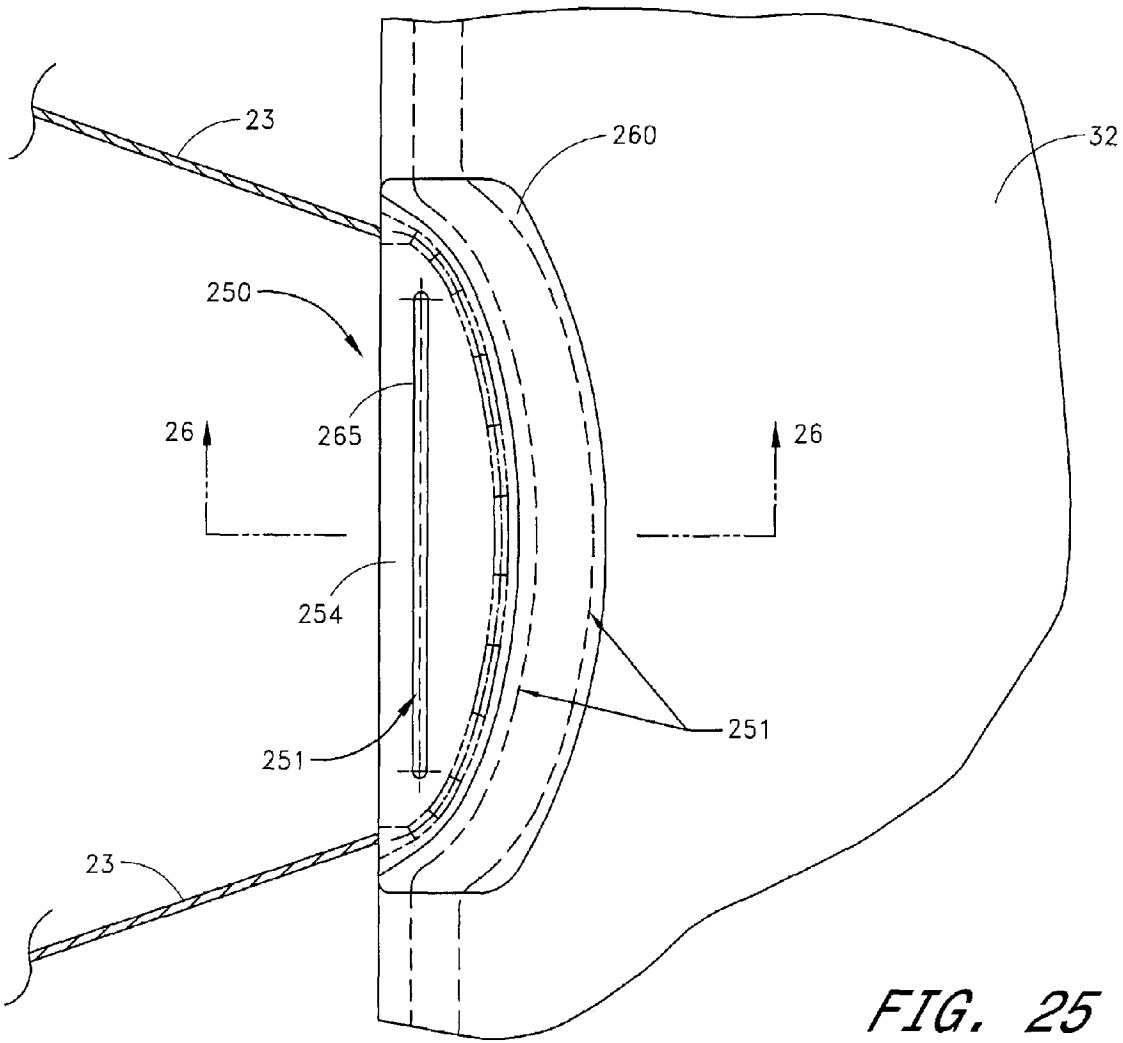
FIG. 25 is a top view of the lace guide of FIG. 23 mounted in a boot flap.
Figure 26:
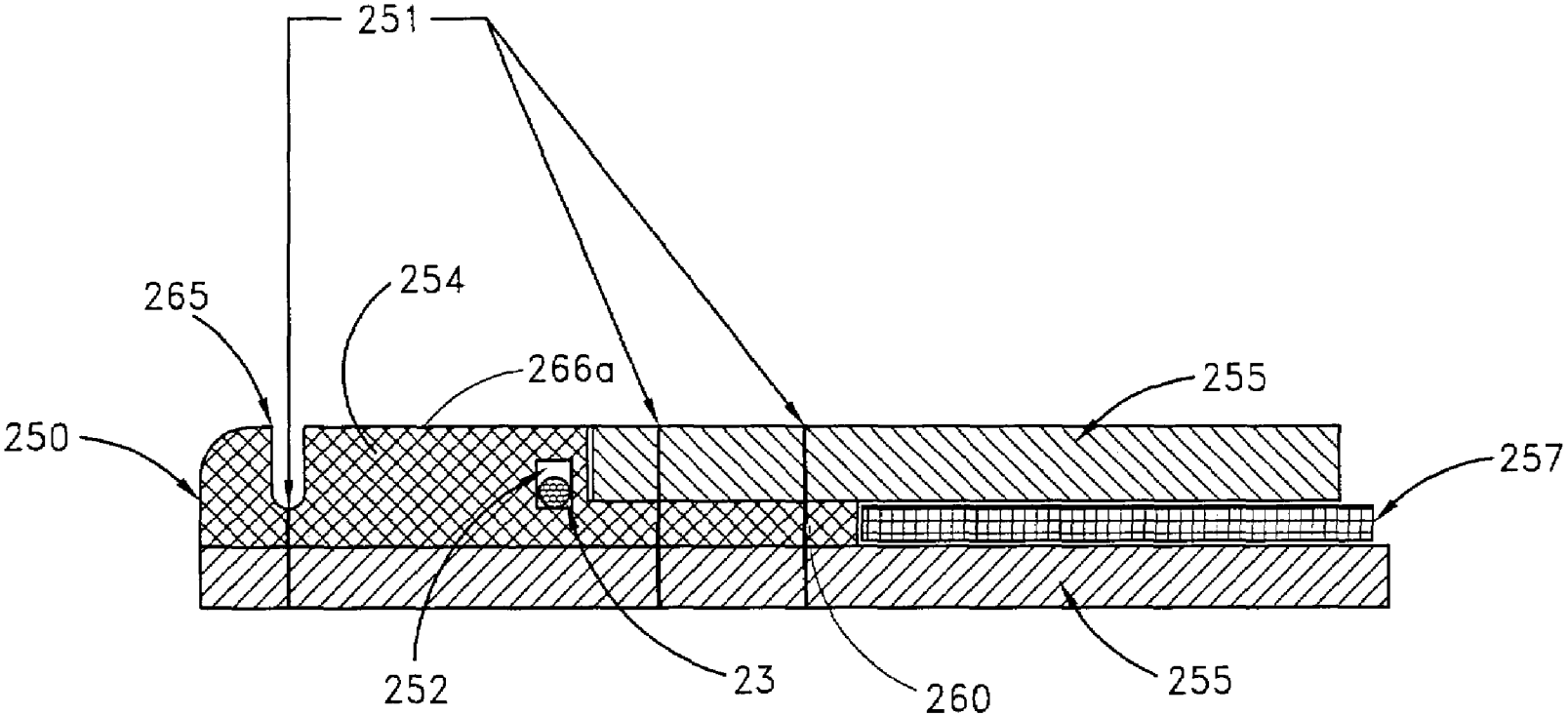
FIG. 26 is a cross-sectional view of the lace guide and boot flap along line 26-26 of FIG. 25.

With respect to FIGS. 25 and 26, the lace guide member 250 is mounted to the flaps 32, 34 by inserting the flange region 260 directly within the flaps 32, 34, such as within or between single or multiple layers 255 (FIG. 26) of material. The layers 255 may be filled with a filler material 257 to maintain a constant thickness in the flaps 32, 34.

The lace guide member 250 may be secured to the flaps 32, 34, for example, by stitching a thread through the flap 32, 34 and through the lace guide member 250 to form a stitch pattern 251. The thread is preferably stitched through the reduced thickness regions of the flange portion 260 and the elongate slot 265. Preferably, the flaps 32, 34 are cut so that the main portion 254 of the guide member 250 is exposed on the flap 32, 34 when the lace guide member 250 is mounted thereon.

With respect to FIG. 26, the upper surface 266*a* of the main portion of the guide member 250 is preferably maintained flush with the upper surface of the flaps 32, 34 to maintain a smooth and continuous appearance and to eliminate discontinuities on the flaps 32, 34. Advantageously, because the flange region 260 has a reduced thickness, the lace guide member 250 is configured to provide very little increase in the thickness of the flaps 32, 34, and preferably no increase in the thickness of the flaps. The lace guide member 250 therefore does not create any lumps in the flaps 32, 34 when the guide member 250 is mounted therein.

As mentioned, a series of upper and lower offset channels 264*a,b* extend through the lace guide member 250 and communicate with the lumen 252. The offset arrangement of the channels advantageously facilitates manufacturing of the guide members 250 as a single structure, such as by using shut-offs in an injection mold process.

The shape of the lumen may be approximately defined by an ellipse. In one embodiment, the ellipse has a major axis of about 0.970 inches and a minor axis of about 0.351 inches.

Figure 27:
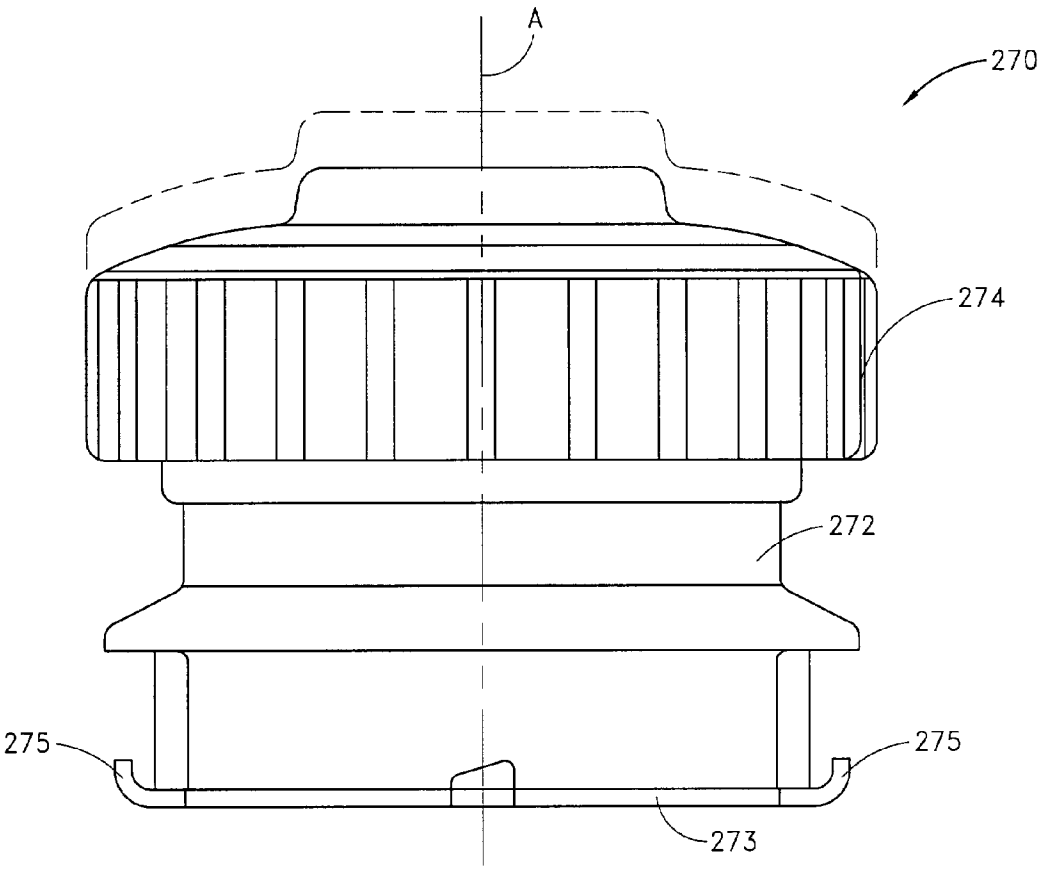
FIG. 27 is a side view of a second embodiment of the tightening mechanism.

FIG. 27 is a side view of an alternative tightening mechanism 270. The tightening mechanism 270 includes an outer housing 272 having a control mechanism, such as a rotatable knob 274, mechanically coupled thereto. The rotatable knob 274 is slideably movable along an axis A between two positions with respect to the outer housing 272. In a first, or engaged, position, the knob 274 is mechanically engaged with an internal gear mechanism located within the outer housing 272, as described more fully below. In a second, or disengaged, position (shown in phantom) the knob is disposed upwardly with respect to the first position and is mechanically disengaged from the gear mechanism. A bottom plate 273 is disposed at a bottom end of the outer housing 272. A set of mounting arms 275 extends radially outwardly from the bottom plate 273, to removably engage a mounting structure discussed below.

Figure 28:
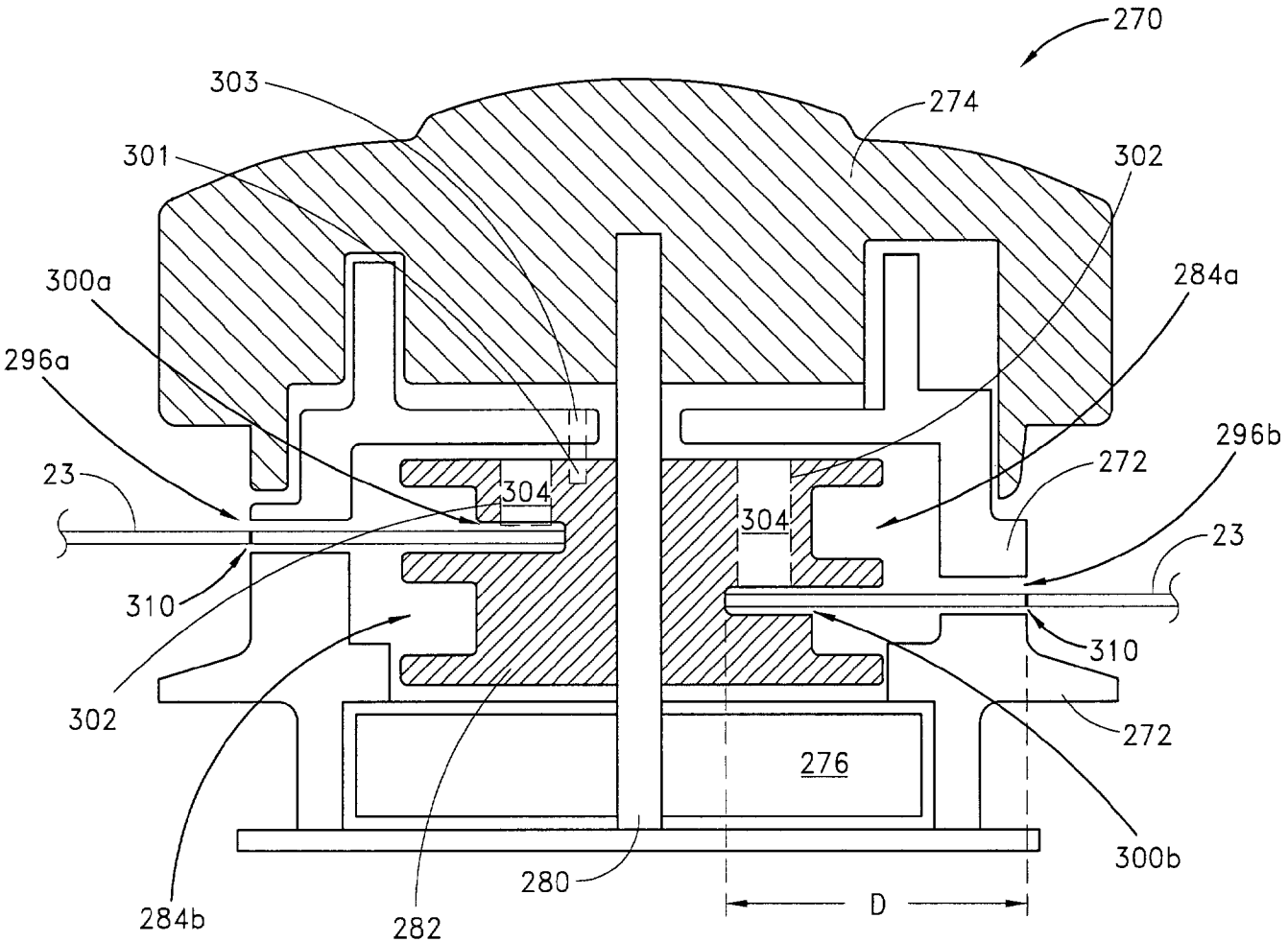
FIG. 28 is a cross-sectional view of the embodiment of FIG. 27.

FIG. 28 is a cross-sectional view of the tightening mechanism 270. A gear mechanism 276 (shown schematically) is disposed within a lower region of the outer housing 272 and is mechanically coupled to the rotatable knob 274 via a shaft 280. The shaft 280 is mechanically coupled to the knob, such as through a spline interface.

A lace wind-up spool 282 is interposed between the gear mechanism 276 and the control knob 274. The shaft 280 is journaled through the spool 282. The spool 282 is mechanically coupled to the gear mechanism 276. The spool 282 includes a pair of annular grooves 284*a,b* that are sized to receive the wound lace 23. The spool 282 rotates about the axis of the shaft 280 in response to rotation of the control knob 274.

The control knob 274 is configured to be incrementally rotated in a forward rotational direction, i.e., in a rotational direction that causes the lace 23 to wind around the spool 282. Toward this end, the control knob 274 preferably includes a series of integrally-mounted pawls 277 that engage corresponding series of ratchets on the outer housing 272. See FIGS. 31-32. The pawls 277 are preferably permanently engaged with the ratchets 279 when the control knob 274 is in the coupled or uncoupled position. The ratchet/pawl engagement prevents the knob 274 and the spool 282 from being rotated in a backwards direction (i.e., in a rotational direction opposite the rotational direction that winds the lace 23 around the spool 282) when the knob 274 is in the coupled position. This configuration prevents the user from inadvertently winding the control knob 274 backwards, which could cause the lace 23 to kink or tangle in the spool 282. The risk of tangling is especially high where a large length of lace 23 is wound around the spool, such as in the present case, where from about six inches up to about 2 feet of cable length (one half on each end) is wound around the spool 282.

Figure 30:
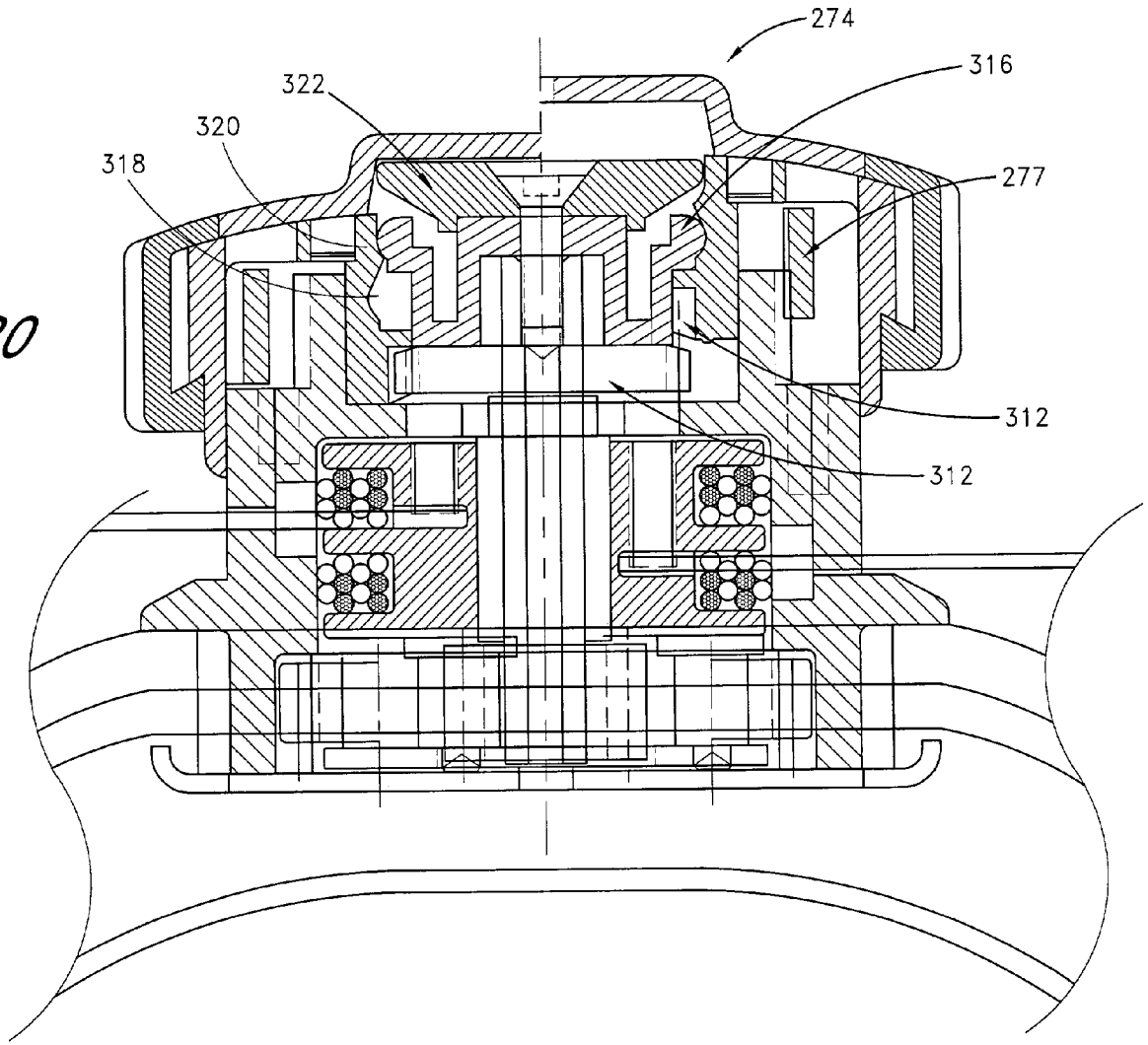
FIG. 30 is a split elevational cross section through a tightening mechanism, with the left side in the coupled position and the right side in the uncoupled position.

Referring to FIG. 30, the knob 274 is illustrated to show moveability between two positions, a coupled position (left side of drawing) and an uncoupled position (right side of drawing). The pawls 277 on the knob 274 are slideably engaged with the ratchets on the case so they are engaged in either position so the knob can never be rotated backwards. In the engaged position, the spline teeth on the knob are coupled to the spline teeth on the shaft 280 which effectively couples the ratchet/pawl system to the gear train and spool 282 so the lace 23 cannot unwind. The only way to unwind the lace 23 from the spool 282 is to pull the knob 274 out into the uncoupled position which uncouples the splines allowing the spool to spin freely in either direction. The lace is then pulled off the spool manually. A deflectable indent washer mounted onto the shaft presses against the knob 274 and falls into one of two indents in the knob. This holds the knob by friction in either the coupled or uncoupled position. Although in this embodiment, the permanently engaged ratchet/pawl assembly is uncoupled from the spool by pulling out the knob, this uncoupling could be accomplished in several different ways by someone skilled in the art.

With reference to FIG. 28, a pair of lace entry holes 296*a,b* are disposed on the side of the outer housing 272 of the tightening mechanism 270. The lace entry holes 296*a,b* communicate with the annular grooves 284*a,b*, respectively, in the spool 282. A pair of lace retention holes 300*a,b* are disposed in the spool within the grooves 284*a,b*. respectively. Each of the lace retention holes 300*a,b* comprises a cylindrical bore that extends radially into the spool 282. The lace retention holes 300*a,b* are sized to receive the end of lace 23 therein. A pair of counterbores 302 extend downwardly through the spool 282 and communicate with the lace retention holes 300*a,b*. An attachment device, such as set screw 304, is disposed within each of the counterbores 302. The set screws 304 may be rotated to incrementally project bottom ends thereof into the lace retention holes 300*a,b*.

The spool 282 may be rotated so that each of the lace retention holes 300*a,b* aligns with a corresponding lace entry hole 296*a,b*, respectively, as shown in FIG. 28. Toward this end, an alignment hole 301 is located in the spool 282 and a corresponding alignment hole 303 is located in the outer housing 272. The two alignment holes 301, 303 may be aligned through rotation of the spool 282. Preferably, when the holes 301, 303 are aligned, the lace retention holes 300 are also aligned with the lace entry holes 296. The user may thereby quickly and easily align the lace retention holes 300 with the lace entry holes 296 by aligning the alignment holes 301, 303 and then inserting a pin therein to fix the position of the spool 282 with respect to the outer housing 272.

The lace 23 is installed onto the tightening mechanism 270 by first rotating the spool 282 so that the lace retention holes 300*a,b* align with the corresponding lace entry holes 296*a,b*, as described above. The ends of the lace 23 are then each inserted into separate lace entry holes 296*a,b* until the lace ends abut an inner surface of the lace retention holes 300*a,b*. The set screws 304 are then individually rotated so that the bottom ends of the set screws 304 engaged or pinch the lace ends to thereby secures the lace 23 within the retention holes 300*a,b*. The control knob 274 may be rotated in the forward direction to wind the lace 23 around the spool 282. The lace 23 may be removed from the spool 282 by loosening the set screws 304 to disengage the set screws 304 from the lace end and then pulling the lace 23 from the spool 282.

Figure 29:
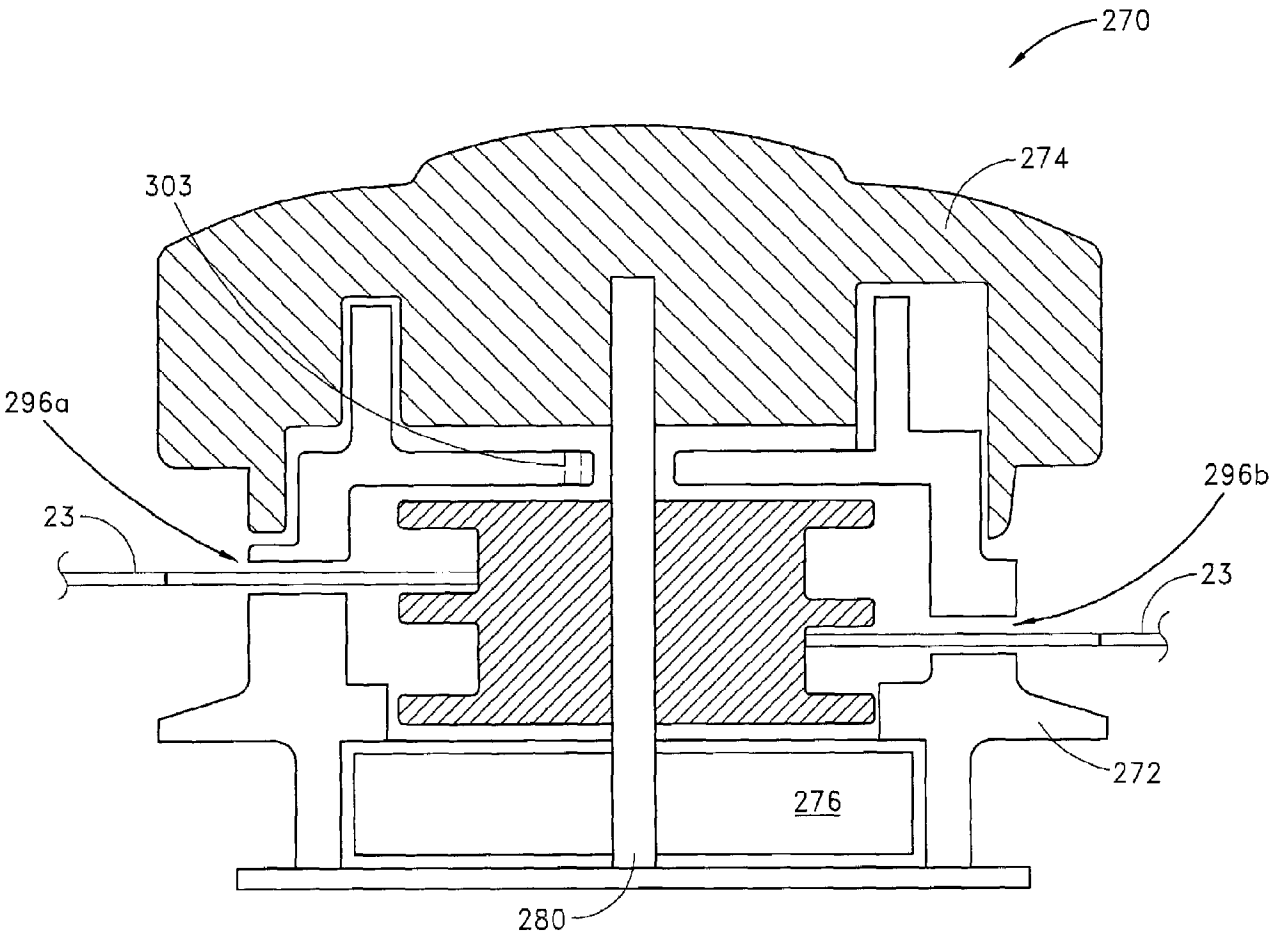
FIG. 29 is a cross-sectional view of an alternate tightening mechanism.

As mentioned, the lace entry holes 296*a,b* should be aligned with the corresponding lace retention holes 300*a,b* when inserting the lace ends into the entry holes 296*a,b*. As shown in FIG. 29, the lace end will not enter the retention hole 300 but will rather abut the inner surface of the spool 282 if the holes 296, 300 are not correctly aligned. The user will then not be able to engage the set screw with the lace 23. The ends of the lace 23 preferably each include a marker or indicator 310 to assist the user in installing the lace 23 into the lace retention hole 300*a,b*. The indicator 310 is located a preselected distance from the end of the lace 23, which is preferably substantially equal to the distance D between the inner surface of the lace retention hole 300 and the location of lace entry hole 296.

If the lace entry hole 296 and the lace retention hole 300 are misaligned during installation of the lace 23, the indicator 310 will be clearly visible to the user, as shown in FIG. 29. However, if the lace 23 is correctly positioned within the lace retention hole 300, the indicator 310 will be flush with the entry point of the lace entry hole 296. Advantageously, the user can confirm the that lace is correctly positioned within the lace retention hole 300 when the indicator on the lace is aligned with the entry point of the lace entry hole 296.

The tightening mechanism 270 may be removably mounted to the front, back, top or sides of the boot. In the illustrated embodiment, the tightening mechanism is mounted to the tongue 36 of the boot 20 between the flaps 32, 34. In one embodiment, a bayonet-type mounting system is used to mount the tightening mechanism 270 to the tongue 36. The tongue 36 may include a sheet of flexible material, such as plastic, mounted therein or thereover. The material may include die-cut hole that mates with a corresponding bayonet structure on the bottom plate 273 (FIG. 27) of the tightening mechanism 270. The die cut hole may be, for example, key-shaped so that the bayonet structure may be inserted therein and twisted to lock the bayonet structure within the hole.

Figure 27A:
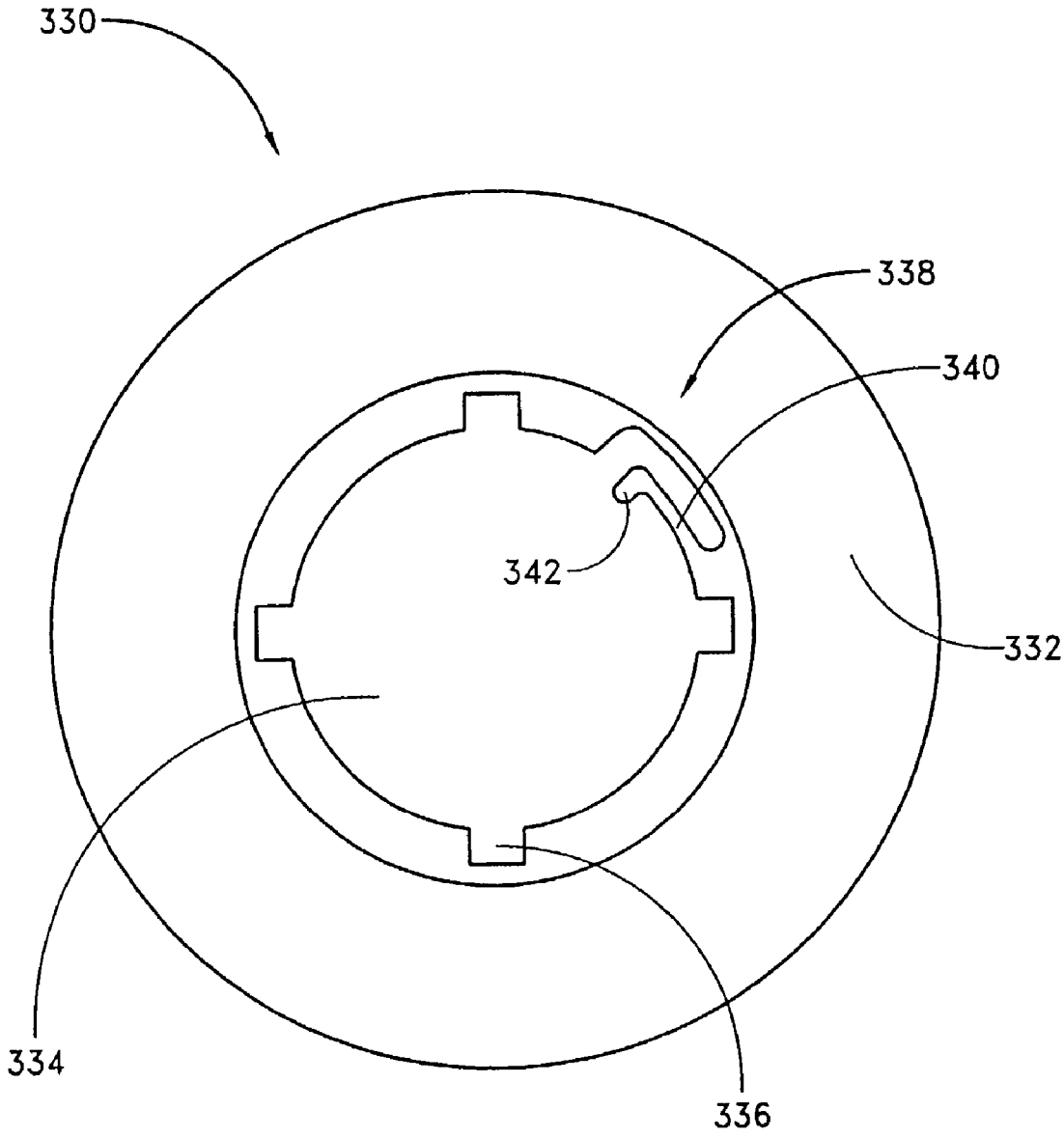
FIG. 27A is a top plan view of a mounting ring for a releasable bayonet mounting in accordance with one aspect of the present invention.

The base for one bayonet mounting system is illustrated in FIG. 27A. The mounting ring 330 comprises an attachment structure 332 for attachment to the boot. In the illustrated embodiment, the attachment structure 332, comprises a radially outwardly extending flange suitable for attachment to the tongue or other portion of the boot by sewing, adhesive bonding, grommets or other fastening techniques known in the art. The mounting ring 330 is provided with a central aperture 334 for removably receiving the base of a reel. One or more axially extending recesses 336 are provided, to slideably receive one or more mounting arms 275 therethrough. When the base of the reel has been advanced into the aperture 334 such that the mounting tab 275 has advanced through the length of the groove 336, the base of the reel may be rotated to offset the mounting tab 275 from the groove 336 thereby locking the reel in place. In the illustrated embodiment, four grooves 336 are illustrated to accommodate four mounting tabs 275. Preferably, two or more corresponding 336 and mounting tabs 275 will be utilized to provide secure retention.

A releasable lock 338 may also be provided. The lock 338 preferably resists rotation of the base such that the base can become separated from the mounting ring 330. In the illustrated embodiment, the lock 338 comprises a flexible arm 340 having a radially inwardly extending engagement surface 342 such as on a tooth. Once the base has been advanced through the aperture 334 and rotated to provide an interference fit, the engagement surface 342 advances under the spring bias supplied by arm 340 into a corresponding recess on the base. By rounding the edges of the tooth, and dimensioning the recess, the engagement provided by lock 338 can be sufficient to resist detachment under normal use conditions. However, when removal of the spool is desired, the spool may be forced to rotate by overcoming the resistance provided by lock 338 as will be appreciated by those of skill in the art in view of the disclosure herein. Advantageously, such a design allows the tightening mechanism to be quickly and easily mounted and dismounted from the boot 20 without the use of tools. Alternatively, it may be desirable to prevent removal of the reel from the bayonet without the use of a special tool. This latter construction will minimize accidental removal of the reel. Any of a variety of locking structures, which may be released using a special screw driver or other tool may be readily incorporated into the present design. Alternatively, a small aperture in the reel may be provided, into which a wire such as a paper clip size pin is inserted to advance a release mechanism to release the reel to bayonet.

Certain functional advantages of embodiments of the present invention can be further illustrated in connection with FIGS. 30 through 32. In particular, the closure system includes a rotatable spool for receiving a lace. The spool is rotatable in a first direction to take up lace and a second direction to release lace. A knob is connected to the spool such that the spool can be rotated in the first direction to take up lace only in response to rotation of the knob. A releasable lock is provided for preventing rotation of the spool in the second direction. One convenient lock mechanism is released by pulling the knob axially away from the boot, thereby enabling the spool to rotate in the second direction to unwind lace. However, the spool rotates in the second direction only in response to traction on the lace. The spool is not rotatable in the second direction in response to rotation of the knob. This prevents tangling of the lace in or around the spool, which could occur if reverse rotation on the knob could cause the lace to loosen in the absence of a commensurate traction on the lace.

Thus, referring to FIG. 30, a knob 274 is shown split down the middle such that the left half of the figure illustrates the knob in the coupled position and the right half of the figure illustrates the knob in the uncoupled position. In the coupled position, rotation of the knob in the forward direction winds lace around the reel. Unwinding of the lace is prevented, despite the tension in the tightened system. In the uncoupled position, traction on the lace causes the reel to unwind. However, the reel is not windable in the reverse direction by rotating the knob.

One manner of accomplishing the foregoing is to provide a spline 314 on the shaft, for engagement with a spline 312 on the knob when the knob is in the coupled position. As illustrated, when the knob 274 is in the uncoupled position, the spline 314 on the shaft is disengaged from the spline 312 on the knob, thereby enabling the reel to be wound in a reverse direction in response to traction on the lace. A radially moveable indent washer 316 is slideably moveable between an uncoupled recess 318 and a coupled recess 320. Any of a wide variety of structures can be utilized to accomplish this result as will be apparent to those of skill in the art in view of the disclosure herein. The indent washer 316 both inhibits accidental movement of the knob 274 from the coupled position to the uncoupled position, and also provides tactile feedback to the user so that the knob will snap into the coupled position or the uncoupled position as desired. A stabilizing washer 322 or other spacer may also be provided, to prevent wobbling of the knob 274.

Figures 31A, 31B:
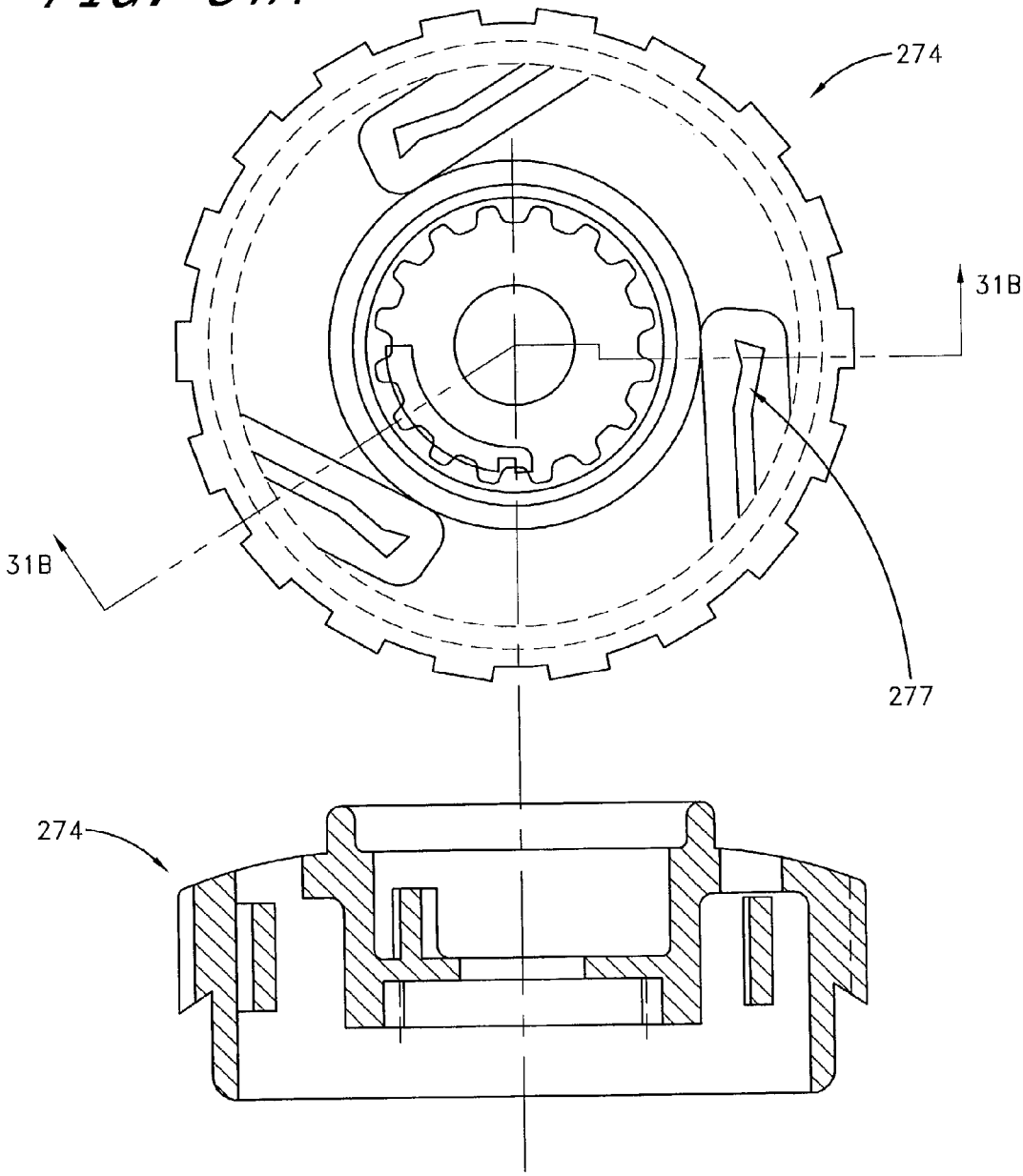
Figure 32:
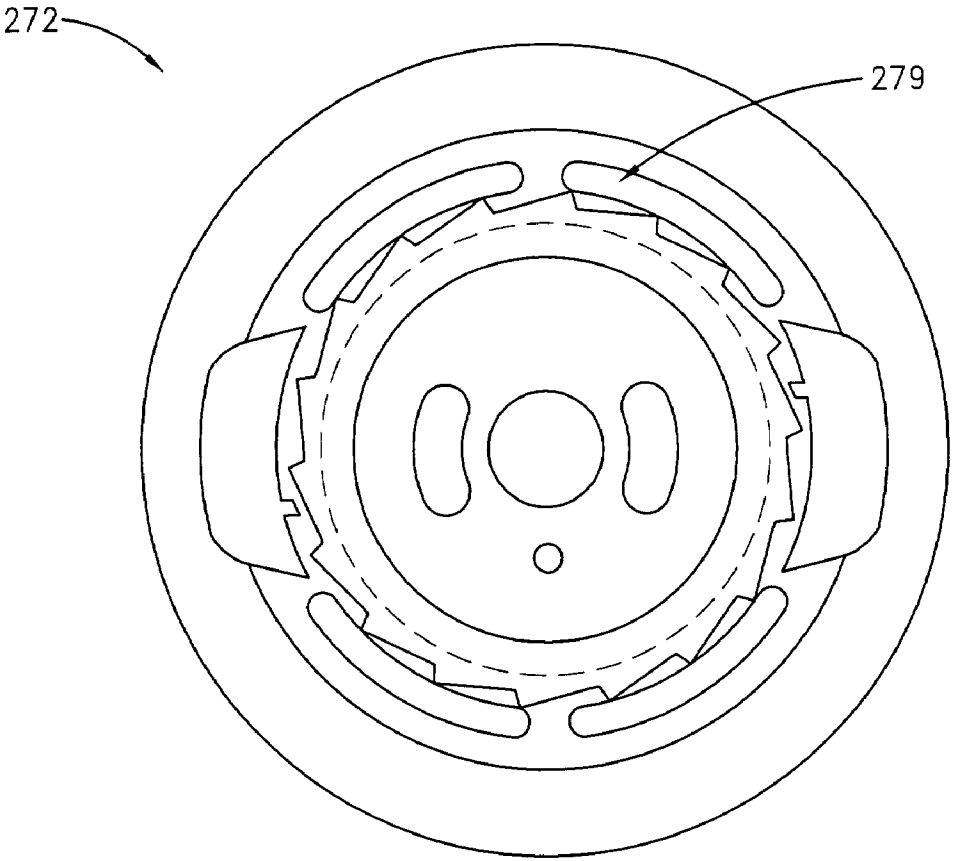
FIG. 32 is a cross section through a tightening mechanism case, illustrating ratchet teeth on the case.

Detailed views shown in FIGS. 31A and 31B and 32 illustrate, for example, a plurality of integrally molded pawls 277 on the knob 274. The pawls 277 are sufficiently axially elongated that they engage the housing in both the coupled position and the uncoupled position to prevent reverse rotation of the knob 274. The corresponding ratchet teeth 279 on the case are illustrated in FIG. 32.

In the foregoing embodiments, the wearer must pull a sufficient length of cable from the spool to enable the wearer's foot to enter or exit the footwear. The resulting slack cable requires a number of turns of the reel to wind in before the boot begins to tighten. An optional feature in accordance with the present invention is the provision of a spring drive or bias within the spool that automatically winds in the slack cable, similar to the mechanism in a self biased automatically winding tape measure. The spring bias in the spool is generally not sufficiently strong to tighten the boot but is sufficient to wind in the slack. The wearer would then engage the knob and manually tighten the system to the desired tension.

The self winding spring may also be utilized to limit the amount of cable which can be accepted by the spool. This may be accomplished by calibrating the length of the spring so that following engagement of the knob and tightening of the boot, the knob can only be rotated a preset additional number of turns before the spring bottoms out and the knob is no longer able to be turned. This limits how much lace cable could be wound onto the spool. Without a limit such as this, if a cable is used which is too long, the wearer may accidentally wind in the lace cable until it jams tightly against the reel housing and cannot be pulled back out.

Figure 33:
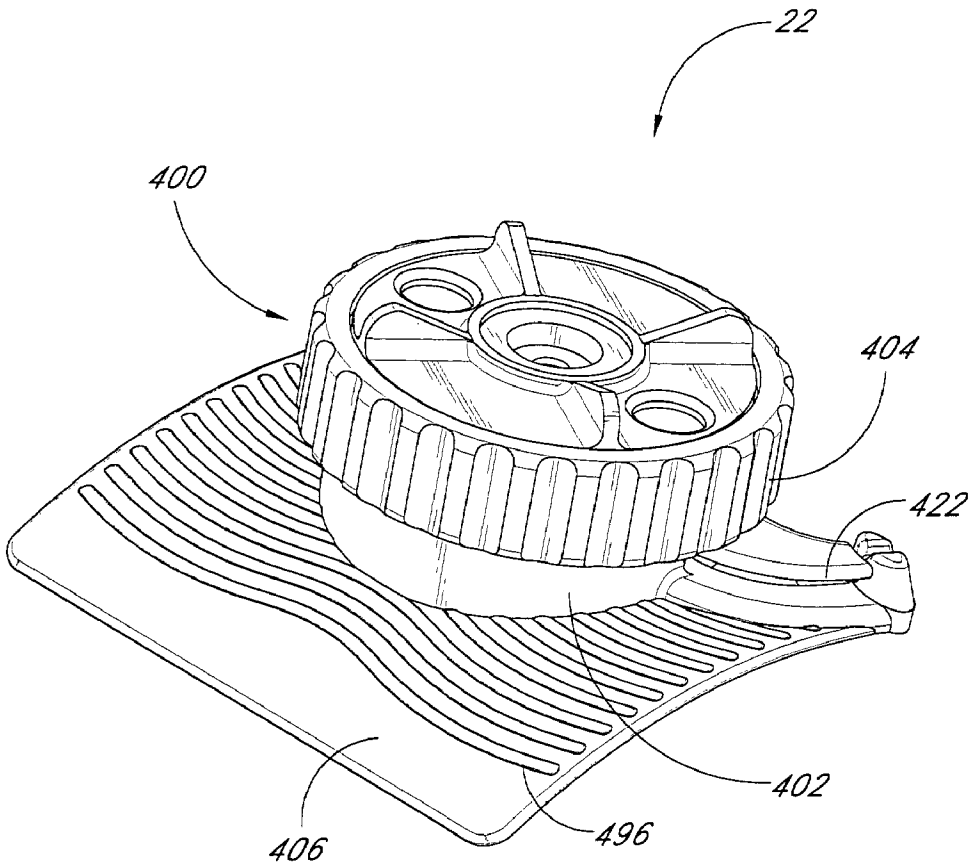
FIG. 33 is a perspective view of one embodiment of a reel for use with a lacing system in accordance with an alternative embodiment incorporating mounting structure and a safety device to inhibit accidental loosing of the lace.
Figure 34:
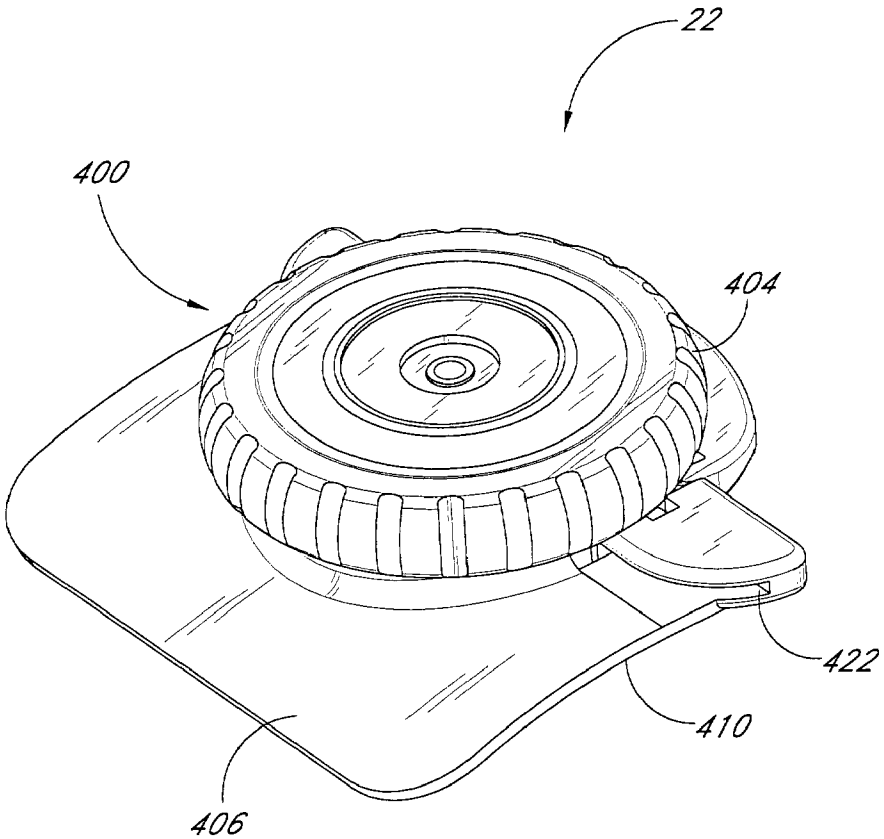
FIG. 34 is a perspective view of another embodiment of the lacing
Figure 35:
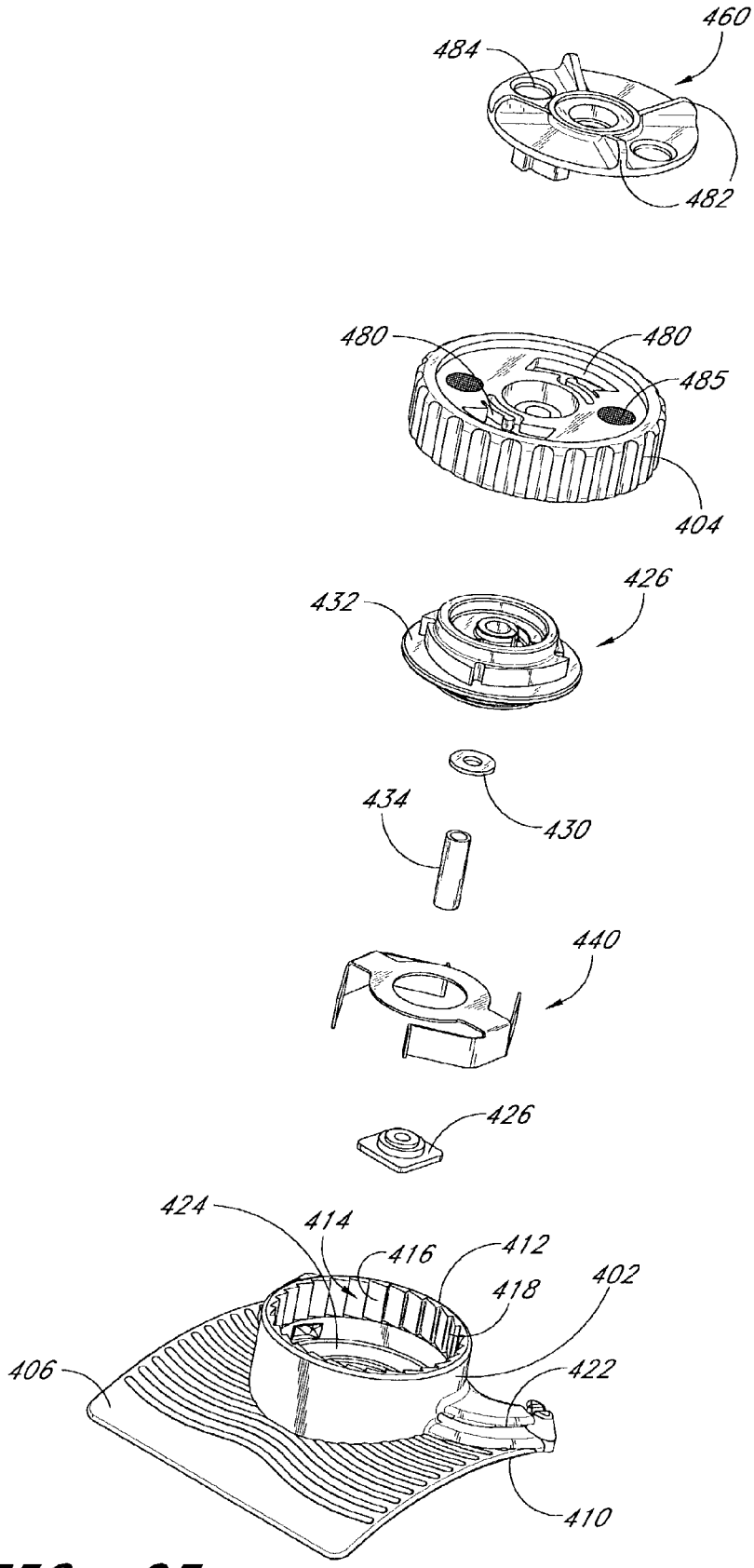
FIG. 35 is an exploded view of the reel of FIG. 33.

With reference to FIGS. 33-35, alternative embodiments of a lacing system 22 have an outer housing 400 comprising a base member 402 and a knob 404. The outer housing is preferably injection molded out of any suitable material, as discussed above, but in one embodiment, is formed of nylon. Of course, any suitable manufacturing process that produces mating parts fitting within the design tolerances is suitable for the manufacture of the components disclosed herein.

The base member 402 is generally a hollow cylinder further having a relatively thin and flat mounting flange 406 that extends generally radially from around about half of the base member 402 circumference. In some embodiments, the mounting flange 406 extends from approximately the bottom surface 410 of the base member, while in other embodiments, the mounting flange 406 extends from about midway between the top edge 412 and the bottom surface of the base member. The mounting flange 406, as described above, is configured to be attached to the footwear in any acceptable manner. In one preferred embodiment, the mounting flange 406 is stitched onto the footwear during manufacture. As discussed above, it may be securely attached by any suitable method, such as, for example, by adhesives, rivets, threaded fasteners, and the like. Alternatively, the mounting flange 406 may be removably attached, such as by a releasable mechanical bonding structure in the form of cooperating hook and loop structure, for example.

The mounting flange 406 may be disposed between layers of the footwear upper, or may be disposed on top of, or underneath, the footwear upper material. The method and location of attachment of the base member 402 is dictated primarily by fashion design, and hence, could conceivably be mounted in any of a number of locations and by any suitable method.

The base member 402 cylindrical portion includes sloped teeth 414 formed into its inner surface. The base member teeth 414 may be formed during the molding process, or may be subsequently cut therein, and each defines a sloped portion 416 and a substantially radial surface 418. In one embodiment, the sloped portion 416 of each tooth 414 allows relative clockwise rotation of a cooperating pawl, while inhibiting relative counterclockwise rotation of an engaging pawl. Of course, the teeth direction could be reversed as desired. The number and spacing of teeth 414 controls the fineness of adjustment possible, and the specific number and spacing can be designed to suit the intended purpose by one of skill in the art in light of this disclosure. However, in many applications, it is desirable to have a fine adjustment of the lace tension, and the inventors hereof have found that approximately 20 to 40 teeth 414 are sufficient to provide an adequately fine adjustment of the lace tension.

The base member 402 additionally contains a pair of lace entry holes 420 (FIG. 40) for allowing each end of a lace to enter therein. As discussed above, the base member 402 lace entry holes 420 may be made more robust by the addition of higher durometer materials either as inserts or coatings to reduce the wear caused by the laces abrading against the base member 402 entry holes 420. Additionally, the site of the entry hole can be rounded or chamfered to provide a larger area of contact with the lace to further reduce the pressure abrasion effects of the lace rubbing on the base unit.

A lace guide 422 can be formed integrally with the base member and can be configured depending upon the specific application of the lacing system 22. For example, in a traditional lacing application where the laces zigzag across the tongue of the boot or shoe, the laces may extend in a lacing path that enters the base member from directions that are diametrically opposed. For this application, the lace guides 422 may extend substantially radially from the base member 402, as discussed above. Alternatively, in applications where the lace path results in substantially parallel laces entering the base member, a pair of lace guides 422 can be integrally molded into the base unit to receive the laces and direct them to opposing sides of the spool for subsequent winding and collection.

It is preferable that the inner bottom surface 424 of the base member is highly lubricious to allow mating components an efficient sliding engagement therewith. Accordingly, in one embodiment, a washer or bushing 426 is disposed within the cylindrical portion of the base member 402, and may be formed of any suitable lubricious polymer, such as PTFE, for example, or may be formed of a lubricious metal. Alternatively, the inner bottom surface 424 of the base member 402 may be coated with any of a number of coatings designed to reduce its coefficient of friction and thereby allow any components sharing surface contact therewith to easily slide.

With additional reference to FIG. 36, a spool 426 is configured to reside within the cylindrical portion of the base member and is configured with sloped teeth 428, such as those found on a ratchet, as has been described herein above in great detail. In one preferred embodiment, the spool 426 is formed of metal, such as aluminum, by any standard chip producing, material removal machining operation. Alternatively, the spool 426 may be cast or molded, and may be formed of any suitable polymer. In another preferred embodiment, the spool is formed of nylon and may optionally have a metal plate insert.

In cooperating with the washer or bushing 426 disposed on the inner bottom surface 424 of the base member 402, the lower surface of the spool 426 is likewise configured for efficient sliding engagement. Accordingly, a second washer 430 formed of highly lubricious material may be provided, or alternatively, the lower surface of the spool 426 may be configured to reduce its coefficient of friction such that the spool 426 easily spins within the base member 402. In the illustrated embodiment, this is accomplished by providing a lip 431 that offers a small surface area that contacts the bottom surface 424 of the base member 402.

The spool 426 has one or more grooves 433 formed therein to receive the lace 435. As described in detail above, there may be one or more grooves that are configured to receive the wound up lace. In one embodiment, the lace passes through holes 437 formed in the spool base member 432 and are securely held in the spool. In one embodiment, the lace 435 has two ends that are tied together. In this particular embodiment, the spool 426 can be configured with a recess 438 (FIG. 40) to accompany the knot formed by the lace ends.

The spool base 432 is preferably circular in shape and is configured to reside within the base member 402. In order to inhibit contact between the outer spool surface and the inner periphery of the base member 402, an axle 434 is provided that extends through the central axis of the spool 426 to maintain the spool 426 in the center of the base member 402.

In one preferred embodiment, the axle 434 is a metallic hollow tube, such as a brass tube, that fits down through the center axis of the spool 426. The axle 434 may be configured with bored ends, or may be threaded, for receiving threaded fasteners. In one embodiment, a screw passes through the knob 404, through the axle 434, and threads into a threaded insert provided in the base member 402. Alternatively, a screw passes through the bottom of the outer housing and is threaded into one end of the axle 434. The spool 426 is installed onto the axle 434, and the knob 404 is attached to the axle 434 by a second threaded fastener. In either case, the base member 402 and knob 404 are interconnected by the axle 434, which provides an axis of rotation for the spool 426.

Additionally, the spool 426 may contain a bushing, bearing, or other form of friction reducing device along its central axis to allow it to easily revolve around the axle 434. The axle 434 can additionally carry a washer 430 disposed between the reel and the washer or bushing 426 disposed in the base member 402 to further reduce rotational friction of the spool 426. This type of rotatable connection maintains the spool 426 at the center of the base member 402 and thereby inhibits friction caused by the outer periphery of the spool 426 contacting the inner periphery of the base member 402, while still allowing the spool 426 to freely spin within the base member 402. Accordingly, without any interference from other components, the rotatable connection of the spool 426 allows it to freely rotate in either direction.

Figure 36:
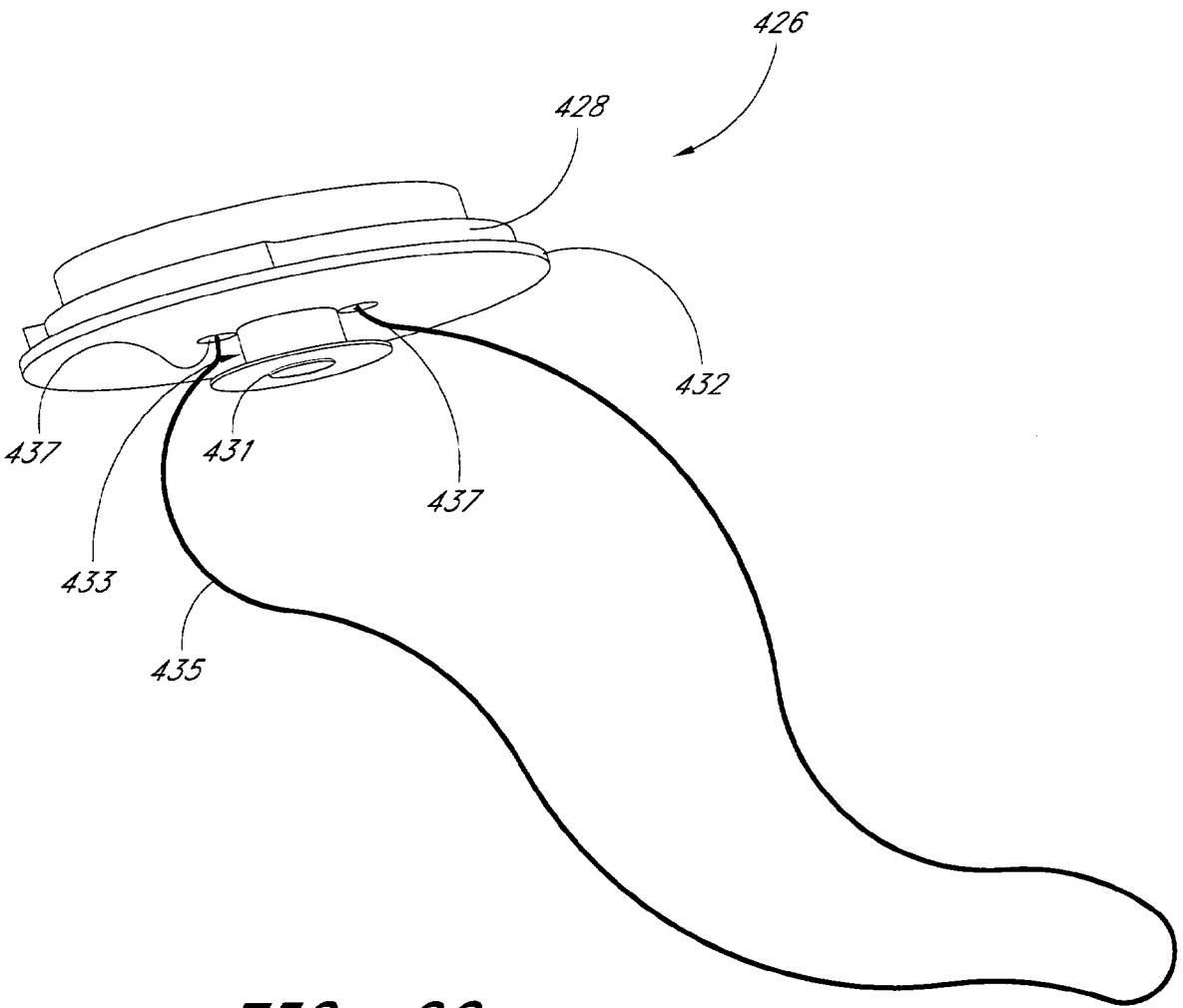
FIG. 36 is a bottom perspective view of a spool with attached lace.

With reference to FIG. 36, the spool 426 is additionally configured with one or more sloped teeth 428 disposed generally above the spool base 432. The spool teeth 428 are preferably configured to allow relative counterclockwise rotation, while inhibiting relative clockwise rotation of a corresponding pawl.

As discussed above, it is preferable that the laces are attached to the spool 426 at substantially diametrically opposed locations to provide a simultaneous and equivalent tension to each lace as a winding force is imparted to the spool 426. Moreover, the preferred lace attachment configuration applies balanced forces to the spool 426 to protect the spool 426 from transverse bending forces that could cause the journal connection to prematurely wear. For example, if the laces engaged the spool 426 from directions forming a ninety degree angle, the forces imparted by the tension in the wound laces would apply a shear force to the axle 434 of the spool 426. If, however, the laces were diametrically attached to the spool 426, the resultant force on the spool 426 from the equivalent opposing tension forces would be zero, thus protecting the spool 426 and its journaled connection from wear resulting from transverse forces.

The spool 426 further comprises one or more annular grooves, as described above, configured to receive the wound up lace. The groove is preferably configured to contain the full length of the lace while minimizing any tendency for the lace to become loose within the housing 400 and potentially becoming jammed, or interfering with additional components contained within the outer housing 400. In some preferred embodiments, two annular grooves separated by an annular ridge are provided to segregate each end of the lace to reduce the likelihood of jamming or binding the mechanism. The lace grooves are preferably located below the spool teeth 428 and spool base, but could optionally be located above the spool teeth 428.

Figure 37B:
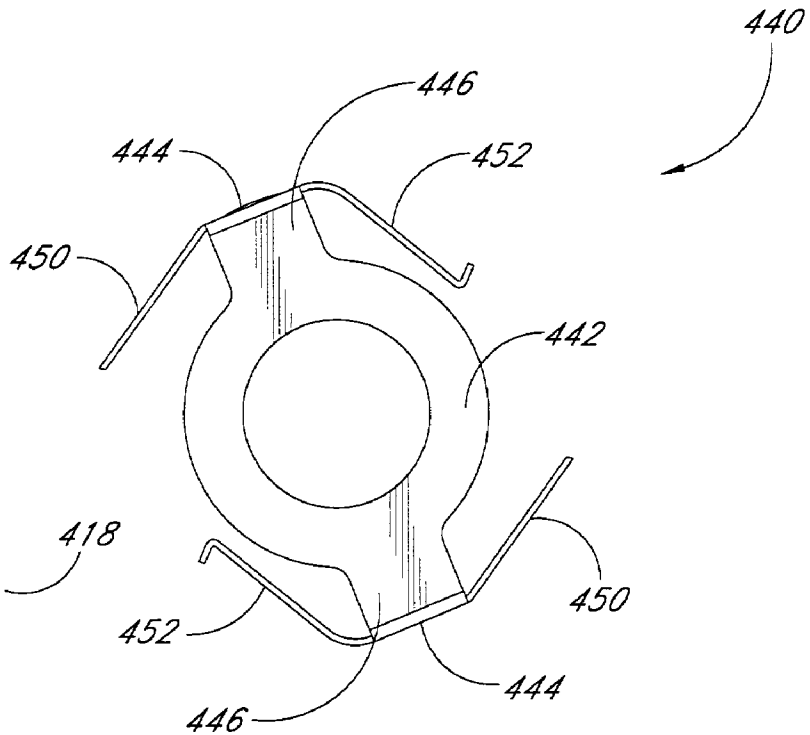
FIG. 37*b* is a top plan view of the pawl spring of FIG. 36*a*.
Figure 37A:
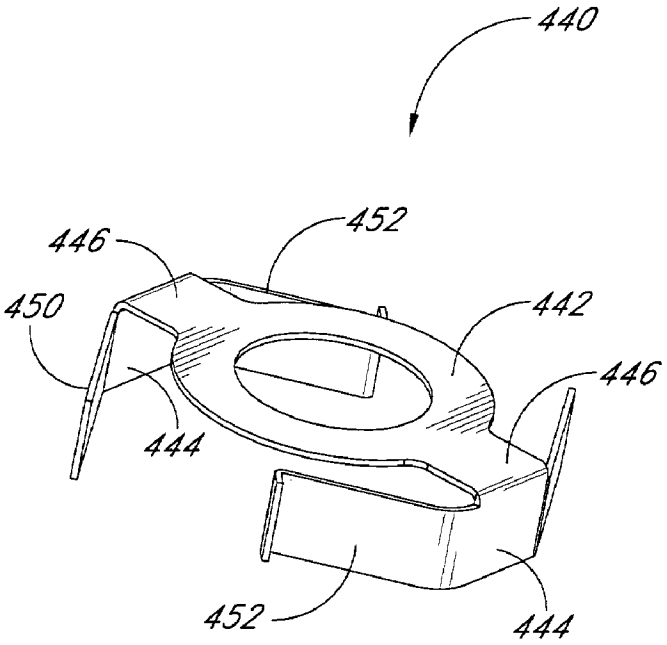
FIG. 37*a* is a perspective view of a pawl spring for use with the reel embodiments of FIGS. 33 and 34.

As illustrated in FIGS. 37*a* and 37*b*, a pawl spring 440 comprises a central horizontally flat circular section 442 attached to two diametrical arm sections 444. In the illustrated embodiment, each arm section 444 is attached to the circular section 442 by a corresponding bridge 446, and may be attached in any suitable manner, such as by welding, or may be formed integrally therewith. The arm sections 444 are generally disposed below the central flat circular section 442 and are flat in a vertical plane.

Extending in a counterclockwise direction from each arm section is an outer pawl 450. Each outer pawl 450 is configured to terminate outside the periphery of the spool base 432, as described later below, and is configured to contact the base member sloped teeth 416. Therefore, when turning one direction, the outer pawls 450 are free to rotate relative to the base member 402, while the base member 402 sloped teeth inhibit relative movement in the opposite direction.

Extending in a clockwise direction from each arm section is a spool pawl 452. The spool pawl 452 is configured to terminate within the periphery of the spool base 432, as described later, and is configured to contact the sloped teeth 428 of the spool 426. Therefore, while turning one direction, the spool pawls 452 interfere with the sloped teeth 428 of the spool 426, and cause the spool 426 to turn concurrently with the pawl spring 442. However, if the spool pawls 452 are removed from contact with the spool sloped teeth 428, the spool 426 is free to rotate. Of course, it should be understood that the illustrated components could be reversed such that the tightening and loosening directions are opposite from those described. However, for clarity, the reel will primarily be discussed by utilizing a design in which a clockwise rotation tightens the lace, while a counterclockwise rotation allows the lace to unwind.

In one preferred embodiment, the pawl spring 442, arms sections 444, and pawls 450, 452 are formed unitarily from a high temper sheet metal. The entire spring 442 may be stamped out of a single sheet of high temper sheet metal, such as, for example, spring steel or stainless steel, and then the arm sections 444 can be plastically bent to be orthogonal to the original plane of the flat material. Additionally, the spool pawls 452 and outer pawls 450 can be permanently bent relative to the arm sections 444. This may be done either prior or subsequent to the arm sections receiving a bend.

The residual stresses formed in the spring 440 may optionally be compensated for such as by heat working to allow the relieve the residual stresses caused by plastic deformation. In other embodiments, the residual stresses are beneficial as they add to the resiliency of the spring 440. For example, the spool pawl 452 is configured to be biased inwardly; however, the residual stresses created by bending the spool pawl 452 with respect to the arm section 444 will tend to force the spool pawl 452 outward. To compensate for this stress, which could ultimately cause the spool pawl 452 to lose its desired bias, the spool pawl 452 may be bent to a more acute angle than necessary and then bent back to its desired angle. By bending the spool pawl 452 beyond the desired angle and then plastically returning it to its desired angle, the residual stresses now naturally bias the spool pawl 452 in an inward direction.

Those of ordinary skill in the art will readily realize that several types of springs and/or spring-loaded devices will provide an equivalent structure and equivalent function to that of the disclosed pawl spring 440. However, the applicants believe the disclosed method is a suitably quick and efficient construction.

Returning to FIGS. 33-35, a knob 404 is configured to fit over and close the open end of the base member 402 and generally circumscribe the outer periphery thereof. The knob 404 can be securely attached to the spool 426 or axle by a screw, as described above. In this way, the outer housing 400 is complete with the base member 402 and the knob 404 both securely attached to the spool 426. Of course, the knob 404 may be attached through alternative structure. For example, the knob 404 and base member 402 can have a cooperating annular ridge and annular groove designed to provide a secure connection therebetween. In this type of connection, the annular ridge can be configured on either the knob 404 or the base member 402, with the corresponding annular groove being formed on the other component. Furthermore, to provide additional support to the spool 426, the knob 404 can contain an integral axle configured to extend down into the spool 426 for providing a rotational connection. The knob 404 may be subsequently removed by prying the knob 404 from the lower unit, with the required force determined by the specific configuration of the cooperating annular groove and ridge. In either disclosed embodiment, the spool 426 is journaled for rotational movement within the outer housing 400.

Figure 38:
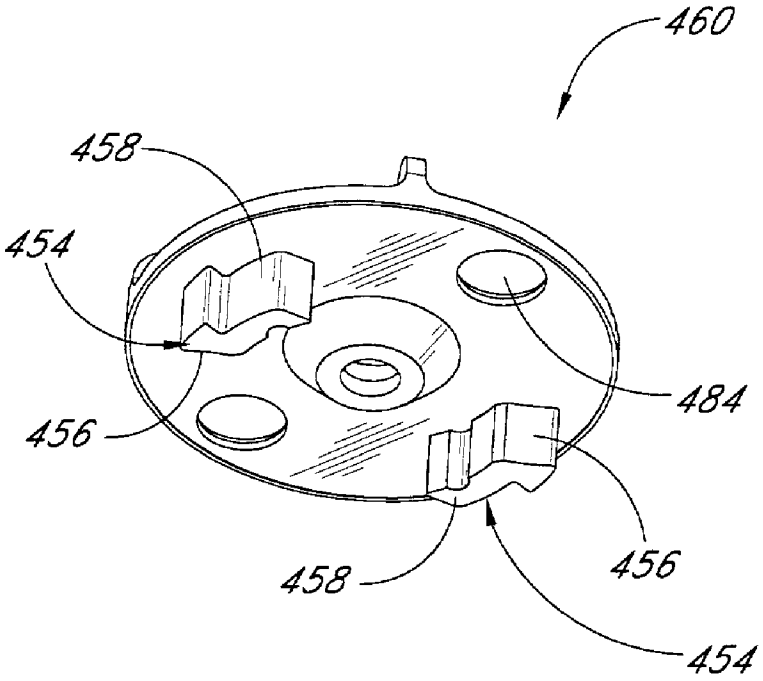
FIG. 38 is a perspective bottom view of a knob insert of the reel of FIG. 33.
Figure 39:
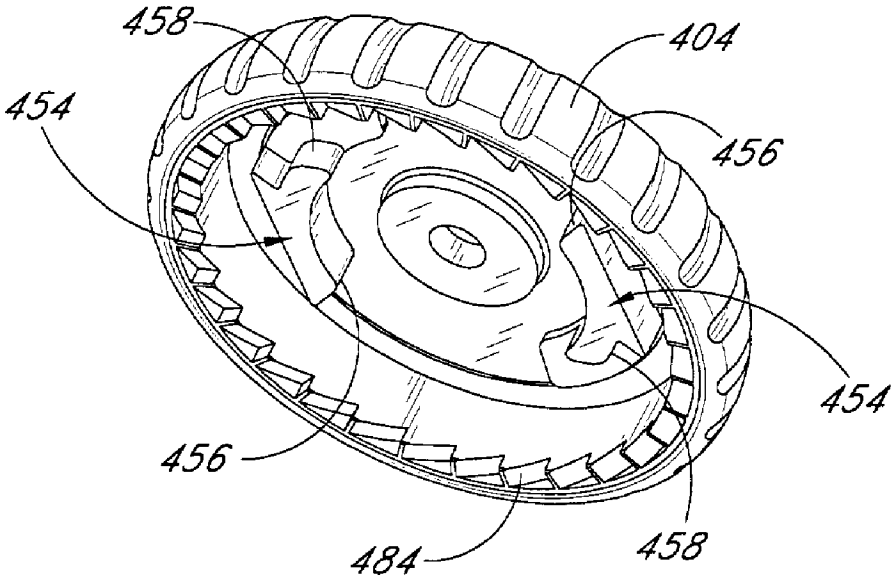
FIG. 39 is a perspective bottom view of the knob of the reel of FIG. 34.

The pawl spring 440 is constrained to rotate with the knob 404 in at least one direction, such as a winding direction, which is some embodiments is clockwise. This may be accomplished in any of a number of ways, one of which is by forming protrusions on the underside of the knob 404 that contact the pawl spring 440 as the knob 404 is rotated, thereby imparting a rotational force to the pawl spring 440. With reference to FIGS. 38 and 39, a portion of the underside of the knob 404 has a pair of protrusions 454 extending therefrom. Each protrusion 454 contains an interfering surface 456 that contacts the bridge 446 of the pawl spring 440 and causes it to rotate concurrently therewith. Additionally, each protrusion contains a ramp 458, as will be discussed in greater detail below.

An alternative structure that allows the knob 404 to impart a rotational force to the pawl spring 440 comprises a recess formed into the underside of the knob 404 that corresponds generally with the shape of the pawl spring 440 such that when the outer housing 400 and its internal components are assembled, the pawl spring 440 center section 442 and bridge sections 446 securely reside within the recess in the underside of the knob 404. Of course, the pawl spring 440 may be constrained for concurrent rotation in one or both directions with the knob 404 by any suitable method, such as alternative interfering structure, adhesives, clips, snaps, mechanical bonding, chemical bonding, heat bonding, or any such suitable interaction.

Figure 40:
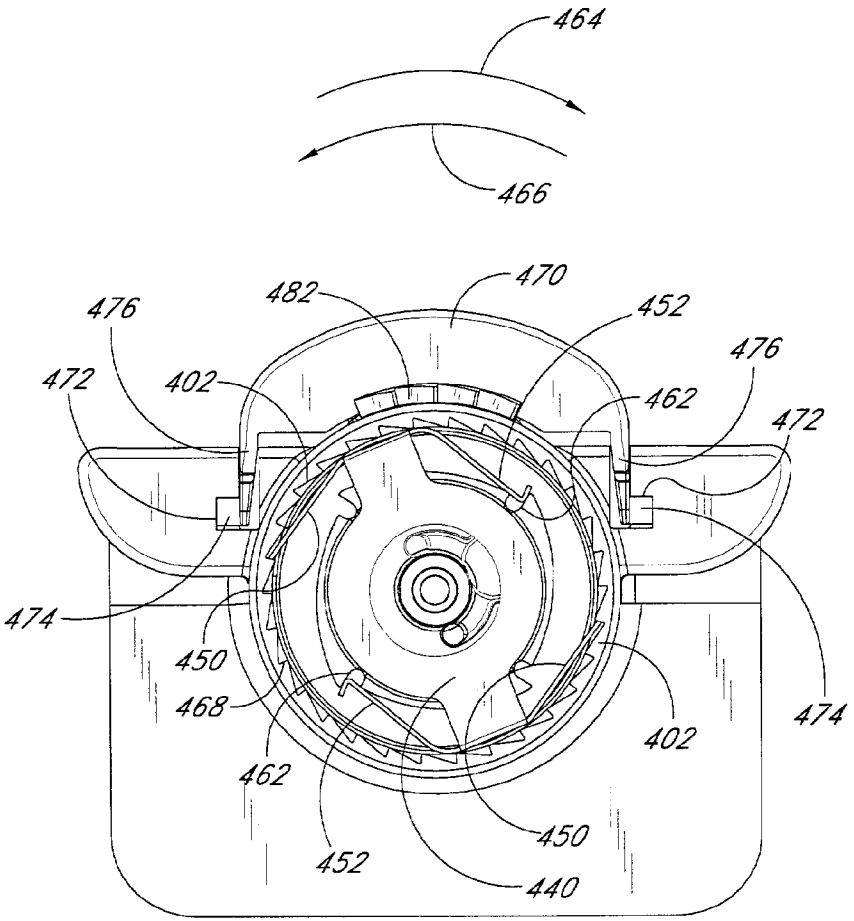
FIG. 40 is a top plan view of the reel of FIGS. 33 and 34 with the knob removed to display the interior components.

Referring to FIG. 40, the interaction and operation of the components is illustrated. As the knob 404 and concomitant spring 440 are rotated in a clockwise direction, the outer pawls 450 slide past the base member 402 sloped teeth. Simultaneously, the spool pawls 452 contact and interfere with the spool teeth 428, also referred to herein as ratchet teeth, thereby imparting a rotating force to the spool 426. Thus, as the knob 404 turns clockwise, the spool 426 also turns clockwise, thereby winding the lace about the spool 426.

Moreover, as the outer pawls 450 slide past the base member teeth 416 and are repeatedly deflected by the high slope of the teeth 416 and resiliently spring outwardly to contact the low slope of the teeth 416, an audible and tactile feedback is provided to the user to indicate incremental winding and tightening of the lace about the spool 426.

The spacing of the base member 402 sloped teeth controls the precision of incremental adjustment. For example, if only two or three base member teeth 416 are present, the knob 404 must be wound either one half or one third revolutions, respectively, to reach the next increment. Otherwise, the tension in the lace will cause the spool 426 to unwind until the outer pawls 450 contact the base member 402 teeth. Accordingly, while the number and spacing of the base member teeth 416 is not critical to practice the invention, those of ordinary skill will realize that an appropriate number of base member teeth 416 should be provided to provide acceptable adjustment increments, such as, for example, 20 to 40 or more teeth.

As the lace becomes wound about the spool 426, its tension increases and thereby imparts a rotation force to the spool 426 in an unwinding direction. This unwinding force is counteracted by the interference between the spool pawls 452 and the spool teeth 428 in combination with the interference between the outer pawls 450 and base member 402 teeth.

For example, during initial turning of the knob 404 and pawl spring 440 in a clockwise direction, the spool pawls 452 resiliently fall down the slope of the spool teeth 428 and contact the substantially radial tooth face 462 of the adjacent tooth. Further rotation of the knob 404 and pawl spring 440 in a winding direction 464 imparts a torque, or winding force, to the spool 426 which rotates and thereby winds the lace about the spool 426. When the winding force is removed, any tension in the lace will impart a torque in an unwinding direction 466, or unwinding force, to the spool 426 and cause it to rotate in a counterclockwise direction. Consequently, as the spool 426 attempts to turn in a counterclockwise direction, the interaction between the radial tooth face 462 and the spool pawl 452 cause the pawl spring 440 to rotate counterclockwise with the spool 426. As such, the outer pawls 450 contact the substantially radial face 468 of the base member 402 teeth and thereby prevent further unwinding of the spool 426.

In order to effectuate unwinding of the spool 426, it must become free of the spool pawls 452. In the illustrated embodiment, this is accomplished by rotating the knob 404 and pawl spring 440 in a counterclockwise direction through predetermined angular displacement, which in one embodiment, is about one quarter turn. As the knob 404 and pawl spring 440 are rotated counterclockwise, structure on the knob 404 will contact the spool pawls 452 which deflect outwardly in response thereto, thus freeing the spool 426 for rotation.

More specifically, one or more ramps 456 (FIGS. 38 and 39) are formed on the underside of the knob 404. The ramps 456 are configured such that counterclockwise rotation of the knob 404 causes the ramps 456 to contact the spool pawls 452, which slide up the ramps 456 and thereby deflect outwardly away from the spool teeth 428. Once the spool pawls 452 extend up the ramp a sufficient distance, the spool pawls 452 are clear of the spool teeth 428. Accordingly, the spool pawls 452 will be deflected a sufficient distance to become free from the spool 426, thereby allowing the spool 426 to freewheel spin in response to the unwinding force applied by the tensioned lace. In this embodiment, the knob 404 must be held in its releasing position until the spool 426 unwinds, otherwise, the spool pawl 452 will resiliently return to its unbiased position and interfere with continued unwinding of the spool 426.

Of course, other suitable methods and structure could be used to effectuate unwinding of the spool 426. For example, a push button (not shown) located on top of the knob 404 could be coupled to the spool pawls 452 in such as way that depression of the push button forces the spool pawls 452 resiliently outward, thus allowing free rotation of the spool 426. Other structure causing the spool pawls 452 to deflect outwardly will be readily apparent to those of skill in the art in light of the present disclosure.

Accordingly, in the described embodiments, as the illustrated spool pawl 452 deflects outwardly, its interfering contact with the spool 426 is released, which is then free to rotate. As such, the spool 426 unwinds in response to the unwinding force imparted by the lace tension, thereby loosing the tension in the lace and releasing the closing force of the footwear about the wearer's foot. The lace is preferably maintained within the reel such that it cannot escape once loosened.

An important realization is that it may be possible for the knob 404 to become inadvertently twisted during use, such as by impact with another object like another shoe, sporting implement, or the ground, for example, thereby resulting in unintentional or accidental unwinding of the laces. This could have unfortunate results, especially during strenuous physical activity when strict fit and control of the footwear is critical. Accordingly, the reel or knob 404 can be configured with a safety mechanism for preventing unintentional and accidental unwinding.

Figure 41:
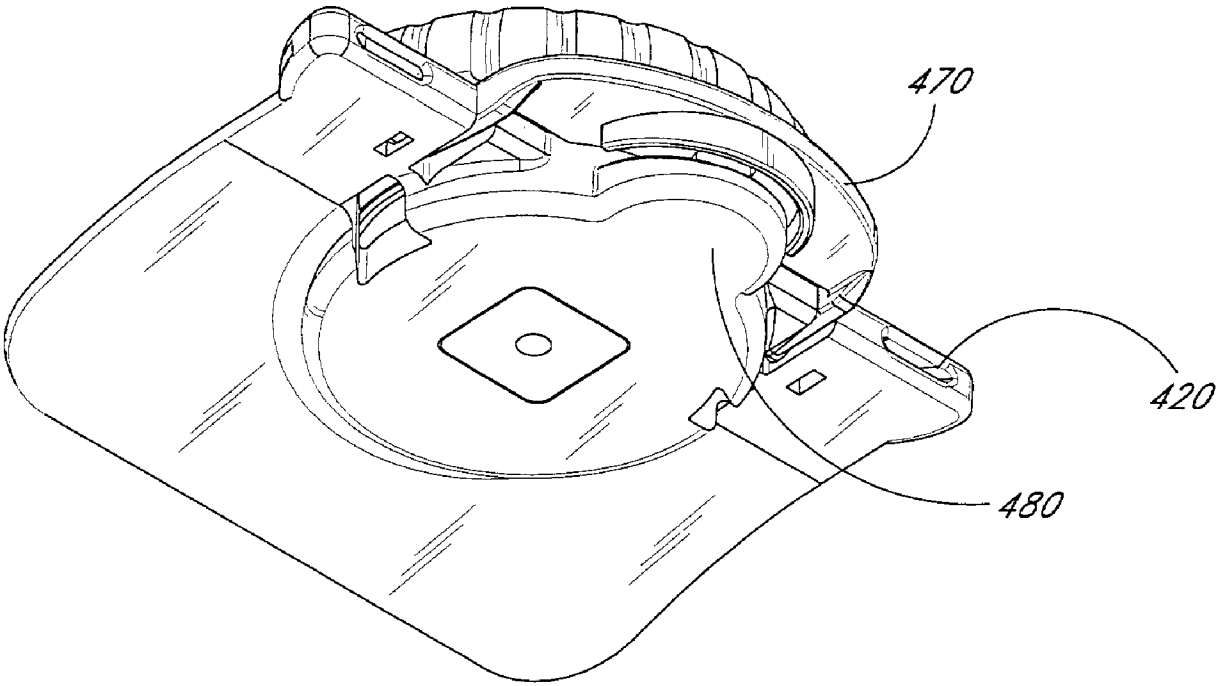
FIG. 41 is a perspective bottom view of the reel of FIG. 34 showing the safety release lever.

In one embodiment, as illustrated in FIGS. 40 and 41, the safety mechanism comprises a lever 470 or button that must be depressed in order to rotate the knob 404 in a counterclockwise direction. The lever is hingedly connected to the base member 402 in any suitable manner. However, in one embodiment, a pair of apertures 472 are provided for receiving a pair of pins 474 extending from connecting arms 476 of the lever 470. Additionally, it is preferable that the lever 470 is biased in an upward direction, and accordingly, a spring can be provided underneath the lever 470 to give the desired bias. As illustrated, the base member 402 includes a lever flange 480 that defines the lever travel limit in a depressed direction and further contains a boss (not shown) for holding a coil spring (not shown) between the lever flange 480 and lever 470. Accordingly, as the lever 470 is depressed, the coil spring becomes compressed, thereby imparting a restoring force to bias the lever in an upward direction.

The lever interacts with the knob 404 to prevent unintentional counterclockwise rotation. In one embodiment, this is accomplished by providing lock teeth 482 on the lever 470 that cooperate with knob teeth 484 (of FIG. 39) to prevent relative rotation of the knob 404. The lever 470 is biased upwardly, thus biasing the lock teeth 482 against the knob teeth 484, which interfere with one another to inhibit counterclockwise rotation of the knob 404 relative to the lever 470. The knob teeth 482 can be strategically spaced around the knob 404 to coincide with the winding increments of the reel. As such, for each winding increment, there is a corresponding locking position that allows the lever teeth 482 to lock the knob 404 at that particular location. However, such a correspondence between the winding increments and the locking increments is not crucial to the present invention.

The lock teeth 482 and knob teeth 484 are preferably configured to allow rotation of the knob 404 in a tightening direction without interference between the respective teeth 482, 484. However, the teeth 482, 484 are configured to inhibit rotation of the knob 404 in a loosening direction by interference between the lock teeth 482 and knob teeth 484. Thus, in order to rotate the knob 404 in a counterclockwise direction and release the spool 426, the lever 470 must be depressed, thereby separating the lock teeth 182 and knob teeth 484. Only then can the knob 404 be rotated counterclockwise to release the spool 426, as described above.

With particular reference to FIG. 38 and additionally to FIG. 35, an alternative embodiment comprises a knob 404 configured with a knob insert, or rotatable actuator 460, that rotates independently of the knob 404. For example, the knob 404 is configured with one or more arc grooves 480 configured to receive the protrusions 454 of the rotatable actuator. The arc grooves 480 and protrusions 454 can cooperate to securely attach the actuator 460 to the knob 404, yet still allow relative rotation therebetween. The actuator 460 is configured with one or more upwardly extending tabs 482 that allow a user to grip and rotate the actuator 460 independently of the knob 404. Moreover, the rotatable actuator 460 carries one or more ramps 456 on its lower surface, as discussed above, that interact with the pawl spring 440 to effectuate a release of the spool pawls 452 from the spool teeth 428, as also described above. One or more alignment holes 484 may be provided through the actuator 460 to allow a user to visually verify the locked or unlocked status of the spool. For example, holes 484 can be located through the actuator 460 and the knob 404 can be configured with a visual indicator, such as one or more colored dots 485. The colored dots 485 are preferably located such that when the actuator 460 is positioned to lock the spool 426 one color is viewable through the holes 484, and when the actuator 460 is positioned to unlock the spool 426 a different color is viewable through the holes 484.

In order to release the spool 426 and unwind the laces, a user simply rotates either the knob 404 or actuator, depending on the particular embodiment, in a counterclockwise direction thus causing the ramps 456 to engage and deflect the spool pawls 452 outwardly, thereby allowing the spool 426 to unwind the tensioned laces. Thus, a safety mechanism is provided that inhibits unintentional and accidental loosing of the reel and lace. Of course, it is to be understood that a counterclockwise rotation is not the only direction of rotation that can release the spool. In some embodiments, a right reel is tightened by rotating the knob in a clockwise direction and the spool is released by rotating the knob in a counterclockwise direction; and a left reel is tightened by rotating the knob in a counterclockwise direction and the spool is released by rotating the knob in a clockwise direction.

Therefore, a right reel and a left reel can be configured for opposite directional rotation to allow a user to more naturally grip and manipulate the reel. It is currently believed that an overhand motion, e.g. a clockwise rotation with a person's right hand, is a more natural motion and can provide a greater torque to tighten the reel. Therefore, by configuring a right and left reel for opposite rotation, each reel is configured to be tightened with an overhand motion by tightening the right reel with the right hand, and tightening the left reel with the left hand.

In several of the above described embodiments, the lace includes two free ends that can be inserted and fixed within the spool 426. One particular advantage of these embodiments is that the lace can be removed and replaced, such as by threading through the guide members and inserted and affixed into the spool 426, as necessary, without having to replace any ancillary components. However, other embodiments provide a closed loop lace which is permanently engaged with the spool 426. In these embodiments, a removable spool and lace unit allows replacement of the spool and lace assembly as a unit. Such a replaceable spool and lace does not require subsequent threading of the lace through the guide members or the outer housing, and further does not require steps to secure the lace within the spool 426, thus making lace replacement a fast and efficient process. However, in order to effectuate such a replacement, a closed loop lace must be able to enter the guide members without having a free end to thread through a tubular guide member.

Figure 42A:
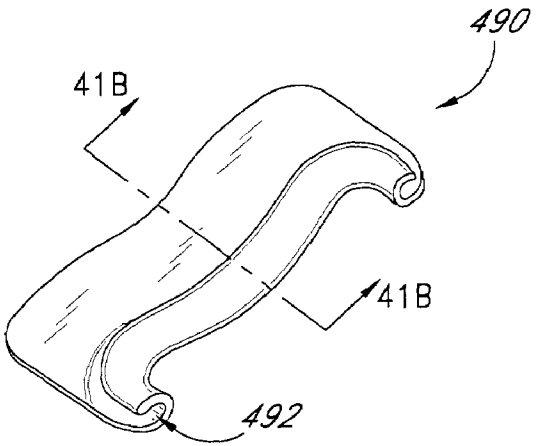
FIG. 42*a* is a perspective view of a guide member for use in accordance with the footwear lacing system of the present invention.
Figure 42B:
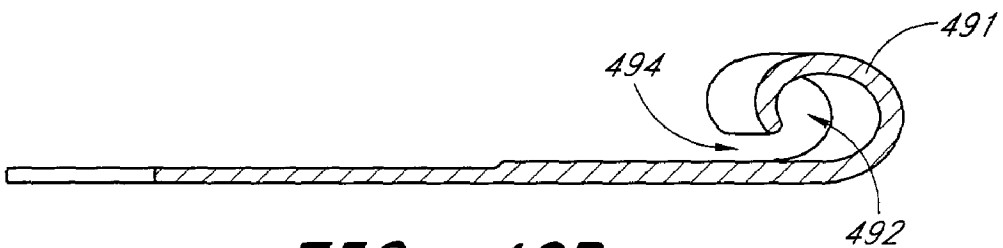
FIG. 42*b* is a cross sectional view of the guide member of FIG. 41*a* taken along line B-B.

To this end, FIGS. 42*a* and 42*b* illustrate one embodiment of a guide member 490 especially suited to accept a closed loop lace. When referring to the term "closed loop lace," it should be interpreted to mean a lace that enters the spool 426 at two or more locations, whether it has two free ends affixed within the spool 426, or is a truly continuous lace having no ends.

In this embodiment of a guide member 490, rather than having a tubular lace guide, the guide members comprise a lace guide 491 defining an open channel 492 having, for example, a semicircular, "C" shaped, or "U" shaped cross section. The guide member 490 is preferably mounted on the boot or shoe such that the channel opening 494 faces away from the midline of the boot, so that a lace under tension will be retained therein. One or more retention strips, stitches or flaps may be provided for "closing" the channel opening 494 to prevent the lace from escaping when tension on the lace is released. The axial length of the channel can be preformed in a generally U configuration. Moreover, practically any axial configuration of the guide member 490 is possible, and is mainly dictated by fashion, and only partly by function.

Figure 44:
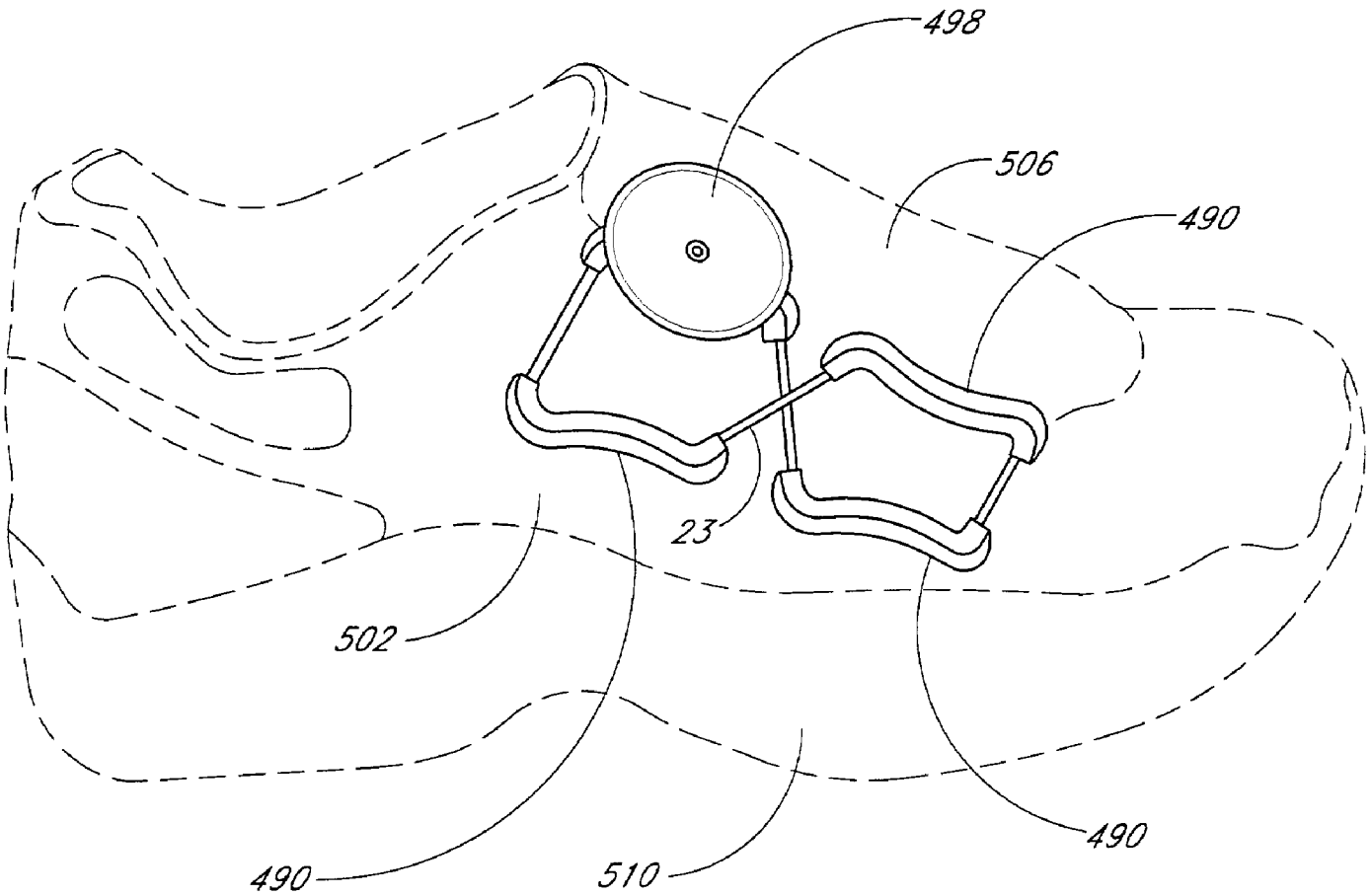
FIG. 44 is a side elevational view of a shoe having another embodiment of the footwear lacing system of the present invention attached thereto.

Several guide members 490 may be molded as a single piece, such as several lace guides 491 molded to a common backing support strip which can be adhered or stitched to the shoe. Thus, a right lace guide member and a left lace guide member can be secured to opposing portions of the top or sides of the shoe to provide a right set of guide channels 492 and a left set of guide channels 492. When referring to "right" and "left" guide members, this should not be construed as suggesting a mounting location of the retainer strips. For example, the guide members 490 can be located on a single side of the shoe, such as in a shoe having a vamp that extends generally from one side of the shoe, across the midline of the foot, and is secured by laces on the opposing side of the shoe. In this type of shoe, the guide members 490 are actually disposed vertically with respect to one another, and hence, a left and right guide member merely refers to the fact that the guide members 490 have openings that face one another, as illustrated in FIG. 44.

When changing a worn or broken lace, a user simply removes the knob 404, such as by removing an axial mounting screw extending through the knob 404 and into the spool 426. Additionally, a screw extending through the base member 402 and into the spool 426 may also require removal before the spool 426 can be removed. Once the appropriate fasteners are removed, the entire spool 426 with concomitant lace can be removed and a new spool 426 and lace unit can be inserted in place. In order to accommodate this type of closed loop lace, not only must the guide members be open channeled, but the guides of the outer housing 400 must likewise comprise open channels to allow removal and insertion of a closed loop lace.

With returning reference to FIGS. 33 and 34, the base member 402 incorporates lace guides 422 having an open channel. The base member 402 has a generally C-shaped channel into which the lace may be inserted or removed. As described above, the channel 492 may selectively be closed by a flap or other closure device for maintaining the lace within the channel when not under tension. A tension applied to the lace will maintain it within the channel.

As described above, the base member 402 may contain a mounting 406 flange adapted for fastening to a shoe or boot. The mounting flange 406 can be configured with ridges 496 or grooves to offer increased frictional holding between the flange portion and connected material. Moreover, grooves can offer a decreased thickness to facilitate puncture, such as for stitching, yet offer an increased thickness to inhibit pull through of the stitching. Ridges or ribs can function in a similar manner to provide an area of increased thickness to increase the flange resistance to stitching pull through pressures. Of course, the base member 402 can be mounted to the footwear in any suitable manner, such as through adhesives, fasteners, mechanical or chemical bonding, mechanical structure, and the like.

While the function of the embodiments disclosed in relation to FIGS. 33 and 34 is substantially similar, it should be apparent to one of ordinary skill in the art that great artistic license can be taken with the design of the outer housing to appease the whims of the fashion conscious.

Figure 43:
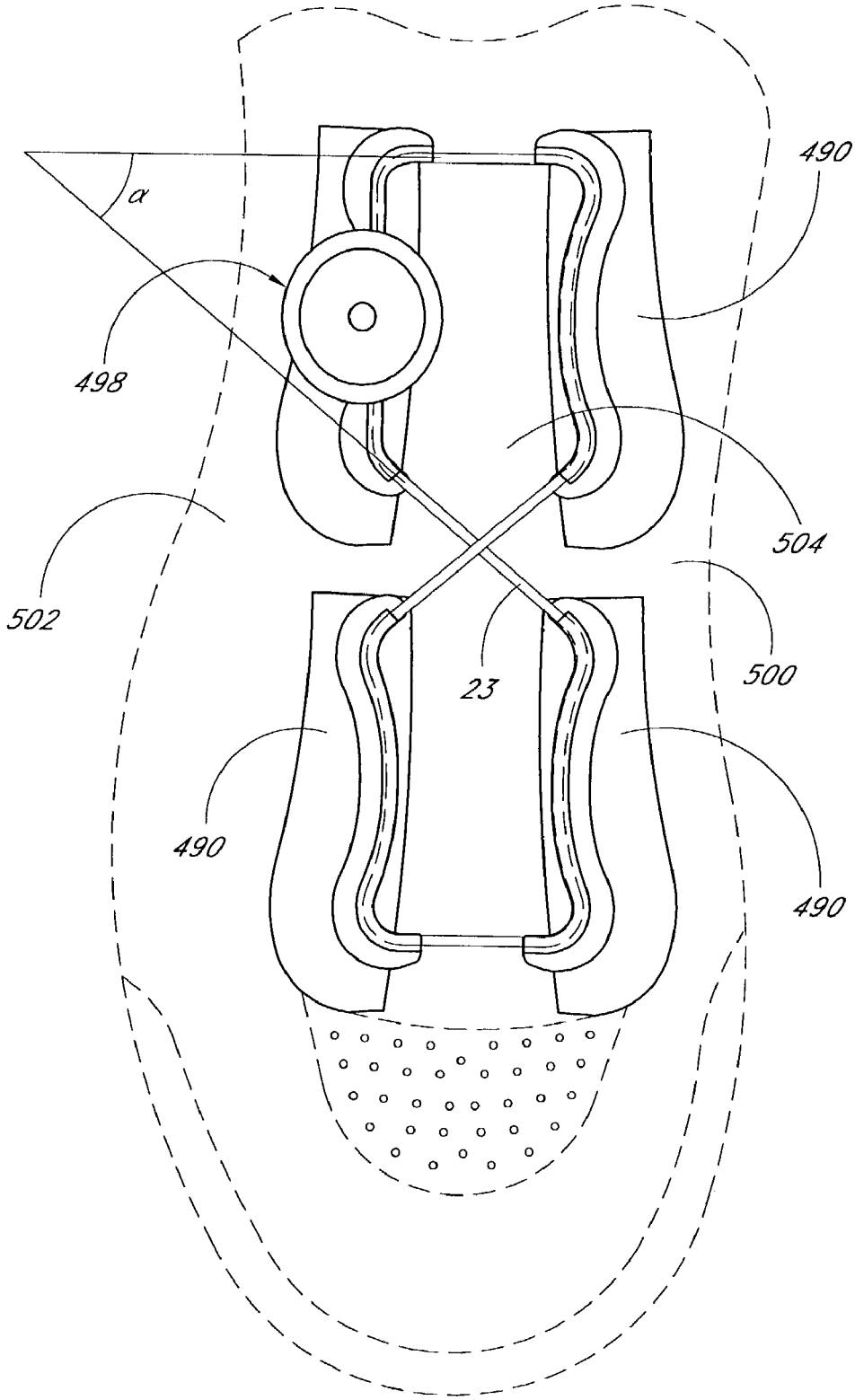
FIG. 43 is a top plan view showing one embodiment of the footwear lacing system of the present invention attached to a shoe that is shown in phantom.

FIGS. 43 and 44 illustrate examplary embodiments and mounting configurations of the present footwear-lacing system. For example, a plurality of guide members 490 can be located in lieu of traditional shoe eyelet strips, as described above. Typically, the guide members 490 are installed as opposing pairs, with the guide members formed integrally with the reel 498 typically comprising one of the guide members. The term "reel" will be used hereinafter to refer to the various embodiments including the complete structure of the outer housing and its internal components, unless otherwise specified. Thus, in some embodiments, there are 2, 4, 6, or 8 or more cooperating guide members 490 installed to define a lace path. Moreover, a non-paired guide member 490 can be installed, such as toward the toe of the shoe and positioned transverse to the midline and having its lace openings directed toward the heel of the shoe. This configuration, in addition to applying tightening forces between the lateral and medial sides of the shoe, would also apply a lace tension force along the midline of the shoe. Of course, other numbers and arrangements of guide members can be provided and this application and its claims should not be limited to only configurations utilizing opposing or even paired guide members.

FIG. 43 shows an embodiment in which the reel 498 is located on the lateral quarter panel of the shoe. Of course, the reel 498 can be located practically anywhere on the shoe and only some of the preferred locations are described herein. Moreover, the illustrated reel can be any reel embodiment suitable for practicing the present invention, and should not be limited to one particular embodiment. The illustrated embodiment provides three guide members 490 spaced along the gap between the medial quarter panel 500 and lateral quarter panels 502 of the shoe and thus creates a lace path that zigzags across the tongue 504 . While the reel 498 is illustrated as being disposed on the lateral quarter 502 panel near the ankle, it may also be disposed on the medial quarter panel 500 of the shoe. In some embodiments, the reel 498 is disposed on the same quarter panel of each shoe, for example, the reel can be mounted on the lateral quarter panel 502 of each shoe, or in alternative embodiments, the reel can be disposed on the lateral quarter panel 502 of one shoe, and on the medial quarter panel 500 of the other shoe.

Notably, this particular embodiment has a lace path that forms an acute angle a as it enters the outer housing. As discussed above, a lace guide member can be integrally formed into the outer housing to direct the lace to approach and interact with the reel from substantially diametrical directions. Thus, the summation of tension forces applied to the reel are substantially cancelled.

FIG. 44 shows an alternative embodiment of a shoe incorporating a vamp closure structure. In this particular embodiment, the reel 498 can be disposed on the vamp 506, as illustrated, or can be disposed on the lateral quarter panel, or even in the heel, as disclosed above. Similar to FIG. 43, the reel illustrated in this FIG. 44 should not be limited to one specific embodiment, but should be understood to be any suitable embodiment of a reel for use with the disclosed invention. In the illustrated embodiment, three lace guides 490 are affixed to the shoe; two on the lateral quarter panel 502, and one on the vamp 506 cooperating with the guide members integrally formed with the reel 498 to define a lace path between the lateral quarter panel 502 and the vamp 506. Those of ordinary skill will appreciate that the guide members can be spaced appropriately to result in various tightening strategies.

For example, the opposing guide members 490 can be spaced a greater distance apart to allow a greater range of tightening. More specifically, by further separating the opposing guide members 490, there is a greater distance that can be used to effectuate tightening before the guide members 490 bottom out. This embodiment offers the additional advantage of extending the lace 23 over a substantially planar portion of the shoe, rather than across a portion of the shoe having a convex curvature thereto.

Figure 45:
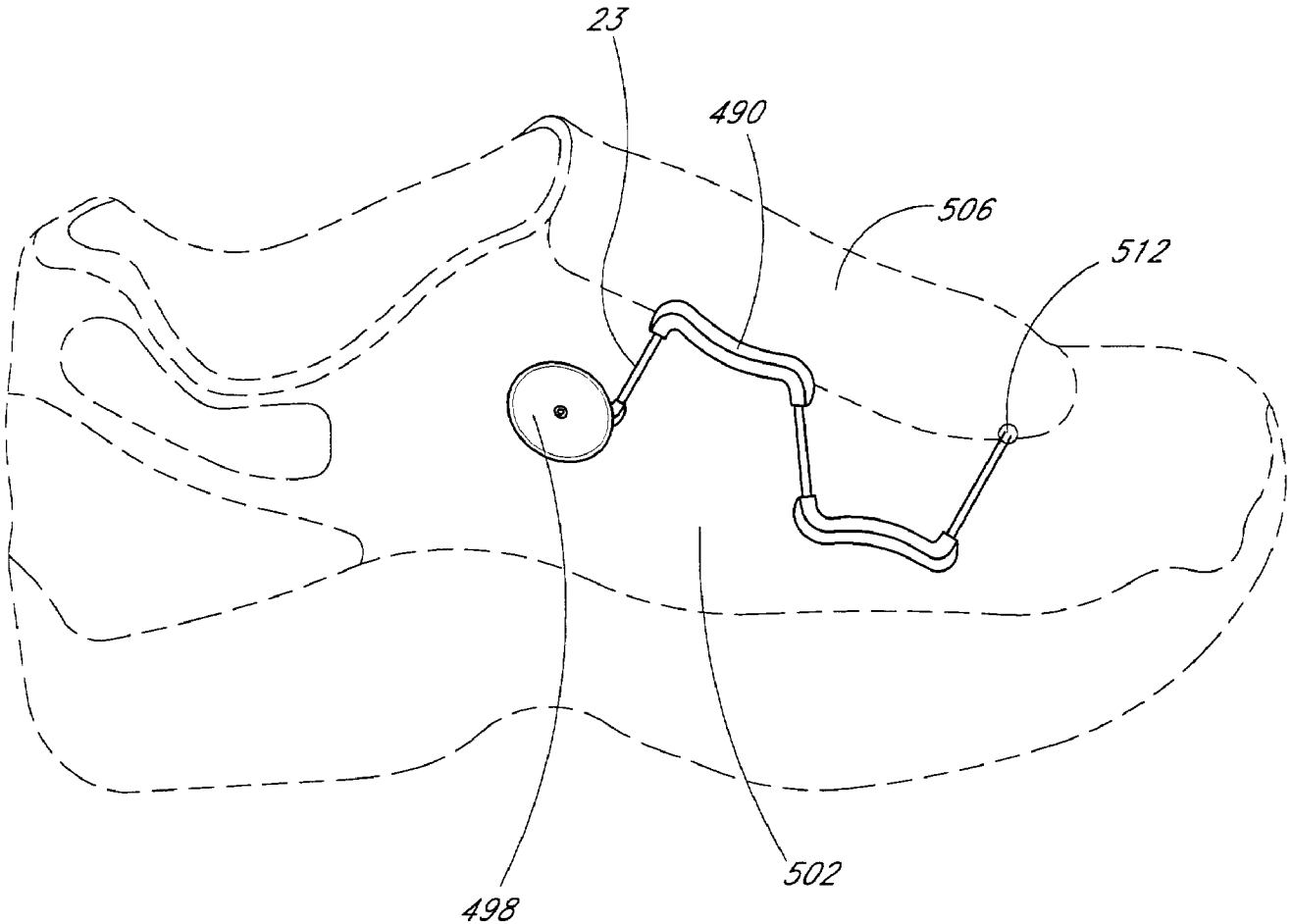
FIG. 45 is a side elevational view of a shoe having yet another embodiment of the footwear lacing system of the present invention attached thereto.

FIG. 45 illustrates an alternative arrangement of a shoe incorporating a vamp closing structure and having a reel and a non-looping lace. In this particular embodiment, an open ended lace can be attached directly to a portion of the shoe. As illustrated, a reel 498 is mounted on the lateral quarter panel 502 of the shoe. The shoe has one or more lace guides 490 strategically positioned thereon. As illustrated, one lace guide 490 is mounted on the vamp 506 while a second lace guide 498 is mounted on the lateral quarter panel 502. A lace has one end connected to a spool within the reel 498 and extends from the reel 498, through the lace guides 490 and is attached directly to the shoe by any suitable connection 512. One suitable location for attaching the lace is on the vamp toward the toe for those embodiments in which the reel 498 is mounted on the lateral quarter panel 502.

The connection 512 may be a permanent connection or may be releasable to allow the lace to be removed and replaced as necessary. The connection is preferably a suitable releasable mechanical connection, such as a clip, clamp, or screw, for example. Other types of mechanical connections, adhesive bonding, or chemical bonding may also be used to attach a lace end to the shoe.

While the illustrated embodiment shows the reel 498 attached to the lateral quarter panel 502, it should be apparent that the reel 498 could readily be attached to the vamp 506 and still provide the beneficial features disclosed herein. Additionally, the lace could optionally be attached to the shoe on the lateral quarter panel 502 rather than the vamp 506. The reel 498 and lace could be attached to a common portion of the shoe, or may be attached to different portions of the shoe, as illustrated. In any case, as the lace is tightened around the spool, the lace tension draws the guide members toward each other and tightens the footwear around a wearer's foot.

A shoe is typically curved across the midline to accommodate the dorsal anatomy of a human foot. Therefore, in an embodiment in which the laces zigzag across the midline of the shoe, the further the lace guides 490 are spaced, the closer the laces 23 are to the sole 510 of the shoe. Consequently, as the laces 23 tighten, a straight line between the lace guides 490 is obstructed by the midline of the shoe, which can result in a substantial pressure to the tongue of the shoe and further result in discomfort to the wearer and increased chaffing and wearing of the tongue. Therefore, by locating the laces 23 across a substantially flat surface on either the lateral or medial portion of the shoe, as illustrated, the laces 23 can be increasingly tightened without imparting pressure to other portions of the shoe.

It is contemplated that some embodiments of the lacing system 22 discussed herein will be incorporated into athletic footwear and other sports gear that is prone to impact. Such examples include bicycle shoes, ski or snowboard boots, and protective athletic equipment, among others. Accordingly, it is preferable to protect the reel from inadvertent releasing of the spool and lace by impact with external objects.

Figure 46:
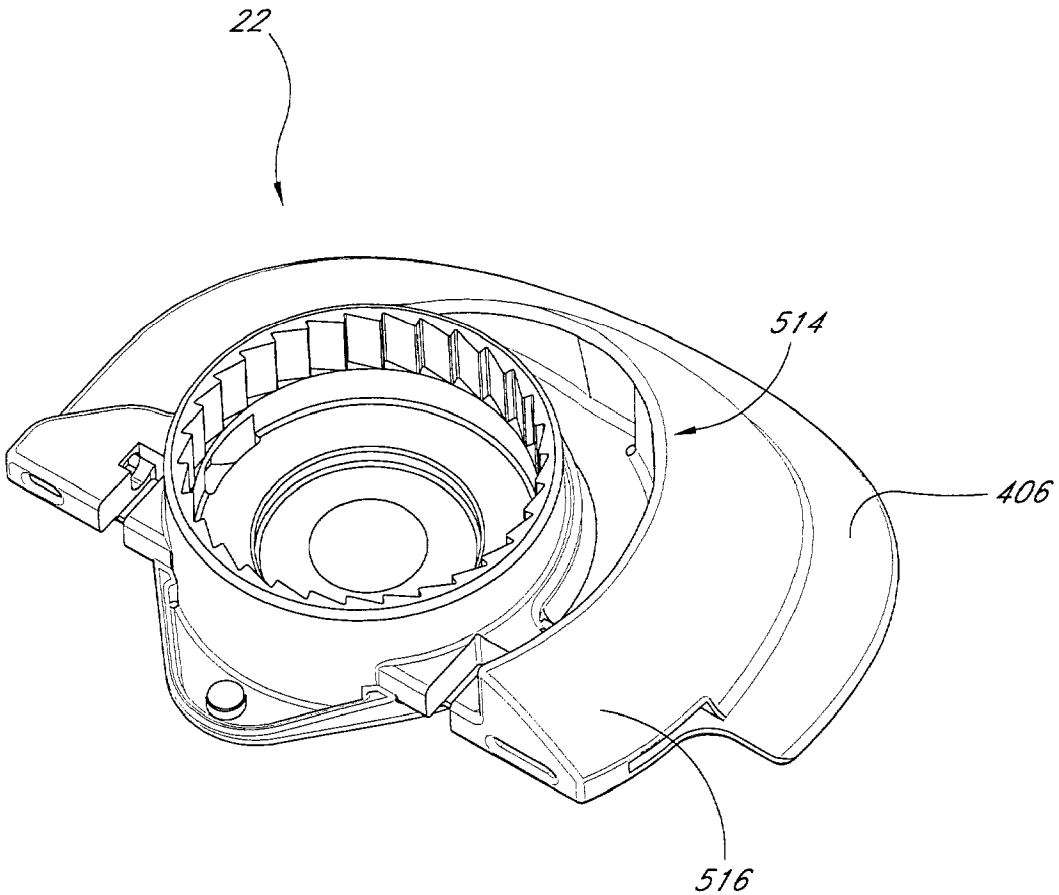
FIG. 46 is a perspective view of an embodiment of a lacing system having a protective element.
Figure 47:
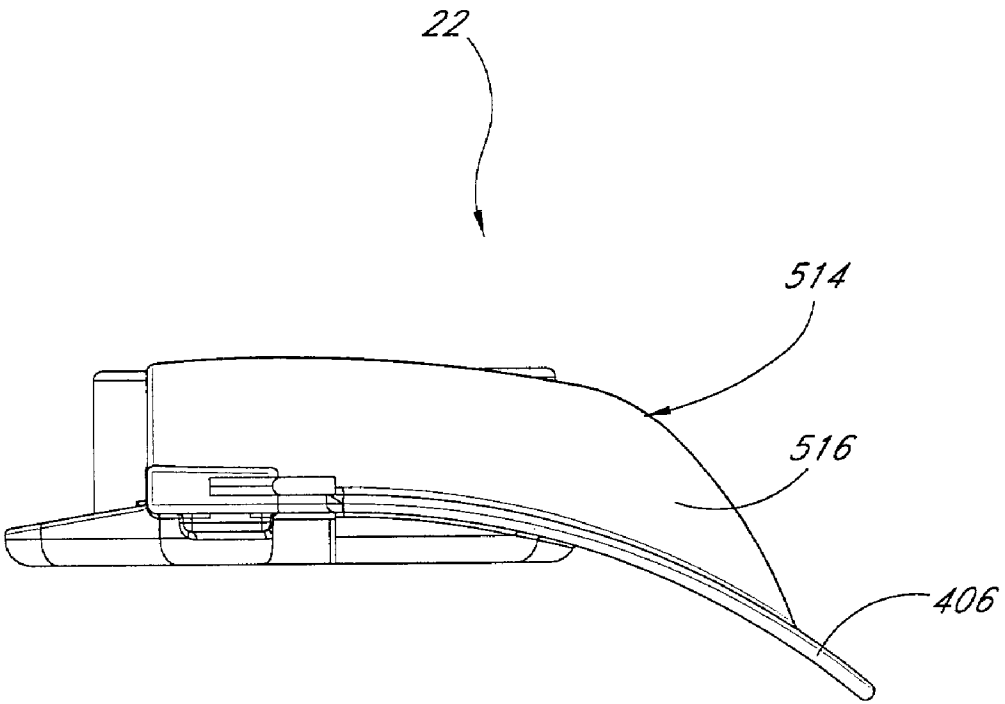
FIG. 47 is a side elevational view of the lacing system of FIG. 46 showing the protective element.

FIGS. 46 and 47 illustrate a lacing system 22 further having a protective element to protect the reel from impact from external objects. In one embodiment, the protective element is a shield 514 comprised of one or more raised ridges 516 or ramps configured to extend away from the mounting flange 406 a distance sufficiently high to protect the otherwise exposed reel. In the illustrated embodiment, the shield 514 is configured to slope toward the reel thus presenting an oblique surface to any objects it may contact to deflect the objects away from the reel. The shield 514 is positioned around the reel circumferentially and slopes radially toward the reel and may encircle the reel, or may be positioned around half the reel, a quarter of the reel, or any suitable portion or portions of the reel.

The shield 514 may be integrally formed with the mounting flange 406, such as during molding, or may be formed as a separate piece and subsequently attached to the lacing system 22 such as by adhesives or other suitable bonding techniques. It is preferable that the shield 514 is formed of a material exhibiting a sufficient hardness to withstand repeated impacts without plastically deforming or showing undue signs of wear.

Figure 48:
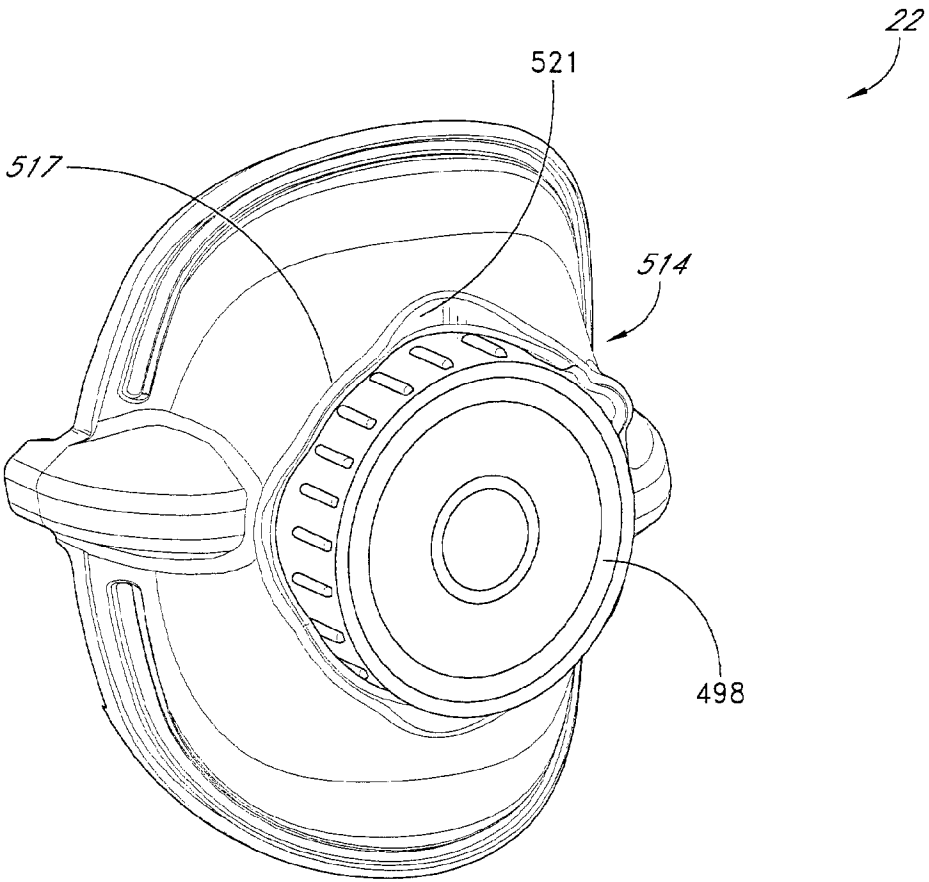
FIG. 48 illustrates a perspective view of an embodiment of a lacing system having an alternative protective element.
Figure 42B:
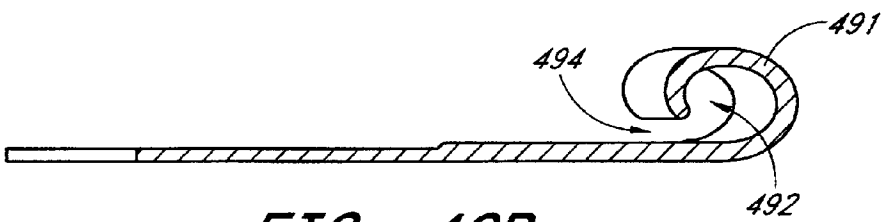

Another embodiment of a protective element is shown in FIG. 48. In this embodiment, a shield 514 is in the form of a raised lip 517 that encircles a portion of the circumference of the knob (not shown). The lip 517 can be of sufficient height to exceed the top of the knob, or can extend to just below the height of the knob to allow a user to still grasp the knob above the lip 517, or the lip 517 can be formed with varying heights. The lip 517 is preferably designed to withstand impact from various objects to thereby protect the knob from being inadvertently rotated and/or displaced axially.

The lip 517 can be integrally molded with the mounting flange, or can be a separate piece. In addition, the lip 517 can take on various shapes and dimensions to satisfy aesthetic tastes while still providing the protective function it has been designed for. For example, it can be formed with various draft angles, heights, bottom fillets, of varying materials and the like. In the illustrated embodiment, the lip 517 extends substantially around the entire circumference of the knob 498, except at holds 521 where the lip 517 recedes sufficiently to allow a user to grasp a large portion of the knob's height to be able to displace the knob axially by lifting it away from the housing. The illustrated embodiment additionally shows that the lip 517 extends outward to protect a substantial portion of the knob's height. While the lip 517 is illustrated as extending around a particular portion of the knob's circumference, it can of course extend around more or less of the knob's circumference. Certain preferred embodiments integrate a continuous shield 514 extending around between a quarter and a half of the knob circumference, while other embodiments incorporate a shield 514 comprising one or more discrete portions that combine to cover any appropriate range about the circumference of the knob. Of course, other protective elements or shields 514 could be incorporated to protect the reel, such as a protective covering or cap to cover the reel, a cage structure that fits over the reel, and the like.

As discussed above, the lace 23 is preferably a highly lubricious cable or fiber having a low modulus of elasticity and a high tensile strength. While any suitable lace may be used, certain preferred embodiments utilize a lace formed from extended chain, high modulus polyethylene fibers. One example of a suitable lace material is sold under the trade name SPECTRA™, manufactured by Honeywell of Morris Township, N.J. The extended chain, high modulus polyethylene fibers advantageously have a high strength to weight ratio, are cut resistant, and have very low elasticity. One preferred lace made of this material is tightly woven. The tight weave provides added stiffness to the completed lace. The additional stiffness provided by the weave offers enhanced pushability, such that the lace is easily threaded through the lace guides, and into the reel and spool.

The lace made of high modulus polyethylene fibers is additionally preferred for its strength to diameter ratio. A small lace diameter allows for a small reel. In some embodiments, the lace has a diameter within the range of from about 0.010" to about 0.050", or preferably from about 0.020" to about 0.030", and in one embodiment, has a diameter of 0.025". Of course, other types of laces, including those formed of textile, polymeric, or metallic materials, may be suitable for use with the present footwear lacing system as will be appreciated by those of skill in the art in light of the disclosure herein.

Another preferred lace is formed of a high modulus polyethylene fiber, nylon or other synthetic material and has a rectangular cross-section. This cross-sectional shape can be formed by weaving the lace material as a flat ribbon, a tube, or other suitable configuration. In any case the lace will substantially flatten and present a larger surface area than a cable or other similar lace and will thereby reduce wear and abrasion against the lace guides and other footwear hardware. In addition, there is a sufficient amount of cross-sectional material to provide an adequate tension strength, while still allowing the lace to maintain a sufficiently thin profile to be efficiently wound around a spool. The thin profile of the lace advantageously allows the spool to remain small while still providing the capacity to receive a sufficient length of lace. Of course, the laces disclosed herein are only exemplary of any of a wide number of different types and configurations of laces that are suitable to be used with the lacing system described herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A footwear lacing system, comprising:

a footwear member including first and second opposing sides configured to fit around a foot;

a plurality of lace guide members positioned on the first and second opposing sides;

a lace guided by the guide members, the lace linked to a spool that is rotatable in a winding direction and an unwinding direction;

a tightening mechanism attached to the footwear member and coupled to the spool, the tightening mechanism including a control for winding the lace around the spool to place tension on the lace thereby pulling the opposing sides towards each other; and a safety device selectively moveable between a first secure position in which the spool is inhibited from rotating in an unwinding direction, and a second releasing position in which the spool is free to rotate in an unwinding direction;

wherein the control comprises a rotatable knob for winding the lace around the spool, and the safety device is moved to its second releasing position by manipulating the knob.

2. A footwear lacing system as in claim 1, wherein the lace is slideably positioned around the guide members to provide a dynamic fit in response to movement of the foot within the footwear.

3. A footwear lacing system as in claim 1, wherein the guide members have a substantially C-shaped cross section.

4. A footwear lacing system as in claim 1, further comprising a second safety device that selectively allows the knob to rotate in an unwinding direction.

5. A footwear lacing system as in claim 1, wherein the safety device is a rotatable release that allows selective unwinding of the spool.

6. A footwear lacing system as in claim 5, wherein the rotatable release is independent of the control.

7. A footwear lacing system as in claim 1, wherein the first opposing side is a vamp configured to extend from one side of the shoe, across the upper midline of the shoe, and to the opposing side of the shoe.

8. A footwear lacing system as in claim 7, wherein the reel is mounted to the first opposing side.

9. A footwear lacing system as in claim 1, wherein the lace is formed of a polymeric fiber.

10. A footwear lacing system as in claim 1, wherein the safety device is adapted to be moved to its second releasing position by rotating the knob in an unwinding direction.

11. A footwear lacing system as in claim 1, wherein the safety device is adapted to be moved to its second releasing position by pulling the knob away from the footwear member into a pulled out position.

12. A footwear lacing system as in claim 11, wherein the knob locks in the pulled out position.

13. A footwear lacing system as in claim 1, wherein the lace is removably linked to the spool.

14. A footwear lacing system as in claim 1, wherein the lace is fixed to the spool.

15. A footwear lacing system as in claim 1, wherein the lace is connected to the spool at a point spaced apart from the ends of the lace.

16. A footwear lacing system as in claim 1, wherein the lace extends through a bore through the spool.

17. A footwear lacing system as in claim 1, wherein the lace is removably connected to the spool such that the lace may be removed from the footwear lacing system without removing the spool.

18. A footwear lacing system as in claim 1, wherein the lace has a diameter within the range of from about 0.020" to about 0.040".

19. A footwear lacing system as in claim 18, wherein the lace has a diameter within the range of from about 0.025" to about 0.035".

20. A footwear lacing system as in claim 18, wherein the lace comprises rounded ends.

21. A footwear lacing system as in claim 1, wherein the lace is slideably positioned around the guide members to provide a dynamic fit in response to movement of the foot within the footwear.

22. A footwear lacing system as in claim 21, further comprising at least one expansion limiting band thereon, which resides in an expansion limiting plane.

23. A footwear lacing system as in claim 22, wherein the expansion limiting band is positioned on the footwear such that it surrounds the wearer's ankle.

24. A footwear lacing system as in claim 23, wherein the expansion limiting plane extends substantially horizontally through the footwear.

25. A footwear lacing system as in claim 1, wherein the lace is formed of multiple strands.

26. A footwear lacing system as in claim 23, wherein the strands are swaged.

27. A footwear lacing system as in claim 1, wherein the lace is formed of metal.

28. A footwear lacing system as in claim 27, wherein the metal is stainless steel.

29. A footwear lacing system as in claim 27, wherein the lace further comprises an outer coating of a lubricous material.

30. A footwear lacing system as in claim 29, wherein the outer coating comprises nylon.

31. A footwear lacing system as in claim 29, wherein the outer coating comprises polytetrafluoroethylene.

32. A closure system for footwear having an upper, the upper having a first portion and a second portion, the closure system comprising:

a tightening reel on the footwear for retracting a lace, thereby advancing the first portion of the upper towards the second portion of the upper to tighten the footwear; and a knob coupled to the tightening reel, the knob being moveable from an engaged position to a disengaged position by pulling the knob away from the upper;

wherein, with the knob in the engaged position, the knob is configured to cause the reel to rotate in a forward direction, and, with the knob in the disengaged position, the reel is rotatable in a reverse direction, and wherein the knob locks in the disengaged position.

33. A closure system as in claim 32, wherein the knob is locked in the disengaged position by a detent.

34. A closure system as in claim 32, further comprising a closed loop lace, wherein the lace is permanently mounted in the reel.

35. A closure system as in claim 32, wherein the lace is removably secured to the reel.

36. A closure system as in claim 32, wherein, with the knob in the engaged position, the reel is rotatable in only the forward direction.

37. A closure system as in claim 32, wherein the knob is mounted on a rear portion of the upper.

38. A closure system as in claim 32, wherein the knob is mounted on a tongue of the footwear.

39. A closure system for footwear having an upper, the upper having a first portion and a second portion, the closure system comprising:

a tightening reel on the footwear for retracting a lace, thereby advancing the first portion of the upper towards the second portion of the upper to tighten the footwear; and a knob coupled to the tightening reel, the knob being moveable between an engaged position and a disengaged position;

wherein, with the knob in the engaged position, the knob is configured to cause the reel to rotate, and, with the knob in the disengaged position, rotation of the knob does not effect rotation of the reel, and wherein the knob is configured to lock in the disengaged position.

40. A closure system as in claim 39, wherein the knob is locked in the disengaged position by a detent.

41. A closure system as in claim 39, further comprising guide members wherein the lace is slideably positioned around the guide members to provide a dynamic fit in response to movement of the foot within the footwear.

42. A closure system as in claim 41, further comprising at least one expansion limiting band thereon, which resides in an expansion limiting plane.

43. A closure system as in claim 42, wherein the expansion limiting band is positioned on the footwear such that it surrounds the wearer's ankle.

44. A closure system as in claim 43, wherein the expansion limiting plane extends substantially horizontally through the footwear.

45. A closure system as in claim 39, further comprising guide members wherein the guide members have a substantially C-shaped cross section.

46. A closure system as in claim 39, wherein the first portion is a vamp configured to extend from one side of the shoe, across the upper midline of the shoe, and to the opposing side of the shoe.

47. A closure system as in claim 46, wherein the reel is mounted to the first portion.

48. A closure system as in claim 39, wherein the lace is formed of a polymeric fiber.

49. A footwear lacing system as in claim 39, wherein the lace is removably linked to the spool.

50. A closure system as in claim 39, wherein the lace is fixed to the spool.

51. A closure system as in claim 39, wherein the lace is connected to the spool at a point spaced apart from the ends of the lace.

52. A closure system as in claim 39, wherein the lace extends through a bore through the spool.

53. A closure system as in claim 39, further comprising a spool wherein the lace is removably connected to the spool such that the lace may be removed from the system without removing the spool.

54. A closure system as in claim 39, wherein the lace has a diameter within the range of from about 0.020" to about 0.040".

55. A closure system as in claim 54, wherein the lace has a diameter within the range of from about 0.025" to about 0.035".

56. A closure system as in claim 54, wherein the lace comprises rounded ends.

57. A closure system as in claim 39, wherein the lace is formed of multiple strands.

58. A closure system as in claim 57, wherein the strands are swaged.

59. A closure system as in claim 39, wherein the lace is formed of metal.

60. A closure system as in claim 59, wherein the metal is stainless steel.

61. A closure system as in claim 59, wherein the lace further comprises an outer coating of a lubricous material.

62. A closure system as in claim 61, wherein the outer coating comprises nylon.

63. A closure system as in claim 61, wherein the outer coating comprises polytetrafluoroethylene.

64. A closure system for drawing first and second sides of an article of footwear towards each other to tighten the footwear around a foot, comprising:

a rotatable spool for receiving a lace, the spool rotatable in a first direction to tension and take up lace and a second direction to release tension on the lace; and a knob movable between a position causing coupling between the knob and the spool and by pulling the knob away from the spool to a position causing the knob and spool to be uncoupled, such that in the coupling position the spool can be rotated in the first direction in response to rotation of the knob, wherein rotation of the spool in the second direction is prevented when the knob is in the coupled position and wherein the knob is configured to be held in the uncoupled position to permit the spool to rotate in the second direction in response to tension on the lace.

65. A closure system as claimed in claim 64, further comprising a radially movable detent washer slideably movable between a recess for the uncoupled position of the knob and a recess for the coupled position of the knob.

66. A closure system as claimed in claim 64, wherein the knob is held in the uncoupled position by friction.

67. A closure system as claimed in claim 64, wherein the knob is only rotatable in the first direction

68. A closure system as claimed in claim 64, wherein the spool is not rotatable in the second direction in response to rotation of the knob.

69. A closure system as claimed in claim 64, further comprising a housing and wherein the knob is slideable with respect to the housing and comprises a series of pawls integrally-mounted to the knob that engage a corresponding series of ratchets on the housing.

70. A closure system as claimed in claim 69, wherein the pawls are permanently engaged with the ratchets.

71. A closure system as claimed in claim 69, further comprising a gear mechanism located in the housing and mechanically coupled to the spool.

72. Footwear incorporating a closure system as claimed in claim 64.

73. Footwear as claimed in claim 72, wherein the closure system is located on the footwear so that the knob can be pulled away from the footwear to uncouple the knob and spool.

74. Footwear as claimed in claim 72, in the form of boots suitable for snow boarding.

75. Footwear as claimed in claim 72, in the form of sports shoes.

76. Footwear as claimed in claim 72, wherein the closure system is mounted on the tongue of the footwear.

77. Footwear as claimed in claim 72, further comprising a plurality of lace guide members positioned on the first and second sides of the footwear.

78. Footwear as claimed in claim 77, wherein the lace guides members have a longitudinal portion and the longitudinal portion is not the same length for all the lace guide members.

79. Footwear as claimed in claim 78, wherein at least one guide defines a circular profile.

80. Footwear as claimed in claim 78, wherein at least one guide defines an elliptical profile.

81. Footwear as claimed in claim 72, wherein the lace is formed of a polymeric material.

82. Footwear as claimed in claim 72, wherein the lace is formed of metal.

83. Footwear as claimed in claim 72, wherein the lace is removably connected to the spool.

84. Footwear as claimed in claim 72, wherein the lace is slideably positioned around the guide members to provide a dynamic fit in response to movement of the foot within the footwear.

85. Footwear as claimed in claim 72, further comprising at least one expansion limiting band thereon, which resides in an expansion limiting plane.

86. Footwear as claimed in claim 85, wherein the expansion limiting plane extends substantially horizontally through the footwear.

87. Footwear as claimed in claim 85, wherein the expansion limiting band is positioned on the footwear such that it surrounds the wearer's ankle.

88. A closure system as claimed in claim 64, wherein the knob is coaxial with the spool.

89. A closure system as claimed in claim 64, further comprising a protective element configured to protect at least a portion of the knob.

90. A closure system as claimed in claim 89, wherein at least a portion of the protective element extends around at least half of the knob.

91. A closure system as claimed in claim 89, wherein at least a portion of the protective element extends around at least a quarter of the knob.

92. A closure system as claimed in claim 89, wherein at least a portion of the protective element extends above the knob.

93. A closure system as claimed in claim 89, wherein the protective element extends substantially around the entire circumference of the knob.

94. A closure system as claimed in claim 64, wherein the lace is removeably coupled to the spool.

95. A closure system as claimed in claim 64, wherein the lace further includes rounded ends.

96. A closure system as claimed in claim 64, configured to allow one or more regions of different tension on the lace.

97. A closure system as claimed in claim 96, further comprising one or more locking members.

98. A closure system as claimed in claim 64, wherein the lace is fixed to the spool.

99. A closure system as claimed in claim 64, wherein the lace is connected to the spool at a point spaced apart from the ends of the lace.

100. A closure system as claimed in claim 64, wherein the lace extends through a bore through the spool.

101. A closure system as claimed in claim 64, further comprising a spring configured to automatically wind lace slack around the reel.

102. A footwear lacing system, comprising:

a footwear member including first and second opposing sides configured to fit around a foot;

a plurality of lace guide members positioned on the first and second opposing sides;

a lace guided by the guide members, the lace linked to a spool that is rotatable in a winding direction and an unwinding direction;

a tightening mechanism attached to the footwear member and coupled to the spool, the tightening mechanism including a control for winding the lace around the spool to place tension on the lace thereby pulling the opposing sides towards each other; and a safety device selectively moveable between a first secure position in which the spool is inhibited from rotating in an unwinding direction, and a second releasing position in which the spool is free to rotate in an unwinding direction;

wherein the safety device is a rotatable release that allows selective unwinding of the spool, wherein the control comprises a rotatable knob for winding the lace around the spool and the safety device is moved to its second releasing position by rotating the knob in an unwinding direction.

103. A footwear lacing system as in claim 102, wherein the lace is slideably positioned around the guide members to provide a dynamic fit in response to movement of the foot within the footwear.

104. A footwear lacing system as in claim 103, further comprising at least one expansion limiting band thereon, which resides in an expansion limiting plane.

105. A footwear lacing system as in claim 104, wherein the expansion limiting band is positioned on the footwear such that it surrounds the wearer's ankle.

106. A footwear lacing system as in claim 105, wherein the expansion limiting plane extends substantially horizontally through the footwear.

107. A footwear lacing system as in claim 102, wherein the guide members have a substantially C-shaped cross section.

108. A footwear lacing system as in claim 102, wherein the first opposing side is a vamp configured to extend from one side of the shoe, across the upper midline of the shoe, and to the opposing side of the shoe.

109. A footwear lacing system as in claim 108, wherein the reel is mounted to the first opposing side.

110. A footwear lacing system as in claim 102, wherein the lace is formed of a polymeric fiber.

111. A footwear lacing system as in claim 102, wherein the lace is removably linked to the spool.

112. A footwear lacing system as in claim 102, wherein the lace is fixed to the spool.

113. A footwear lacing system as in claim 102, wherein the lace is connected to the spool at a point spaced apart from the ends of the lace.

114. A footwear lacing system as in claim 102, wherein the lace extends through a bore through the spool.

115. A footwear lacing system as in claim 102, wherein the lace is removably connected to the spool such that the lace may be removed from the footwear lacing system without removing the spool.

116. A footwear lacing system as in claim 102, wherein the lace has a diameter within the range of from about 0.020" to about 0.040".

117. A footwear lacing system as in claim 116, wherein the lace has a diameter within the range of from about 0.025" to about 0.03 5".

118. A footwear lacing system as in claim 116, wherein the lace comprises rounded ends.

119. A footwear lacing system as in claim 102, wherein the lace is formed of multiple strands.

120. A footwear lacing system as in claim 119, wherein the strands are swaged.

121. A footwear lacing system as in claim 102, wherein the lace is formed of metal.

122. A footwear lacing system as in claim 121, wherein the metal is stainless steel.

123. A footwear lacing system as in claim 122, wherein the lace further comprises an outer coating of a lubricous material.

124. A footwear lacing system as in claim 123, wherein the outer coating comprises nylon.

125. A footwear lacing system as in claim 123, wherein the outer coating comprises polytetrafluoroethylene.

126. A footwear lacing system, comprising:

a footwear member including first and second opposing sides configured to fit around a foot;

a plurality of lace guide members positioned on the first and second opposing sides;

a lace guided by the guide members, the lace linked to a spool that is rotatable in a winding direction and an unwinding direction;

a tightening mechanism attached to the footwear member and coupled to the spool, the tightening mechanism including a control for winding the lace around the spool to place tension on the lace thereby pulling the opposing sides towards each other; and a safety device selectively moveable between a first secure position in which the spool is inhibited from rotating in an unwinding direction, and a second releasing position in which the spool is free to rotate in an unwinding direction;

wherein the safety device is a rotatable release that allows selective unwinding of the spool, further comprising a second safety device that selectively allows the knob to rotate in an unwinding direction.

127. A footwear lacing system as in claim 126, wherein the lace is slideably positioned around the guide members to provide a dynamic fit in response to movement of the foot within the footwear.

128. A footwear lacing system as in claim 127, further comprising at least one expansion limiting band thereon, which resides in an expansion limiting plane.

129. A footwear lacing system as in claim 128, wherein the expansion limiting band is positioned on the footwear such that it surrounds the wearer's ankle.

130. A footwear lacing system as in claim 129, wherein the expansion limiting plane extends substantially horizontally through the footwear.

131. A footwear lacing system as in claim 126, wherein the guide members have a substantially C-shaped cross section.

132. A footwear lacing system as in claim 126, wherein the first opposing side is a vamp configured to extend from one side of the shoe, across the upper midline of the shoe, and to the opposing side of the shoe.

133. A footwear lacing system as in claim 132, wherein the reel is mounted to the first opposing side.

134. A footwear lacing system as in claim 126, wherein the lace is formed of a polymeric fiber.

135. A footwear lacing system as in claim 126, wherein the lace is removably linked to the spool.

136. A footwear lacing system as in claim 126, wherein the lace is fixed to the spool.

137. A footwear lacing system as in claim 126, wherein the lace is connected to the spool at a point spaced apart from the ends of the lace.

138. A footwear lacing system as in claim 126, wherein the lace extends through a bore through the spool.

139. A footwear lacing system as in claim 126, wherein the lace is removably connected to the spool such that the lace may be removed from the footwear lacing system without removing the spool.

140. A footwear lacing system as in claim 126, wherein the lace has a diameter within the range of from about 0.020" to about 0.040".

141. A footwear lacing system as in claim 140, wherein the lace has a diameter within the range of from about 0.025" to about 0.03 5".

142. A footwear lacing system as in claim 140, wherein the lace comprises rounded ends.

143. A footwear lacing system as in claim 126, wherein the lace is formed of multiple strands.

144. A footwear lacing system as in claim 143, wherein the strands are swaged.

145. A footwear lacing system as in claim 126, wherein the lace is formed of metal.

146. A footwear lacing system as in claim 145, wherein the metal is stainless steel.

147. A footwear lacing system as in claim 146, wherein the lace further comprises an outer coating of a lubricous material.

148. A footwear lacing system as in claim 147, wherein the outer coating comprises nylon.

149. A footwear lacing system as in claim 147, wherein the outer coating comprises polytetrafluoroethylene.

150. A closure system for drawing first and second sides of an article of footwear towards each other to tighten the footwear around a foot, comprising:

a rotatable spool for receiving a lace, the spool rotatable in a first direction to tension and take up lace and a second direction to release tension on the lace; and a knob movable between a position causing coupling between the knob and the spool and by pulling the knob away from the spool to a position causing the knob and spool to be uncoupled, such that in the coupling position the spool can be rotated in the first direction in response to rotation of the knob, wherein rotation of the spool in the second direction is prevented when the knob is in the coupled position and wherein the knob is only rotatable in the first direction.

151. A closure system as claimed in claim 150, further comprising a protective element configured to protect at least a portion of the knob.

152. A closure system as claimed in claim 150, wherein the lace is removeably coupled to the spool.

153. A closure system as claimed in claim 150, configured to allow one or more regions of different tension on the lace.

154. A closure system as claimed in claim 150, further comprising a spring configured to automatically wind lace slack around the reel.

155. Footwear incorporating a closure system as claimed in claim 150.

156. Footwear as claimed in claims 155, further comprising a plurality of lace guide members positioned on the first and second sides of the footwear.

157. Footwear as claimed in claim 156, wherein the lace guides members have a longitudinal portion and the longitudinal portion is not the same length for all the lace guide members.

158. Footwear as claimed in claim 157, wherein at least one guide defines an elliptical profile.

159. Footwear as claimed in claim 155, wherein the lace is removably connected to the spool.

160. A closure system for drawing first and second sides of an article of footwear towards each other to tighten the footwear around a foot, comprising:

a rotatable spool for receiving a lace, the spool rotatable in a first direction to tension and take up lace and a second direction to release tension on the lace;

a knob movable between a position causing coupling between the knob and the spool and by pulling the knob away from the spool to a position causing the knob and spool to be uncoupled, such that in the coupling position the spool can be rotated in the first direction in response to rotation of the knob, wherein rotation of the spool in the second direction is prevented when the knob is in the coupled position; and a housing wherein the knob is slideable with respect to the housing and comprises a series of pawls integrally-mounted to the knob that engage a corresponding series of ratchets on the housing.

161. A closure system as claimed in claim 160, wherein the pawls are permanently engaged with the ratchets.

162. A closure system as claimed in claim 160, further comprising a gear mechanism located in the housing and mechanically coupled to the spool.

163. A closure system as claimed in claim 160, further comprising a protective element configured to protect at least a portion of the knob.

164. A closure system as claimed in claim 163, wherein the protective element is integrally formed with the housing.

165. A closure system as claimed in claim 160, wherein the lace is removeably coupled to the spool.

166. A closure system as claimed in claim 160, configured to allow one or more regions of different tension on the lace.

167. A closure system as claimed in claim 160, further comprising a spring configured to automatically wind lace slack around the reel.

168. Footwear incorporating a closure system as claimed in claim 160.

169. Footwear as claimed in claims 168, further comprising a plurality of lace guide members positioned on the first and second sides of the footwear.

170. Footwear as claimed in claim 169, wherein the lace guides members have a longitudinal portion and the longitudinal portion is not the same length for all the lace guide members.

171. Footwear as claimed in claim 170, wherein at least one guide defines an elliptical profile.

172. Footwear as claimed in any of claims 168, wherein the lace is removably connected to the spool.

173. A closure system for drawing first and second sides of an article of footwear towards each other to tighten the footwear around a foot, comprising:

a rotatable spool for receiving a lace, the spool rotatable in a first direction to tension and take up lace and a second direction to release tension on the lace;

a knob movable between a position causing coupling between the knob and the spool and by pulling the knob away from the spool to a position causing the knob and spool to be uncoupled, such that in the coupling position the spool can be rotated in the first direction in response to rotation of the knob, wherein rotation of the spool in the second direction is prevented when the knob is in the coupled position; and a spring configured to automatically wind lace slack around the reel.

174. A closure system as claimed in claim 173, further comprising a protective element configured to protect at least a portion of the knob.

175. A closure system as claimed in claim 173, wherein the lace is removeably coupled to the spool.

176. A closure system as claimed in claim 173, configured to allow one or more regions of different tension on the lace.

177. Footwear incorporating a closure system as claimed in claim 173.

178. Footwear as claimed in claims 177, further comprising a plurality of lace guide members positioned on the first and second sides of the footwear.

179. Footwear as claimed in claim 178, wherein the lace guides members have a longitudinal portion and the longitudinal portion is not the same length for all the lace guide members.

180. Footwear as claimed in claim 179, wherein at least one guide defines a circular profile.

181. Footwear as claimed in claim 177, wherein the lace is removably connected to the spool.

* * * * *

UNITED STATES PATENT AND TRADEMARK OFFICE

CERTIFICATE OF CORRECTION

PATENT NO. : 7,591,050 B2
APPLICATION NO. : 10/459843
DATED : September 22, 2009
INVENTOR(S) : Gary R. Hammerslag It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 277 days.

Signed and Sealed this

Twenty-first Day of September, 2010

David J. Kappos

David J. Kappos
*Director of the United States Patent and Trademark Office*

US007591050C1

(12) EX PARTE REEXAMINATION CERTIFICATE (8955th)

United States Patent
Hammerslag

(10) Number: US 7,591,050 C1
(45) **Certificate Issued: *Apr. 10, 2012**

(54) FOOTWEAR LACING SYSTEM

(75) Inventor: Gary R. Hammerslag, Steamboat Springs, CO (US)

(73) Assignee: Boa Technology, Inc., Steamboat Springs, CO (US)

Reexamination Request:
No. 90/011,028, Jun. 11, 2010

Reexamination Certificate for:

| | |
|---|---|
| Patent No.: | **7,591,050** |
| Issued: | **Sep. 22, 2009** |
| Appl. No.: | **10/459,843** |
| Filed: | **Jun. 12, 2003** |

( * ) Notice: This patent is subject to a terminal disclaimer.

Certificate of Correction issued Sep. 21, 2010.

Related U.S. Application Data

(63) Continuation-in-part of application No. 09/993,296, filed on Nov. 14, 2001, now abandoned, which is a continuation-in-part of application No. 09/956,601, filed on Sep. 18, 2001, now abandoned, which is a continuation of application No. 09/388,756, filed on Sep. 2, 1999, now Pat. No. 6,289,558, which is a continuation-in-part of application No. 09/337,763, filed on Jun. 22, 1999, now Pat. No. 6,202,953, which is a continuation of application No. 08/917,056, filed on Aug. 22, 1997, now Pat. No. 5,934,599.

(51) Int. Cl.
*A43C 11/00* (2006.01)
*A43B 5/16* (2006.01)

(52) U.S. Cl. ..... 24/68 SK; 36/50.5
(58) Field of Classification Search ..... None
See application file for complete search history.

(56) References Cited

To view the complete listing of prior art documents cited during the proceeding for Reexamination Control Number 90/011,028, please refer to the USPTO's public Patent Application Information Retrieval (PAIR) system under the Display References tab.

*Primary Examiner*—Catherine S. Williams

(57) ABSTRACT

Disclosed is a footwear lacing system comprising a lace attached to a tightening mechanism. The lace extends through a series of guide members positioned along two opposing footwear closure portions. The lace and guides preferably have low friction surfaces to facilitate sliding of the lace along the guide members so that the lace evenly distributes tension across the footwear member. The tightening mechanism allows incremental adjustment of the tension of the lace. A release mechanism allows a user to quickly loosen the lace. A safety mechanism inhibits unintentional and/or accidental loosing of the lace.

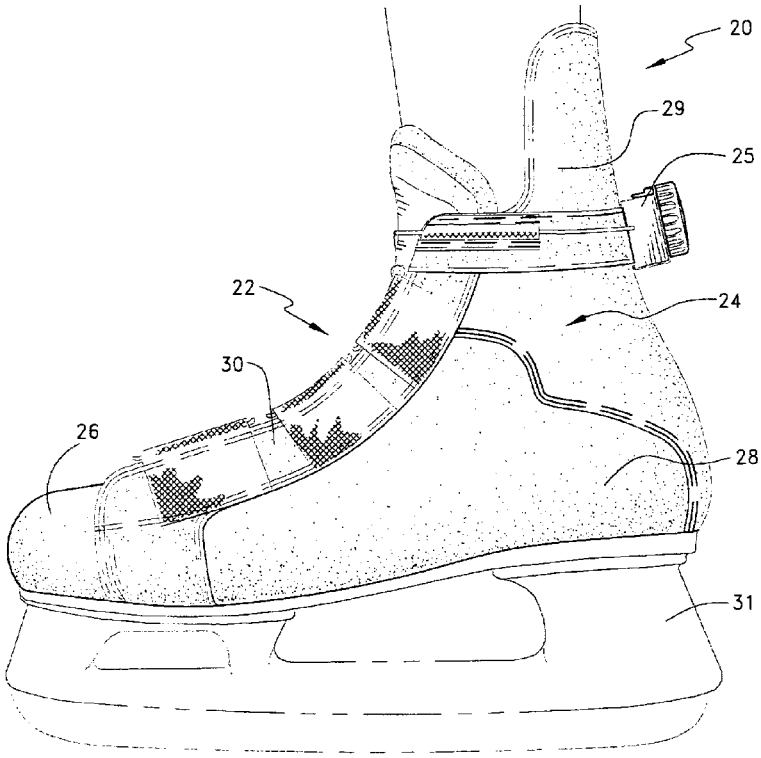

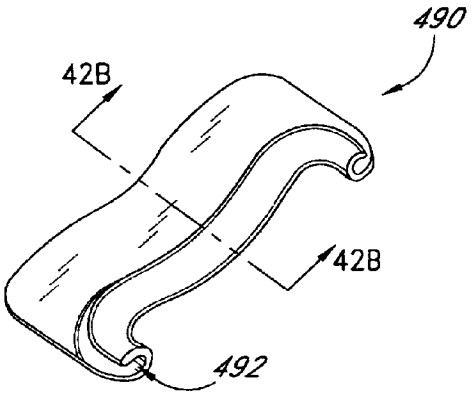
FIG. 42A (Amended)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

THE DRAWING FIGURES HAVE BEEN CHANGED AS FOLLOWS:

In FIG. 42A reference #41 B has been changed to 42B (two locations).

AS A RESULT OF REEXAMINATION, IT HAS BEEN DETERMINED THAT:

Claim 2 is cancelled.

Claims 1, 7-8, 23, 102 and 126 are determined to be patentable as amended.

Claims 4-6, 13-17, 21-22 and 24-25, dependent on an amended claim, are determined to be patentable.

New claims 182-189 are added and determined to be patentable.

Claims 3, 9-12, 18-20, 26-101, 103-125 and 127-181 were not reexamined.

1. A footwear lacing system, comprising:

a footwear member including first and second opposing sides configured to fit around a foot;

a plurality of lace guide members positioned on the first and second opposing sides;

a lace guided by the guide members, the lace linked to a spool that is rotatable *about an axis* in a winding direction and an unwinding direction;

a tightening mechanism attached to the footwear member and coupled to the spool, the tightening mechanism including a control *comprising a rotatable knob* for winding the lace around the spool to place tension on the lace thereby pulling the opposing sides towards each other; and a safety device selectively moveable between a first secure position in which the spool is inhibited from rotating in an unwinding direction, and a second releasing position in which the spool is *uncoupled from the knob and* free to rotate *independent of the knob* in an unwinding direction;

wherein [the control comprises a rotatable knob for winding the lace around the spool, and] the safety device is *radially* moved *with respect to the axis of rotation of the spool* to its second releasing position by manipulating the knob.

7. A footwear lacing system as in claim 1, wherein the first opposing side is a vamp configured to extend from one [side] *portion* of the [shoe] *footwear member*, across [the] *an* upper midline of the [shoe] *footwear member*, and to [the] *an* opposing [side] *portion* of the [shoe] *footwear member*.

8. A footwear lacing system as in claim 7, wherein the [reel] *spool* is mounted to the first opposing side.

23. A footwear lacing system as in claim 22, wherein the expansion limiting band is positioned on the footwear such that it surrounds [the wearer's ankle] *an ankle portion of the footwear member*.

102. A footwear lacing system, comprising:

a footwear member including first and second opposing sides configured to fit around a foot;

a plurality of lace guide members positioned on the first and second opposing sides;

a lace guided by the guide members, the lace linked to a spool that is rotatable in a winding direction and an unwinding direction;

a tightening mechanism attached to the footwear member and coupled to the spool, the tightening mechanism including a control *comprising a rotatable knob* for winding the lace around the spool to place tension on the lace thereby pulling the opposing sides towards each other; and a safety device selectively moveable between a first secure position in which the spool is inhibited from rotating in an unwinding direction, and a second releasing position in which the spool is *uncoupled from the knob and* free to rotate *independent of the knob* in an unwinding direction;

wherein the safety device is a rotatable release that allows selective unwinding of the spool, wherein [the control comprises a rotatable knob for winding the lace around the spool and] the safety device is moved to its second releasing position by rotating the knob in an unwinding direction.

126. A footwear lacing system, comprising:

a footwear member including first and second opposing sides configured to fit around a foot;

a plurality of lace guide members positioned on the first and second opposing sides;

a lace guided by the guide members, the lace linked to a spool that is rotatable in a winding direction and an unwinding direction;

a tightening mechanism attached to the footwear member and coupled to the spool, the tightening mechanism including a control *comprising a rotatable knob* for winding the lace around the spool to place tension on the lace thereby pulling the opposing sides towards each other; and a safety device selectively moveable between a first secure position in which the spool is inhibited from rotating in an unwinding direction, and a second releasing position in which the spool is *uncoupled from the knob and* free to rotate in an unwinding direction *independent of the knob*;

wherein the safety device is a rotatable release that allows selective unwinding of the spool, further comprising a second safety device that selectively allows the knob to rotate in an unwinding direction.

*182. The footwear lacing system of claim 1, wherein the rotatable knob is positioned in the same axial position when the safety device is in the first secure position and in the second releasing position.*

*183. The footwear lacing system of claim 1, wherein the safety device is positioned in the same axial position when in the first secure position and in the second releasing position.*

*184. The footwear lacing system of claim 102, wherein the rotatable knob is positioned in the same axial position when the safety device is in the first secure position and in the second releasing position.*

*185. The footwear lacing system of claim 102, wherein the safety device is positioned in the same axial position when in the first secure position and in the second releasing position.*

*186. The footwear lacing system of claim 126, wherein the rotatable knob is positioned in the same axial position when the safety device is in the first secure position and in the second releasing position.*

*187. The footwear lacing system of claim 126, wherein the safety device is positioned in the same axial position when in the first secure position and in the second releasing position.*

*188. The footwear lacing system of claim 4, wherein the second safety device has an engaged position in which the knob is prevented from rotating in the unwinding direction and a disengaged position in which the knob is allowed to rotate in the unwinding direction, and wherein rotating the knob in the unwinding direction moves the safety device to the second releasing position to uncouple to the spool from the knob.*

*189. The footwear lacing system of claim 126, wherein the second safety device has an engaged position in which the knob is prevented from rotating in the unwinding direction and a disengaged position in which the knob is allowed to rotate in the unwinding direction, and wherein rotating the knob in the unwinding direction moves the safety device to the second releasing position to uncouple to the spool from the knob.*

* * * * *